US008237748B2

(12) United States Patent
Kwan et al.

(10) Patent No.: US 8,237,748 B2
(45) **Date of Patent: *Aug. 7, 2012**

(54) DISPLAY DEVICE AND DRIVING METHOD FACILITATING UNIFORM RESOURCE REQUIREMENTS DURING DIFFERENT INTERVALS OF A MODULATION PERIOD

(75) Inventors: Kin Yip Kenneth Kwan, San Jose, CA (US); Andrea Nguyen, San Jose, CA (US); Sunny Yat-san Ng, Cupertino, CA (US); William K. Zuravleff, Mountain View, CA (US)

(73) Assignee: OmniVision Technologies, Inc., Santa Clara, CA (US)

( * ) Notice: Subject to any disclaimer, the term of this patent is extended or adjusted under 35 U.S.C. 154(b) by 1159 days.

This patent is subject to a terminal disclaimer.

(21) Appl. No.: 12/011,606

(22) Filed: Jan. 28, 2008

(65) Prior Publication Data

US 2009/0027364 A1 Jan. 29, 2009

Related U.S. Application Data

(62) Division of application No. 11/881,732, filed on Jul. 27, 2007.

(51) Int. Cl.
*G09G 5/10* (2006.01)

(52) U.S. Cl. ..... 345/690

(58) Field of Classification Search ..... 345/87–100, 345/103, 204, 690–693

See application file for complete search history.

(56) References Cited

U.S. PATENT DOCUMENTS 4,591,842 A 5/1986 Clarke, Jr. et al.
4,745,475 A 5/1988 Bicknell
4,951,229 A 8/1990 DiNicola et al.
5,285,214 A 2/1994 Bowry
5,497,172 A 3/1996 Doherty et al.
5,570,297 A 10/1996 Brzezinski et al.
5,598,188 A 1/1997 Gove et al.
5,602,559 A 2/1997 Kimura
5,619,228 A 4/1997 Doherty (Continued)

FOREIGN PATENT DOCUMENTS

CN 1155136 A 7/1997

(Continued)

OTHER PUBLICATIONS

U.S. Appl. No. 11/881,732, Office Action dated Aug. 22, 2011.

(Continued)

*Primary Examiner* — Sumati Lefkowitz
*Assistant Examiner* — Rodney Amadiz
(74) *Attorney, Agent, or Firm* — Larry E. Henneman, Jr.; Henneman & Associates PLC

(57) ABSTRACT

A novel method for driving a display having an array of pixels arranged in a plurality of columns and a plurality of rows includes the steps of defining a modulation period for a row of pixels, dividing the modulation period into a number of coequal time intervals equal to n times the number of rows in the array, receiving a multi-bit data word that indicates an intensity value, and updating the signal asserted on the pixel during a plurality of the time intervals such that the intensity value is displayed by the pixel. Note that n is an integer greater than zero. The method can be applied to all rows, which can be driven asynchronously. A display driver for performing the novel methods is also disclosed. The present invention facilitates driving the display at 100% bandwidth efficiency during each time interval in the modulation period.

45 Claims, 54 Drawing Sheets

U.S. PATENT DOCUMENTS 5,668,611 A 9/1997 Ernstoff et al.
5,677,703 A 10/1997 Bhuva et al.
5,680,156 A 10/1997 Gove et al.
5,731,802 A 3/1998 Aras et al.
5,748,164 A 5/1998 Handschy et al.
5,757,347 A 5/1998 Han
5,767,818 A 6/1998 Nishida
5,940,142 A 8/1999 Wakitani et al.
5,969,710 A 10/1999 Doherty et al.
5,986,640 A 11/1999 Baldwin et al.
6,005,591 A 12/1999 Ogura et al.
6,008,785 A 12/1999 Hewlett et al.
6,072,452 A 6/2000 Worley, III et al.
6,100,939 A 8/2000 Kougami et al.
6,140,983 A 10/2000 Quanrud
6,144,356 A 11/2000 Weatherford et al.
6,144,364 A 11/2000 Otobe et al.
6,151,011 A 11/2000 Worley, III et al.
6,175,355 B1 1/2001 Reddy
6,201,521 B1 3/2001 Doherty
6,215,466 B1 4/2001 Yamazaki et al.
6,232,963 B1 5/2001 Tew et al.
6,246,386 B1 6/2001 Perner
6,295,054 B1 9/2001 McKnight
6,326,980 B1 12/2001 Worley, III
6,353,435 B2 3/2002 Kudo et al.
6,388,661 B1 5/2002 Richards
6,441,829 B1 8/2002 Blalock et al.
6,518,977 B1 2/2003 Ohsawa et al.
6,636,206 B1 10/2003 Yatabe
6,639,602 B1 10/2003 Fukushima et al.
6,771,240 B2 8/2004 Inoue et al.
6,809,717 B2 10/2004 Asao et al.
6,833,832 B2 12/2004 Wolverton
6,864,643 B2 3/2005 Min et al.
6,873,308 B2 3/2005 Sagano et al.
6,903,516 B2 6/2005 Tanada
6,965,357 B2 11/2005 Sakamoto et al.
6,972,773 B2 12/2005 Matsui et al.
6,982,722 B1 1/2006 Alben et al.
6,985,164 B2 1/2006 Rogers et al.
7,071,905 B1 7/2006 Fan
7,172,297 B2 2/2007 Whitehead et al.
7,184,035 B2 2/2007 Sato et al.
7,196,683 B2 3/2007 Yamamoto et al.
7,274,363 B2 9/2007 Ishizuka et al.
7,301,518 B2 11/2007 Hosaka
7,317,464 B2 1/2008 Willis
7,471,273 B2 12/2008 Hewlett et al.
7,499,065 B2 3/2009 Richards
7,545,396 B2 6/2009 Ng
7,580,047 B2 8/2009 Ng
7,580,048 B2 8/2009 Ng
7,580,049 B2 8/2009 Ng
7,605,831 B2 10/2009 Ng
7,692,671 B2 4/2010 Ng
7,903,123 B1 3/2011 Alben et al.
2004/1002095 9/2001 Onagawa
2002/0018054 A1 2/2002 Tojima et al.
2002/0018073 A1 2/2002 Stradley et al.
2002/0085438 A1 7/2002 Wolverton
2002/0135553 A1 9/2002 Nagai et al.
2002/0145585 A1 10/2002 Richards
2003/0034948 A1 2/2003 Imamura
2003/0048238 A1 3/2003 Tsuge et al.
2003/0063107 A1 4/2003 Thebault et al.
2003/0151599 A1 8/2003 Bone
2003/0210257 A1 11/2003 Hudson et al.
2004/0113879 A1 6/2004 Sekiguchi et al.
2004/0125117 A1 7/2004 Suzuki et al.
2004/0150596 A1 8/2004 Uchida et al.
2004/0150602 A1 8/2004 Furukawa et al.
2004/0218334 A1 11/2004 Martin et al.
2004/0239593 A1 12/2004 Yamada
2004/0239606 A1 12/2004 Ota
2005/0062709 A1 3/2005 Zeiter et al.
2005/0062765 A1 3/2005 Hudson
2005/0110720 A1 5/2005 Akimoto et al.
2005/0110811 A1 5/2005 Lee et al.
2006/0001613 A1 1/2006 Routley et al.
2006/0017746 A1 1/2006 Weithbruch et al.
2006/0044325 A1 3/2006 Thebault et al.
2006/0066645 A1 3/2006 Ng
2006/0267896 A1 11/2006 Edwards
2007/0008252 A1 1/2007 Seki
2007/0091042 A1 4/2007 Chung et al.
2008/0259019 A1 10/2008 Ng
2009/0027360 A1 1/2009 Kwan et al.
2009/0027361 A1 1/2009 Kwan et al.
2009/0027362 A1 1/2009 Kwan et al.
2009/0027363 A1 1/2009 Kwan et al.
2009/0303206 A1 12/2009 Ng
2009/0303207 A1 12/2009 Ng
2009/0303248 A1 12/2009 Ng
2010/0091004 A1 4/2010 Ng
2010/0259553 A9 10/2010 Van Belle

FOREIGN PATENT DOCUMENTS

EP 0698874 A1 2/1996
EP 0720139 A2 7/1996
EP 0762375 A2 3/1997
EP 0774745 B1 5/1997
EP 1937035 A2 6/2008
JP 08-511635 A 12/1996
JP 09-034399 A 2/1997
JP 09-083911 A 3/1997
JP 09-212127 A 8/1997
JP 10-31455 A 2/1998
TW 544645 B 8/2003
TW 544650 B 8/2003
WO WO 94/09473 A1 4/1994
WO WO 95/27970 A1 10/1995
WO WO 97/40487 A1 10/1997

OTHER PUBLICATIONS

U.S. Appl. No. 12/011,520, Office Action dated Oct. 7, 2011.
U.S. Appl. No. 12/011,605, Office Action dated Oct. 7, 2011.
U.S. Appl. No. 11/154,984, Office Action dated Feb. 27, 2008.
U.S. Appl. No. 11/154,984, Office Action dated Oct. 15, 2008.
U.S. Appl. No. 11/154,984, Notice of Allowance dated Jan. 27, 2009.
PCT Application No. PCT/US2006/020096, International Search Report and Written Opinion dated Oct. 9, 2007.
PCT Application No. PCT/US2006/020096, International Preliminary Report on Patentability dated Jan. 3, 2008.
TW Application No. 095118593, Office Action dated Jul. 27, 2011 (English translation).
U.S. Appl. No. 11/171,496, Office Action dated Feb. 27, 2008.
U.S. Appl. No. 11/171,496, Office Action dated Dec. 19, 2008.
U.S. Appl. No. 11/171,496, Notice of Allowance dated Apr. 3, 2009.
U.S. Appl. No. 11/172,622, Office Action dated Sep. 24, 2008.
U.S. Appl. No. 11/172,622, Notice of Allowance dated Jun. 8, 2009.
U.S. Appl. No. 11/172,621, Office Action dated Sep. 15, 2008.
U.S. Appl. No. 11/172,621, Notice of Allowance dated Apr. 17, 2009.
U.S. Appl. No. 11/172,382, Office Action dated Sep. 2, 2008.
U.S. Appl. No. 11/172,382, Office Action dated Apr. 10, 2009.
U.S. Appl. No. 11/172,382, Notice of Allowance dated Nov. 18, 2009.
U.S. Appl. No. 11/172,623, Office Action dated Sep. 23, 2008.
U.S. Appl. No. 11/172,623, Notice of Allowance dated Apr. 16, 2009.
U.S. Appl. No. 12/077,536, Office Action dated Jan. 5, 2012.
*An Overview of Flaws in Emerging Television Displays and Remedial Video Processing*, Gerard de Haan and Michiel A. Klompenhouwer, IEEE Transactions on Consumer Electronics, Aug. 2001, vol. 47, pp. 326-334.
U.S. Appl. No. 11/881,732, Interview Summary dated Feb. 23, 2012.
U.S. Appl. No. 12/011,604, Office Action dated Feb. 14, 2012.
U.S. Appl. No. 12/011,604, Interview Summary dated Feb. 23, 2012.
U.S. Appl. No. 12/011,520, Interview Summary dated Feb. 23, 2012.
U.S. Appl. No. 12/011,605, Interview Summary dated Feb. 24, 2012.
U.S. Appl. No. 12/157,190, Office Action dated May 26, 2011.
U.S. Appl. No. 12/157,190, Office Action dated Mar. 7, 2012.
U.S. Appl. No. 12/157,166, Office Action dated Jul. 8, 2011.
U.S. Appl. No. 12/157,166, Office Action dated Dec. 23, 2011.

U.S. Appl. No. 12/157,166, Interview Summary dated Feb. 22, 2012.
U.S. Appl. No. 12/157,189, Office Action dated Jul. 7, 2011.
U.S. Appl. No. 12/157,189, Office Action dated Dec. 29, 2011.
U.S. Appl. No. 12/157,189, Interview Summary dated Feb. 23, 2012.
U.S. Appl. No. 10/949,703, Office Action dated Aug. 14, 2009.
U.S. Appl. No. 10/949,703, Notice of Abandonment dated Mar. 1, 2010.
U.S. Appl. No. 09/032,174, Office Action dated Dec. 20, 1999.
U.S. Appl. No. 09/032,174, Notice of Allowance dated Jun. 2, 2000.
PCT Application Serial No. PCT/US1999/003847, International Search Report dated Jun. 16, 1999.
PCT Application Serial No. PCT/US1999/003847, Written Opinion dated Mar. 1, 2000.
PCT Application Serial No. PCT/US1999/003847, International Preliminary Examination Report dated Jul. 11, 2000.
CA Application Serial No. 2,322,510, Office Action dated Oct. 13, 2006.
CA Application Serial No. 2,322,510, Office Action dated Sep. 4, 2007.
CA Application Serial No. 2,322,510, Notice of Allowance dated Sep. 11, 2008.
CN Application Serial No. 99805193.4, Office Action dated Jan. 16, 2004.
CN Application Serial No. 99805193.4, Office Action dated Aug. 6, 2004.
CN Application Serial No. 99805193.4, Notice of Allowance dated Apr. 29, 2005.
EP Application Serial No. 99 936 139.7, Office Action dated Jul. 24, 2007.
EP Application Serial No. 99 936 139.7, Office Action dated Sep. 28, 2009.
EP Application Serial No. 99 936 139.7, Notice of Abandonment dated May 17, 2010.
JP Application Serial No. 2000-533866, Office Action dated Sep. 15, 2009.
JP Application Serial No. 2000-533866, Office Action dated Apr. 7, 2010.
JP Application Serial No. 2000-533866, Office Action dated Nov. 1, 2010.
U.S. Appl. No. 11/881,732, Notice of Allowance dated May 3, 2012.
U.S. Appl. No. 12/011,604, Interview Summary dated May 4, 2012.
U.S. Appl. No. 12/011,604, Notice of Allowance dated May 4, 2012.
U.S. Appl. No. 12/011,520, Notice of Allowance dated May 3, 2012.
U.S. Appl. No. 12/011,605, Notice of Allowance dated May 4, 2012.
U.S. Appl. No. 12/157,166, Notice of Allowance dated May 11, 2012.
U.S. Appl. No. 12/157,189, Notice of Allowance dated May 17, 2012.

1100

602 Data Word = { $2^0$, $2^1$, $2^2$, $2^3$, 9, 8, 8, 8 }

604 B = { $2^0$, $2^1$, $2^2$, $2^3$ }

606 T = { 9, 8, 8, 8 }

| Bit | Weight (Time Int.) | Update Time Interval (T_Event) |
|---|---|---|
| B0 | 1 | 0 |
| B1 | 2 | 1 |
| B2 | 4 | 3 |
| B3 | 8 | 7 |
| B4 | 9 | 15 |
| B5 | 8 | 24 |
| B6 | 8 | 32 |
| B7 | 8 | 40 |

1102 1104 1106

FIG. 11

1200

| 1202 Bit | 1204 Update Time Int. (T_Event) | 1206 Row Schedule for $\tau = 0$ | 1208 Row Schedule for $\tau = 1$ | 1210 Row Schedule for $\tau = 2$ | 1212 Row Schedule for $\tau = 3$ | 1214 Row Schedule for $\tau = 4$ |
|---|---|---|---|---|---|---|
| B0 | 0 | row 0 | row 1 | row 2 | row 3 | row 4 |
| B1 | 1 | row 47 | row 0 | row 1 | row 2 | row 3 |
| B2 | 3 | row 45 | row 46 | row 47 | row 0 | row 1 |
| B3 | 7 | row 41 | row 42 | row 43 | row 44 | row 45 |
| B4 | 15 | row 33 | row 34 | row 35 | row 36 | row 37 |
| B5 | 24 | row 24 | row 25 | row 26 | row 27 | row 28 |
| B6 | 32 | row 16 | row 17 | row 18 | row 19 | row 20 |
| B7 | 40 | row 8 | row 9 | row 10 | row 11 | row 12 |

FIG. 12

1300

Time Interval (τ) 1002(0-47)

| Row | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 0 | 0 | 1 | | 2 | | | | 3 | | | | | | | | 4 | | | | | | | | | 5 | | | | | | | 6 | | | | | | | | 7 | | | | | | |
| 1 | | 0 | 1 | | 2 | | | | 3 | | | | | | | | 4 | | | | | | | | | 5 | | | | | | | 6 | | | | | | | | 7 | | | | | |
| 2 | | | 0 | 1 | | 2 | | | | 3 | | | | | | | | 4 | | | | | | | | | 5 | | | | | | | 6 | | | | | | | | 7 | | | | |
| 3 | | | | 0 | 1 | | 2 | | | | 3 | | | | | | | | 4 | | | | | | | | | 5 | | | | | | | 6 | | | | | | | | 7 | | | |
| 4 | | | | | 0 | 1 | | 2 | | | | 3 | | | | | | | | 4 | | | | | | | | | 5 | | | | | | | 6 | | | | | | | | 7 | | |
| 5 | | | | | | 0 | 1 | | 2 | | | | 3 | | | | | | | | 4 | | | | | | | | | 5 | | | | | | | 6 | | | | | | | | 7 | |
| 6 | | | | | | | 0 | 1 | | 2 | | | | 3 | | | | | | | | 4 | | | | | | | | | 5 | | | | | | | 6 | | | | | | | | 7 |
| 7 | | | | | | | | 0 | 1 | | 2 | | | | 3 | | | | | | | | 4 | | | | | | | | | 5 | | | | | | | 6 | | | | | | | |
| 8 | 7 | | | | | | | | 0 | 1 | | 2 | | | | 3 | | | | | | | | 4 | | | | | | | | | 5 | | | | | | | 6 | | | | | | |
| 9 | | 7 | | | | | | | | 0 | 1 | | 2 | | | | 3 | | | | | | | | 4 | | | | | | | | | 5 | | | | | | | 6 | | | | | |
| 10 | | | 7 | | | | | | | | 0 | 1 | | 2 | | | | 3 | | | | | | | | 4 | | | | | | | | | 5 | | | | | | | 6 | | | | |
| 11 | | | | 7 | | | | | | | | 0 | 1 | | 2 | | | | 3 | | | | | | | | 4 | | | | | | | | | 5 | | | | | | | 6 | | | |
| 12 | | | | | 7 | | | | | | | | 0 | 1 | | 2 | | | | 3 | | | | | | | | 4 | | | | | | | | | 5 | | | | | | | 6 | | |
| 13 | | | | | | 7 | | | | | | | | 0 | 1 | | 2 | | | | 3 | | | | | | | | 4 | | | | | | | | | 5 | | | | | | | 6 | |
| 14 | | | | | | | 7 | | | | | | | | 0 | 1 | | 2 | | | | 3 | | | | | | | | 4 | | | | | | | | | 5 | | | | | | | 6 |
| 15 | | | | | | | | 7 | | | | | | | | 0 | 1 | | 2 | | | | 3 | | | | | | | | 4 | | | | | | | | | 5 | | | | | | | 6 |
| 16 | 6 | | | | | | | | 7 | | | | | | | | 0 | 1 | | 2 | | | | 3 | | | | | | | | 4 | | | | | | | | | 5 | | | | | | |
| 17 | | 6 | | | | | | | | 7 | | | | | | | | 0 | 1 | | 2 | | | | 3 | | | | | | | | 4 | | | | | | | | | 5 | | | | | |
| 18 | | | 6 | | | | | | | | 7 | | | | | | | | 0 | 1 | | 2 | | | | 3 | | | | | | | | 4 | | | | | | | | | 5 | | | | |
| 19 | | | | 6 | | | | | | | | 7 | | | | | | | | 0 | 1 | | 2 | | | | 3 | | | | | | | | 4 | | | | | | | | | 5 | | | |
| 20 | | | | | 6 | | | | | | | | 7 | | | | | | | | 0 | 1 | | 2 | | | | 3 | | | | | | | | 4 | | | | | | | | | 5 | | |
| 21 | | | | | | 6 | | | | | | | | 7 | | | | | | | | 0 | 1 | | 2 | | | | 3 | | | | | | | | 4 | | | | | | | | | 5 | |
| 22 | | | | | | | 6 | | | | | | | | 7 | | | | | | | | 0 | 1 | | 2 | | | | 3 | | | | | | | | 4 | | | | | | | | | 5 |
| 23 | | | | | | | | 6 | | | | | | | | 7 | | | | | | | | 0 | 1 | | 2 | | | | 3 | | | | | | | | 4 | | | | | | | | 5 |

814(0-23)

FIG. 13A

1300

Time Interval (τ) 1002(0-47)

| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 24 | 5 | | | | | | | | 6 | | | | | | | | 7 | | | | | | | 0 | 1 | | 2 | | | 3 | | | | | | 4 | | | | | | | | | | |
| 25 | | 5 | | | | | | | | 6 | | | | | | | | 7 | | | | | | | | 0 | 1 | | 2 | | | 3 | | | | | | 4 | | | | | | | | | |
| 26 | | | 5 | | | | | | | | 6 | | | | | | | | 7 | | | | | | | | 0 | 1 | | 2 | | | 3 | | | | | | 4 | | | | | | | | |
| 27 | | | | 5 | | | | | | | | 6 | | | | | | | | 7 | | | | | | | | 0 | 1 | | 2 | | | 3 | | | | | | 4 | | | | | | | |
| 28 | | | | | 5 | | | | | | | | 6 | | | | | | | | 7 | | | | | | | | 0 | 1 | | 2 | | | 3 | | | | | | 4 | | | | | | |
| 29 | | | | | | 5 | | | | | | | | 6 | | | | | | | | 7 | | | | | | | | 0 | 1 | | 2 | | | 3 | | | | | | 4 | | | | |
| 30 | | | | | | | 5 | | | | | | | | 6 | | | | | | | | 7 | | | | | | | | 0 | 1 | | 2 | | | 3 | | | | | | 4 | | |
| 31 | | | | | | | | 5 | | | | | | | | 6 | | | | | | | | 7 | | | | | | | | 0 | 1 | | 2 | | | 3 | | | | | | 4 | |
| 32 | | | | | | | | | 5 | | | | | | | | 6 | | | | | | | | 7 | | | | | | | | 0 | 1 | | 2 | | | 3 | | | | | | | 4 |
| 33 | 4 | | | | | | | | | 5 | | | | | | | | 6 | | | | | | | | 7 | | | | | | | | 0 | 1 | | 2 | | | 3 | | | | | | |
| 34 | | 4 | | | | | | | | | 5 | | | | | | | | 6 | | | | | | | | 7 | | | | | | | | 0 | 1 | | 2 | | | 3 | | | | |
| 35 | | | 4 | | | | | | | | | 5 | | | | | | | | 6 | | | | | | | | 7 | | | | | | | | 0 | 1 | | 2 | | | 3 | | | |
| 36 | | | | 4 | | | | | | | | | 5 | | | | | | | | 6 | | | | | | | | 7 | | | | | | | | 0 | 1 | | 2 | | | 3 | | |
| 37 | | | | | 4 | | | | | | | | | 5 | | | | | | | | 6 | | | | | | | | 7 | | | | | | | | 0 | 1 | | 2 | | | 3 | |
| 38 | | | | | | 4 | | | | | | | | | 5 | | | | | | | | 6 | | | | | | | | 7 | | | | | | | | 0 | 1 | | 2 | | | 3 |
| 39 | | | | | | | 4 | | | | | | | | | 5 | | | | | | | | 6 | | | | | | | | 7 | | | | | | | | 0 | 1 | | 2 | | |
| 40 | | | | | | | | 4 | | | | | | | | | 5 | | | | | | | | 6 | | | | | | | | 7 | | | | | | | | 0 | 1 | | 2 | |
| 41 | 3 | | | | | | | | 4 | | | | | | | | | 5 | | | | | | | | 6 | | | | | | | | 7 | | | | | | | | 0 | 1 | | 2 |
| 42 | | 3 | | | | | | | | 4 | | | | | | | | | 5 | | | | | | | | 6 | | | | | | | | 7 | | | | | | | | 0 | 1 | |
| 43 | | | 3 | | | | | | | | 4 | | | | | | | | | 5 | | | | | | | | 6 | | | | | | | | 7 | | | | | | | | 0 | 1 |
| 44 | | | | 3 | | | | | | | | 4 | | | | | | | | | 5 | | | | | | | | 6 | | | | | | | | 7 | | | | | | | | 0 | 1 |
| 45 | 2 | | | | 3 | | | | | | | | 4 | | | | | | | | | 5 | | | | | | | | 6 | | | | | | | | 7 | | | | | | | | 0 |
| 46 | | 2 | | | | 3 | | | | | | | | 4 | | | | | | | | | 5 | | | | | | | | 6 | | | | | | | | 7 | | | | | | | 0 |
| 47 | 1 | | 2 | | | | 3 | | | | | | | | 4 | | | | | | | | | 5 | | | | | | | | 6 | | | | | | | | 7 | | | | | | |

Row

814(24-47)

FIG. 13B

1602

| Time Interval | Read Row Address | | | | | | | |
|---|---|---|---|---|---|---|---|---|
| 0 | R0 | R47 | R45 | R41 | R33 | R24 | R16 | R8 |
| 1 | R1 | R0 | R46 | R42 | R34 | R25 | R17 | R9 |
| 2 | R2 | R1 | R47 | R43 | R35 | R26 | R18 | R10 |
| 3 | R3 | R2 | R0 | R44 | R36 | R27 | R19 | R11 |
| 4 | R4 | R3 | R1 | R45 | R37 | R28 | R20 | R12 |
| 5 | R5 | R4 | R2 | R46 | R38 | R29 | R21 | R13 |
| 6 | R6 | R5 | R3 | R47 | R39 | R30 | R22 | R14 |
| 7 | R7 | R6 | R4 | R0 | R40 | R31 | R23 | R15 |
| 8 | R8 | R7 | R5 | R1 | R41 | R32 | R24 | R16 |
| 9 | R9 | R8 | R6 | R2 | R42 | R33 | R25 | R17 |
| 10 | R10 | R9 | R7 | R3 | R43 | R34 | R26 | R18 |
| 11 | R11 | R10 | R8 | R4 | R44 | R35 | R27 | R19 |
| 12 | R12 | R11 | R9 | R5 | R45 | R36 | R28 | R20 |
| 13 | R13 | R12 | R10 | R6 | R46 | R37 | R29 | R21 |
| 14 | R14 | R13 | R11 | R7 | R47 | R38 | R30 | R22 |

FIG. 16A

602A Data Word = { $2^0$, $2^1$, $2^2$, $2^3$, 11, 10, 9, 9, 10, 10, 11, 11 }

604A B = { $2^0$, $2^1$, $2^2$, $2^3$ }

606A T = { 11, 10, 9, 9, 10, 10, 11, 11 }

| Bit | Weight | Update Time Interval (T_Event) | Row Number | Remainder Group |
|---|---|---|---|---|
| B0 | 1 | 0 | 48 (= row 0) | 0 |
| B1 | 2 | 1 | 47 | 1 |
| B2 | 4 | 3 | 46 | 1 |
| B3 | 8 | 7 | 44 | 1 |
| B4 | 11 | 15 | 40 | 1 |
| B5 | 10 | 26 | 35 | 0 |
| B6 | 9 | 36 | 30 | 0 |
| B7 | 9 | 45 | 25 | 1 |
| B8 | 10 | 54 | 21 | 0 |
| B9 | 10 | 64 | 16 | 0 |
| B10 | 11 | 74 | 11 | 0 |
| B11 | 11 | 85 | 5 | 1 |

2002 2004 2006 2008 2010

2000

FIG. 20

Tau = 0, Remainder Group 0, Counter = 0

| Row Schedule for Remainder Group 0 | Row Number + Counter | Bit Number |
|---|---|---|
| 48 (row 0) | 48 (row 0) | B0 |
| 35 | 35 | B5 |
| 30 | 30 | B6 |
| 21 | 21 | B8 |
| 16 | 16 | B9 |
| 11 | 11 | B10 |

2104 2106 2108

2102

FIG. 21A

Tau = 1, Remainder Group 1, Counter = 1

| Row Schedule for Remainder Group 1 | Row Number + Counter | Bit Number |
|---|---|---|
| 47 | 48 (= row 0) | B1 |
| 46 | 47 | B2 |
| 44 | 45 | B3 |
| 40 | 41 | B4 |
| 25 | 26 | B7 |
| 5 | 6 | B11 |

2112 2114 2116

2110

FIG. 21B

Tau = 2, Remainder Group 0, Counter = 1

| Row Schedule for Remainder Group 0 | Row Number + Counter | Bit Number |
|---|---|---|
| 48 (row 0) | 1 | B0 |
| 35 | 36 | B5 |
| 30 | 31 | B6 |
| 21 | 22 | B8 |
| 16 | 17 | B9 |
| 11 | 12 | B10 |

2120 2122 2124

2118

FIG. 21C

Tau = 3, Remainder Group 1, Counter = 2

| Row Schedule for Remainder Group 1 | Row Number + Counter | Bit Number |
|---|---|---|
| 47 | 1 | B1 |
| 46 | 0 | B2 |
| 44 | 46 | B3 |
| 40 | 42 | B4 |
| 25 | 27 | B7 |
| 5 | 7 | B11 |

2128 2130 2132

2126

FIG. 21D

2200

Time Interval (τ) 1902(0-95)

| | 0 | 1 | 2 | 3 | 4 | 5 | 6 | 7 | 8 | 9 | 10 | 11 | 12 | 13 | 14 | 15 | 16 | 17 | ... | 88 | 89 | 90 | 91 | 92 | 93 | 94 | 95 |
|---|---|---|---|---|---|---|---|---|---|---|---|---|---|---|---|---|---|---|---|---|---|---|---|---|---|---|---|
| 0 | 0 | 1 | | 2 | | | | 3 | | | | | | | | 4 | | | | | | | | | | | |
| 1 | | | 0 | 1 | | 2 | | | | 3 | | | | | | | | 4 | | | | | | | | | |
| 2 | | | | | 0 | 1 | | 2 | | | | 3 | | | | | | | | | 11 | | | | | | |
| 3 | | | | | | | 0 | 1 | | 2 | | | | 3 | | | | | | | | | 11 | | | | |
| 4 | | | | | | | | | 0 | 1 | | 2 | | | | 3 | | | | | | | | | 11 | | |
| 5 | | | | | | | | | | | 0 | 1 | | 2 | | | | 3 | | | | | | | | | 11 |
| 6 | | 11 | | | | | | | | | | | 0 | 1 | | 2 | | | | | | | | | | | |
| 7 | | | | 11 | | | | | | | | | | | 0 | 1 | | 2 | | 10 | | | | | | | |
| 8 | | | | | | 11 | | | | | | | | | | | 0 | 1 | | | | 10 | | | | | |
| ⋮ | | | | | | | | | | | | | | | | | | | | ⋮ | | | | | | | |
| 42 | | | | 4 | | | | | | | | | | | 5 | | | | | | | | 3 | | | | |
| 43 | | | | | | 4 | | | | | | | | | | | 5 | | | | 2 | | | | 3 | | |
| 44 | | | | | | | | 4 | | | | | | | | | | | | 0 | 1 | | 2 | | | | 3 |
| 45 | | 3 | | | | | | | | 4 | | | | | | | | | | | | 0 | 1 | | 2 | | |
| 46 | | | | 3 | | | | | | | | 4 | | | | | | | | | | | | 0 | 1 | | 2 |
| 47 | | 2 | | | | 3 | | | | | | | | 4 | | | | | | | | | | | | 0 | 1 |

Row 814(0-47)

FIG. 22

Data Word = { $B0_1$, $B1_2$, $B2_4$, $B3_8$, $B4_{11}$, $B5_{10}$, $B6_9$, $B7_9$, $B8_{10}$, $B9_{10}$, $B10_{11}$, $B11_{11}$}

2500

2702 Data Word = { $2^0$, $2^1$, $2^2$, $2^3$, $2^4$, $2^5$, $2^6$, $2^7$, 37, 36, 36, 36, ... }

2704 B = { $2^0$, $2^1$, $2^2$, $2^3$, $2^4$, $2^5$, $2^6$, $2^7$ }

2706 T ∈ $37_8$, $36_9$, $36_{10}$, $36_{11}$, $36_{12}$, $36_{13}$, $36_{14}$, $36_{15}$, $37_{16}$, $36_{17}$, $37_{18}$, $36_{19}$, $37_{20}$, $36_{21}$, $37_{22}$, $36_{23}$, $35_{24}$, $34_{25}$, $35_{26}$, $34_{27}$, $35_{28}$, $34_{29}$, $35_{30}$, $34_{31}$ }

3100

| Bit | Weight | T_Event | Row Schedule | Even | Odd |
|---|---|---|---|---|---|
| B0 | 1 | 0 | 1112 (= row 0) | X | |
| B1 | 2 | 1 | 1111 | | X |
| B2 | 4 | 3 | 1109 | | X |
| B3 | 8 | 7 | 1105 | | X |
| B4 | 16 | 15 | 1097 | | X |
| B5 | 32 | 31 | 1081 | | X |
| B6 | 64 | 63 | 1049 | | X |
| B7 | 128 | 127 | 985 | | X |
| B8 | 37 | 255 | 857 | | X |
| B9 | 36 | 292 | 820 | X | |
| B10 | 36 | 328 | 784 | X | |
| B11 | 36 | 364 | 748 | X | |
| B12 | 36 | 400 | 712 | X | |
| B13 | 36 | 436 | 676 | X | |
| B14 | 36 | 472 | 640 | X | |
| B15 | 36 | 508 | 604 | X | |
| B16 | 37 | 544 | 568 | X | |
| B17 | 36 | 581 | 531 | | X |
| B18 | 37 | 617 | 495 | | X |
| B19 | 36 | 654 | 458 | X | |
| B20 | 37 | 690 | 422 | X | |
| B21 | 36 | 727 | 385 | | X |
| B22 | 37 | 763 | 349 | | X |
| B23 | 36 | 800 | 312 | X | |
| B24 | 35 | 836 | 276 | X | |
| B25 | 34 | 871 | 241 | | X |
| B26 | 35 | 905 | 207 | | X |
| B27 | 34 | 940 | 172 | X | |
| B28 | 35 | 974 | 138 | X | |
| B29 | 34 | 1009 | 103 | | X |
| B30 | 35 | 1043 | 69 | | X |
| B31 | 34 | 1078 | 34 | X | |

3102 3104 3106 3108 3110 3112

FIG. 31

2702A Data Word = { $2^0$, $2^1$, $2^2$, $2^3$, $2^4$, $2^5$, $2^6$, $2^7$, 83, 82, 85, 85, ... }

2704A B = { $2^0$, $2^1$, $2^2$, $2^3$, $2^4$, $2^5$, $2^6$, $2^7$ }

2706A T = { 83, 82, 85, 85, 82, 85, . . . , 81, 81}

3400

| Bit | Weight | T_Event | Row Schedule | Remainder |
|---|---|---|---|---|
| B0 | 1 | 0 | 1112 (= row 0) | 0 |
| B1 | 2 | 1 | 1111 | 1 |
| B2 | 4 | 3 | 1110 | 1 |
| B3 | 8 | 7 | 1108 | 1 |
| B4 | 16 | 15 | 1104 | 1 |
| B5 | 32 | 31 | 1096 | 1 |
| B6 | 64 | 63 | 1080 | 1 |
| B7 | 128 | 127 | 1048 | 1 |
| B8 | 83 | 255 | 984 | 1 |
| B9 | 82 | 338 | 943 | 0 |
| B10 | 85 | 420 | 902 | 0 |
| B11 | 85 | 505 | 859 | 1 |
| B12 | 82 | 590 | 817 | 0 |
| B13 | 85 | 672 | 776 | 0 |
| B14 | 85 | 757 | 733 | 1 |
| B15 | 82 | 842 | 691 | 0 |
| B16 | 81 | 924 | 650 | 0 |
| B17 | 81 | 1005 | 609 | 1 |
| B18 | 82 | 1086 | 569 | 0 |
| B19 | 81 | 1168 | 528 | 0 |
| B20 | 81 | 1249 | 487 | 1 |
| B21 | 82 | 1330 | 447 | 0 |
| B22 | 81 | 1412 | 406 | 0 |
| B23 | 81 | 1493 | 365 | 1 |
| B24 | 82 | 1574 | 325 | 0 |
| B25 | 81 | 1656 | 284 | 0 |
| B26 | 81 | 1737 | 243 | 1 |
| B27 | 82 | 1818 | 203 | 0 |
| B28 | 81 | 1900 | 162 | 0 |
| B29 | 81 | 1981 | 121 | 1 |
| B30 | 81 | 2062 | 81 | 0 |
| B31 | 81 | 2143 | 40 | 1 |

3402 3404 3406 3408 3410

FIG. 34

3502

Tau = 0, Remainder Set 0, Counter = 0

| Row Schedule for Remainder Group 0 | Row Number + Counter | Bit Number |
|---|---|---|
| 1112 (row 0) | 1112 (row 0) | B0 |
| 943 | 943 | B9 |
| 902 | 902 | B10 |
| 817 | 817 | B12 |
| 776 | 776 | B13 |
| 691 | 691 | B15 |
| 650 | 650 | B16 |
| 569 | 569 | B18 |
| 528 | 528 | B19 |
| 447 | 447 | B21 |
| 406 | 406 | B22 |
| 325 | 325 | B24 |
| 284 | 284 | B25 |
| 203 | 203 | B27 |
| 162 | 162 | B28 |
| 81 | 81 | B30 |

3504 3506 3508

FIG. 35A

3510

Tau = 1, Remainder Set 1, Counter = 1

| Row Schedule for Remainder Group 1 | Row Number + Counter | Bit Number |
|---|---|---|
| 1111 | 1112 (row 0) | B1 |
| 1110 | 1111 | B2 |
| 1108 | 1109 | B3 |
| 1104 | 1105 | B4 |
| 1096 | 1097 | B5 |
| 1080 | 1081 | B6 |
| 1048 | 1049 | B7 |
| 984 | 985 | B8 |
| 859 | 860 | B11 |
| 733 | 734 | B14 |
| 609 | 610 | B17 |
| 487 | 488 | B20 |
| 365 | 366 | B23 |
| 243 | 244 | B26 |
| 121 | 122 | B29 |
| 40 | 41 | B31 |

3512 3514 3516

FIG. 35B

3518

Tau = 2, Remainder Set 0, Counter = 1

| Row Schedule for Remainder Group 0 | Row Number + Counter | Bit Number |
|---|---|---|
| 1112 (row 0) | 1 | B0 |
| 943 | 944 | B9 |
| 902 | 903 | B10 |
| 817 | 818 | B12 |
| 776 | 777 | B13 |
| 691 | 692 | B15 |
| 650 | 651 | B16 |
| 569 | 570 | B18 |
| 528 | 529 | B19 |
| 447 | 448 | B21 |
| 406 | 407 | B22 |
| 325 | 326 | B24 |
| 284 | 285 | B25 |
| 203 | 204 | B27 |
| 162 | 163 | B28 |
| 81 | 82 | B30 |

3520 3522 3524

FIG. 35C

3526

Tau = 3, Remainder Set 1, Counter = 2

| Row Schedule for Remainder Group 1 | Row Number + Counter | Bit Number |
|---|---|---|
| 1111 | 1 | B1 |
| 1110 | 1112 (row 0) | B2 |
| 1108 | 1110 | B3 |
| 1104 | 1106 | B4 |
| 1096 | 1098 | B5 |
| 1080 | 1082 | B6 |
| 1048 | 1050 | B7 |
| 984 | 986 | B8 |
| 859 | 861 | B11 |
| 733 | 735 | B14 |
| 609 | 611 | B17 |
| 487 | 489 | B20 |
| 365 | 367 | B23 |
| 243 | 245 | B26 |
| 121 | 123 | B29 |
| 40 | 42 | B31 |

3528 3530 3532

FIG. 35D

Data Word = $\{B0_1, B1_2, B2_4, B3_8, B4_{16}, B5_{32}, B6_{64}, B7_{128}, B7_{83}, B9_{82}, B10_{85}, B11_{85}, B12_{82}, B13_{85}, B14_{85}, B15_{82}, B16_{81}, B17_{81}, B18_{82}, B19_{81}, B20_{81}, B21_{82}, B22_{81}, B23_{81}, B24_{82}, B25_{81}, B26_{81}, B27_{82}, B28_{81}, B29_{81}, B30_{81}, B31_{81}\}$

3600

3700

3702(0) 3702(1) 3702(23)

Time Interval (τ)

| Row | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| 0 | 0 | 1 | | 2 | | | | 3 | | | | | | | | 4 | | | | | 5 | | | |
| 1 | 0 | 1 | | 2 | | | | 3 | | | | | | | | 4 | | | | | 5 | | | |
| 2 | | 0 | 1 | | 2 | | | | 3 | | | | | | | | 4 | | | | | 5 | | |
| 3 | | 0 | 1 | | 2 | | | | 3 | | | | | | | | 4 | | | | | 5 | | |
| 4 | | | 0 | 1 | | 2 | | | | 3 | | | | | | | | 4 | | | | | 5 | |
| 5 | | | 0 | 1 | | 2 | | | | 3 | | | | | | | | 4 | | | | | 5 | |
| 6 | | | | 0 | 1 | | 2 | | | | 3 | | | | | | | | 4 | | | | | 5 |
| 7 | | | | 0 | 1 | | 2 | | | | 3 | | | | | | | | 4 | | | | | 5 |
| 8 | 5 | | | | 0 | 1 | | 2 | | | | 3 | | | | | | | | 4 | | | | |
| ⋮ | | | | | | | | | | | | | | | | | | | | | | | | |
| 43 | 2 | | | | 3 | | | | | | | | 4 | | | | | 5 | | | | 0 | 1 | |
| 44 | | 2 | | | | 3 | | | | | | | | 4 | | | | | 5 | | | | 0 | 1 |
| 45 | | 2 | | | | 3 | | | | | | | | 4 | | | | | 5 | | | | 0 | 1 |
| 46 | 1 | | 2 | | | | 3 | | | | | | | | 4 | | | | | 5 | | | | 0 |
| 47 | 1 | | 2 | | | | 3 | | | | | | | | 4 | | | | | 5 | | | | 0 |

814(0-47)

FIG. 37

3802 Data Word = { $2^0$, $2^1$, $2^2$, $2^3$, 5, 4 }

3804 B = { $2^0$, $2^1$, $2^2$, $2^3$ }

3806 T = { 5, 4 }

3800

| Bit | Weight (Time Int.) | Update Time Int. (T_Event) | Row Schedule for $\tau = 0$ | Row Schedule for $\tau = 1$ |
|---|---|---|---|---|
| B0 | 1 | 0 | 0<br>1 | 2<br>3 |
| B1 | 2 | 1 | 46<br>47 | 0<br>1 |
| B2 | 4 | 3 | 42<br>43 | 44<br>45 |
| B3 | 8 | 7 | 34<br>35 | 36<br>37 |
| B4 | 5 | 15 | 18<br>19 | 20<br>21 |
| B5 | 4 | 20 | 8<br>9 | 10<br>11 |

3808 3810 3812 3814 3816

FIG. 38

DISPLAY DEVICE AND DRIVING METHOD FACILITATING UNIFORM RESOURCE REQUIREMENTS DURING DIFFERENT INTERVALS OF A MODULATION PERIOD

RELATED APPLICATIONS

This application is a division of co-pending U.S. patent application Ser. No. 11/881,732, entitled "Display Device And Driving Method," filed Jul. 27, 2007 by the same inventors, which is incorporated by reference herein in its entirety.

BACKGROUND

1. Field of the Invention

This invention relates generally to driving electronic displays, and more particularly to a display driver circuit and methods for driving a multi-pixel liquid crystal display. Even more particularly, the present invention relates to a driver circuit and method for driving a liquid crystal on silicon display device with a digital backplane.

2. Description of the Background Art

FIG. 1 shows a block diagram of a prior art display driver 100 for driving an imager 102, which includes a pixel array 104 having 1952 columns and 1112 rows. Display driver 100 also includes a select decoder 105, a row decoder 106, and a timing generator 108. In addition to pixel array 104, imager 102 also includes an input buffer 110, which receives and stores 4-bit video data from a system (e.g., a computer that is not shown). Timing generator 108 generates timing signals by methods well known to those skilled in the art, and provides the timing signals to select decoder 105 and row decoder 106 via a timing signal line 112 to coordinate the modulation of pixel array 104.

Video data is written into input buffer 110 according to methods well known in the art. In the present embodiment, input buffer 110 stores a single frame of video data for each pixel in pixel array 104. When input buffer 110 receives a command from the system (not shown), input buffer 110 asserts video data for each pixel of a particular row of pixel array 104 onto all 1952 output terminals 114. In the present example, input buffer 110 must be sufficiently large to accommodate four bits of video data for each pixel of pixel array 104. Therefore, input buffer 110 is approximately 8.68 Megabits (i.e., 1952×1112×4 bits) in size. Of course, if the number of of bits in the video data increases (e.g., 8-bit video data), then the required capacity of input buffer 110 would necessarily increase proportionately.

The size requirement of input buffer 110 is a significant disadvantage. First, the circuitry of input buffer 110 occupies space on imager 102. As the required memory capacity increases, the chip space required by input buffer 110 also increases, thus hindering the ever present objective of size reduction in integrated circuits. Further, as the memory capacity increases, the number of storage devices increases, thereby increasing the probability of manufacturing defects, which reduces the yield of the manufacturing process and increase the cost of imager 102.

Row decoder 106 receives row addresses from the system (not shown) via a row address bus 116, and responsive to a store command from timing generator 108, row decoder 106 stores the asserted row address. Then, responsive to row decoder 106 receiving a decode instruction from timing generator 108, row decoder 106 decodes the stored row address and enables one of 1112 word-lines 118 corresponding to the decoded row address. Enabling word-line 118 causes data being asserted on data output terminals 114 of input buffer 110 to be latched into the enabled row of pixel cells in pixel array 104.

Select decoder 105 receives block addresses from the system (not shown) via a block address bus 120. Responsive to receiving a store block address command from timing signal generator 108 via timing signal line 112, select decoder 105 stores the asserted block address therein. Then, responsive to timing generator 108 asserting a load block address instruction on timing signal line 112, select decoder 105 decodes the asserted block address and asserts a block update signal on one of 35 block select lines 122 corresponding to the decoded block address. The block update signal on the corresponding block select line 122 causes all of the pixels cells of an associated block of rows of pixel array 104 to assert the previously latched video data onto their associated pixel electrodes (not shown in FIG. 1).

Note that the number of rows (i.e., 1112) in pixel array 104 is not evenly divisible into 35 blocks. Accordingly, different blocks will have different numbers of rows. For example, in one embodiment, if 34 of the 35 blocks each contained 32 rows, then the $35^{th}$ block would contain only 24 rows. Alternatively, if 27 of the 35 blocks contained 32 rows each, then the remaining 8 blocks would contain 31 rows each. In either case, the number of rows updated in each block will vary. This variation in the number of rows assigned to each block will cause the bandwidth and power requirements of display driver 100 and imager 102 to also vary over each frame of display data.

FIG. 2A shows an example dual-latch pixel cell 200(*r,c,b*) of imager 102, where (r), (c), and (b) indicate the row, column, and block of the pixel cell, respectively. Pixel cell 200 includes a master latch 202, a slave latch 204, a pixel electrode 206 (e.g., a mirror electrode overlying the circuitry layer of imager 102), and switching transistors 208, 210, and 212. Master latch 202 is a static random access memory (SRAM) latch. One input of master latch 202 is coupled, via transistor 208, to a Bit+ data line 214(*c*), and the other input of master latch 202 is coupled, via transistor 210, to a Bit− data line 216(*c*). The gate terminals of transistors 208 and 210 are coupled to word line 118(*r*). The output of master latch 202 is coupled, via transistor 212, to the input of slave latch 204. The gate terminal of transistor 212 is coupled to block select line 122(*b*). The output of slave latch 204 is coupled to pixel electrode 206.

An enable signal on word line 118(*r*) places transistors 208 and 210 into a conducting state, causing the complementary data asserted on data lines 214(*c*) and 216(*c*) to be latched, such that the output of master latch 202 is at the same logic level as data line 214(*c*). A block select signal on block select line 122(*b*) places transistor 212 into a conducting state, and causes the data being asserted on the output of master latch 202 to be latched onto the output of slave latch 204 and thus onto pixel electrode 206.

Although the master-slave latch design functions well, it is a disadvantage that each pixel cell requires two storage latches. It is also a disadvantage that separate circuitry is required to write data to the pixel cells and to cause the stored data to be asserted on the pixel electrode.

FIG. 2B shows the light modulating portion of pixel cell 200 (*r, c, b*) in greater detail. Pixel cell 200 further includes a portion of a liquid crystal layer 218, contained between a transparent common electrode 220 and pixel storage electrode 206. Liquid crystal layer 218 rotates the polarization of light passing through it, the degree of rotation depending on the root-mean-square (RMS) voltage across liquid crystal layer 218.

The ability to rotate the polarization is exploited to modulate the intensity of reflected light as follows. An incident light beam 222 is polarized by a polarizer 224. The polarized beam then passes through liquid crystal layer 218, is reflected off of pixel electrode 206, and passes again through liquid crystal layer 218. During this double pass through liquid crystal layer 218, the beam's polarization is rotated by an amount which depends on the data being asserted on pixel electrode 206 by slave latch 204 (FIG. 2A). The beam then passes through polarizer 226, which passes only that portion of the beam having a specified polarity. Thus, the intensity of the reflected beam passing through polarizer 226 depends on the amount of polarization rotation induced by liquid crystal layer 218, which in turn depends on the data being asserted on pixel electrode 206 by slave latch 204.

A common way to drive pixel electrode 206 is via pulse-width-modulation (PWM). In PWM, different gray scale levels (i.e., intensity values) are represented by multi-bit words (i.e., binary numbers). The multi-bit words are converted to a series of pulses, whose time-averaged root-mean-square (RMS) voltage corresponds to the analog voltage necessary to attain the desired gray scale value.

For example, in a 4-bit PWM scheme, the frame time (time in which a gray scale value is written to every pixel) is divided into 15 time intervals. During each interval, a signal (high, e.g., 5V or low, e.g., 0V) is asserted on the pixel storage electrode 106. There are, therefore, 16 (0-15) different gray scale values possible. The actual value displayed depends on the number of "high" pulses asserted during the frame time. The assertion of 0 high pulses corresponds to a gray scale value of 0 (RMS 0V), whereas the assertion of 15 high pulses corresponds to a gray scale value of 15 (RMS 5V). Intermediate numbers of high pulses correspond to intermediate gray scale levels.

FIG. 3 shows a series of pulses corresponding to the 4-bit gray scale value (1010), where the most significant bit is the far left bit. In this example of binary-weighted pulse-width modulation, the pulses are grouped to correspond to the bits of the binary gray scale value. Specifically, the first group B3 includes 8 intervals ($2^3$), and corresponds to the most significant bit of the value (1010). Similarly, group B2 includes 4 intervals ($2^2$) corresponding to the next most significant bit, group B1 includes 2 intervals ($2^1$) corresponding to the next most significant bit, and group B0 includes 1 interval ($2^0$) corresponding to the least significant bit. This grouping reduces the number of pulses required from 15 to 4, one for each bit of the binary gray scale value, with the width of each pulse corresponding to the significance of its associated bit. Thus, for the value (1010), the first pulse B3 (8 intervals wide) is high, the second pulse B2 (4 intervals wide) is low, the third pulse B1 (2 intervals wide) is high, and the last pulse B0 (1 interval wide) is low. This series of pulses results in an RMS voltage that is approximately $$\sqrt{\frac{2}{3}}$$

(10 of 15 intervals) of the full value (5V), or approximately 4.1V.

Because the liquid crystal cells are susceptible to deterioration due to ionic migration resulting from a DC voltage being applied across them, the above described PWM scheme is modified as shown in FIG. 4. The frame time is divided in half. During the first half, the PWM data is asserted on the pixel storage electrode, while the common electrode is held low. During the second half of the frame time, the complement of the PWM data is asserted on the pixel storage electrode, while the common electrode is held high. This results in a net DC component of 0V, avoiding deterioration of the liquid crystal cell, without changing the RMS voltage across the cell, as is well known to those skilled in the art. Although pixel array 104 is debiased, the bandwidth between input buffer 110 and pixel array 104 is increased to accommodate the increased number of pulse transitions.

The resolution of the gray scale can be improved by adding additional bits to the binary gray scale value. For example, if 8 bits are used, the frame time is divided into 255 intervals, providing 256 possible gray scale values. In general, for (n) bits, the frame time is divided into ($2^n-1$) intervals, yielding ($2^n$) possible gray scale values. However, as the number of bits and grayscale values increase, the display driver 100 and imager 102 have to operate faster to accommodate additional bit processing.

If the PWM data shown in FIG. 4 was written to pixel cell 200 of pixel array 104 then the digital value of pixel electrode 206 would transition between a digital high and digital low value six times within the frame. It is well known that there is a delay between when the data is first asserted on pixel electrode 206 and when the intensity output of pixel 200 actually corresponds to the steady state RMS voltage of the grayscale value being asserted. This delay is referred to as the "rise time" of the cell, and results from the physical properties of the liquid crystals. The cell rise time can cause undesirable visual artifacts in the image produced by pixel array 104 such as blurred moving objects and/or moving objects that leave ghost trails. In any case, the severity of the aberrations in the visual image increases with an increase of pulse transitions asserted on pixel electrode 206. Further, visually perceptible aberrations result from the assertion of opposite digital values on adjacent pixel electrodes for a significant portion of the frame time, at least in part to the lateral field affect between adjacent pixels.

What is needed is a system and method that equalizes the transfer bandwidth to the imager and the power requirements needed to update rows of pixels in the imager. What is also needed is a system and method that facilitates processing many display instructions during each frame of display data. What is also needed is a system and method that reduces the number of pulse transitions experienced by the pixels of a display. What is also needed is a system and method that reduces the amount of input memory needed to drive the display. What is also needed is a system and method that reduces visually perceptible aberrations in images generated by a display. What is also needed is a driving circuit and method that can drive pixel arrays with only one storage latch per pixel.

SUMMARY

The present invention overcomes the problems associated with the prior art by providing a display driver and method that equalizes the bandwidth between the display driver and the imager over the entire frame. The invention facilitates transferring the same amount of video data during each time interval within a frame by setting the number of time intervals equal to an integer multiple of the number of rows in the display. By equalizing the bandwidth, the power requirements needed to update the pixels in the display are equalized over the frame. The invention also facilitates spreading any unused frame time over the entire frame based on the number of row updates performed during the frame. Furthermore, the invention facilitates driving different portions of an imager's display with different iterations of pixel control circuitry, thereby enabling more intensity values to be defined by each pixel in the display.

The present invention discloses a method for driving a display device having an array of pixels arranged in a plurality of columns and a plurality of rows. The method includes the steps of defining a modulation period for a row of pixels, dividing the modulation period into a plurality of time intervals equal to n times the number of rows in the array, receiving a multi-bit data word that indicates an intensity value to be asserted on a pixel in the row, and updating the signal asserted on the pixel during at least some of the time intervals in the modulation period such that the intensity value defined by the multi-bit data word is displayed by the pixel. Note that n is an integer greater than zero, such as one, two, three, four, and so on.

This method can be applied to all rows by defining a plurality of modulation periods, associating each of the modulation periods with one of the rows in the display, dividing each of the modulation periods into a plurality of time intervals equal to n times the number of rows in the array, receiving a plurality of multi-bit data words that each define an intensity value to be asserted on one of the pixels in the array, and updating the signals asserted on the pixels in each row of the array during a plurality of time intervals in the row's modulation period such that each of the pixels display an intensity value defined by one of the data words. In this particular method, one or more of the modulation periods is temporally offset from the other modulation periods. In particular method, each modulation period is temporally offset by n time intervals from the previous modulation period.

Where n is greater than one, a particular method includes the steps of defining n groups, associating each time interval with one of the groups, and updating the signal on a pixel in a particular row during an equal number of time intervals associated with each group during the pixel's modulation period. A more particular method includes updating the signal on the pixel in (b/n) ones of the time intervals associated with each group during the modulation period, where b equals the number of bits in the multi-bit data word. Where multiple modulation periods are defined for multiple rows, the method further includes updating signals asserted on pixels in the same number of rows during each of the time intervals.

The bit codes of data words used to carry out the various aspects of the present invention are, in some instances, subject to some limitations. According to one aspect of the present invention, the sum of the weighted values of the bits in each multi-bit data word should be equal to n times the number of rows in the array. In addition, the number of bits in the multi-bit data word should be evenly divisible by n. These limitations ensure that an equal number of rows in the display will be updated during each time interval, which ensures 100% bandwidth efficiency between the display driver and the imager(s).

According to another aspect of the present invention where the imager(s) contain (s) iterations of pixel control units and the rows are allocated among (s) sets of rows, then the following additional limitations on the bit code of the data words also apply. First, the sum of the weighted values in each data word should be evenly divisible by s*n, where (s) equals the number of iterations of pixel control circuitry in the imager(s) and (n) is given above. Second, the number of bits in each data word should be evenly divisibly by s*n. Third, an equal number of rows assigned to each of the (s) sets should be updated by each pixel control circuitry unit. This aspect of the invention increases the processing capability of the imagers because each imager can process more data instructions because of the multiple pixel control units.

A particular method according to this aspect of the present invention includes associating each of the rows in the array with one of a plurality of sets of rows and updating the electrical signals asserted on the pixels in a plurality of the rows during each time interval such that each pixel control unit updates only the rows associated with a particular set. For example, for (s) equals two, the even-numbered rows in an imager's display can be associated with a first set, and the odd-numbered rows in the display can be associated with a second set. Accordingly, in an imager with two pixel control units, one pixel control unit updates the even-numbered rows, and the other pixel control unit updates the odd-numbered rows. If both pixel control units update the same number or rows during each time interval, then each pixel control unit operates at 100% efficiency during each time interval.

In many cases, the multi-bit data words of the present methods will be compound data words having both binary-coded bits and thermometer-coded bits. Because intensity values are commonly defined by binary-weighted data words, a particular method of the present invention includes the steps of receiving a binary-weighted data word and converting the binary-weighted data word into a compound data word having at least one binary-coded bit and at least one thermometer-coded bit.

The present invention also provides methods for debiasing the display device and discarding one or more bits of a multi-bit data word before an associated pixel's modulation period is over. For example, where each pixel in the array includes a liquid crystal layer between a pixel electrode and a common electrode, a method for debiasing the pixel array includes the steps of asserting a signal on a pixel relative to the common electrode in a first bias direction during a first group of time intervals in the pixel's modulation period, and asserting the signal on the pixel in a second bias direction during a second group of time intervals. In addition, the method for discarding bits includes the steps of discarding at least one bit of a multi-bit data word prior to the end of the modulation period, and updating the signal on the pixel based on the remaining bits of the multi-bit data word so that the pixel still displays the correct intensity value.

A novel display driver for driving an array of pixels arranged in a plurality of columns and a plurality of rows is also disclosed. The display driver includes a timer that generates a series of time values each associated with one of a plurality of time intervals, a data input terminal set that receives a multi-bit data word indicative of an intensity value to be asserted on the pixel, and control logic that defines a modulation period during which a signal corresponding to the intensity value will be asserted on the pixel and updates the signal during a plurality of the time intervals so that the pixel displays the intensity value. The control logic defines a modulation period with a number of time intervals equal to n times the number of rows in the array, where n is an integer greater than zero.

The display driver drives each row of the array in a similar manner. In a particular embodiment, the data input terminal set receives a plurality of multi-bit data words, each associated with a pixel of the array, and the control logic defines a modulation period for each row in the array and temporally offsets at least one of the modulation periods with respect to every other modulation period. The control logic further updates the signals asserted on pixels in each row during at least some of time intervals in the row's respective modulation period such that an intensity value is asserted on each pixel. Note that each modulation period defined by the control logic contains a number of time intervals equal to n times the number of rows in the array. In a particular embodiment, each modulation period is temporally offset from the previous modulation period by n time intervals.

Where n is greater than one, the control logic is further operative to define n groups of time intervals, associate each time interval in a modulation period to one of the groups, and then update the signals on a pixel in the row during an equal number time intervals assigned to each group during the row's modulation periods. In a more particular method, the control logic updates the signal on the pixel in (b/n) ones of the time intervals associated with each group during the pixel's modulation period, where b equals the number of bits in the multi-bit data word. Where the control logic defines multiple modulation periods for multiple rows, the control logic is further operative to update signals asserted on pixels in the same number of rows during each of the time intervals.

The control logic of the present invention is also operative to convert a binary-weighted data word (received via data input terminal set) into a compound data word having one or more binary bits and thermometer bits.

The display driver also includes components to debias the display and to discard bits of data words before the end of a rows respective modulation period. For example, where each pixel in the array includes a liquid crystal layer disposed between a common electrode and a pixel electrode, the display driver further includes a debias controller that provides a first debias signal indicative of a first bias direction for a first group of the time intervals in a pixel's modulation period and a second debias signal indicative of a second bias direction for a second group of time intervals. In another particular embodiment, the control logic is further operative to discard at least one bit of the multi-bit data word prior to the end of the modulation period and update the signal on the pixel based on any of the remaining bits such that the intensity value of the original data word is still asserted on the pixel.

Another aspect of the present invention facilitates 100% bandwidth and operation efficiency during each time interval in a frame. A particular method for driving an array of pixels includes the steps of defining a plurality of modulation periods during which electrical signals corresponding to particular intensity values will be asserted on pixels in rows of the array, associating each modulation period with at least one of the rows in the array, and then dividing each of the modulation periods into a plurality of coequal time intervals. In addition, the method also includes the steps of receiving a plurality of multi-bit data words that are each indicative of one of the intensity values that is asserted on a corresponding pixel and updating the electrical signals asserted on the pixels in an equal number of rows during each time. Usually less than all of the rows in the array are updated during each time interval. In a particular method, (b/n) rows are updated during each time interval, where b equals the number of bits in each multi-bit data word.

A display driver is also disclosed for carrying out this alternate aspect of the present invention. In particular, the display driver includes control logic that is operative to define a plurality of modulation periods during which electrical signals corresponding to intensity values can be asserted on pixels in the array. The control logic is also operative to associate each modulation period with at least one of the rows in the array, and divide each of the modulation periods into a plurality of time intervals. The display driver also includes a data input terminal set that receives a plurality of multi-bit data words that is each indicative of an intensity value to be asserted on a corresponding one of the pixels in the array. Responsive to the data words, the control logic is able to update the electrical signals on an equal number of rows during each time interval such that each intensity value defined a data word is asserted on the corresponding pixel in the array. In a particular embodiment, the control logic updates (b/n) rows of pixels during each time interval.

Yet another aspect of the present invention facilitates spreading any unused frame time between the time intervals in a modulation time period, thereby increasing the length of the time intervals. In particular, the method includes receiving a first synchronization signal, defining a time period during which electrical signals corresponding to intensity values will be asserted on pixels of an array, updating the electrical signals on the pixels a plurality of times during the time period such that each pixel displays the corresponding intensity value, and receiving a second synchronization signal that defines a time difference between the last time the electrical signals in a row were updated and the receipt of the second frame synchronization signal. The method further includes the steps of defining a second time period during which electrical signals will be asserted on the pixels in the rows of the array, updating the electrical signals asserted on the pixels in the rows a plurality of times during the second time period such that each of the pixels displays the corresponding intensity value, and spreading the time difference throughout the second time period based upon the number of times the electrical signals asserted on pixels in the rows of the display are updated during the second time period. Spreading the time difference throughout the second time period adjusts the duration of at least some of the time intervals in the second time period.

A display driver for driving a pixel array is also disclosed for carrying out this aspect of the present invention. In particular, the display driver includes a synchronization input terminal that receives a first, a second, and subsequent synchronization signals. The display driver also includes control logic the defines a first, a second and subsequent time periods during which electrical signals that correspond to intensity values are asserted on pixels in the rows of the array. The control logic updates the electrical signals asserted on the pixels in the rows a plurality of times during each time period such that the pixels display their corresponding intensity values. The display driver also includes a compensator that spreads the time difference between the last time the electrical signals were updated and a subsequent synchronization signal throughout the subsequent time periods based upon the number of times the electrical signals asserted on rows of pixels are updated during each subsequent time period. Spreading the time difference adjusts the length of at least some of the time intervals in the time periods.

Still another aspect of the present invention discloses a method for driving a display device having an array of pixels arranged in a plurality of columns and a plurality of rows. The method includes the steps of defining a modulation period for a row of pixels, dividing the modulation period into a plurality of time intervals equal to the quotient of the number of rows in the array and an integer (m), receiving a multi-bit data word that indicates an intensity value to be asserted on a pixel in the row, and updating the signal asserted on the pixel during at least some of the time intervals in the modulation period such that the intensity value defined by the multi-bit data word is displayed by the pixel. According to this aspect of the present invention, the value (m) is a common divisor of the number of rows in the pixel array.

A novel display driver for this aspect of the present invention is also disclosed. The display driver includes a timer that generates a series of time values each associated with one of a plurality of time intervals, a data input terminal set that receives a multi-bit data word indicative of an intensity value to be asserted on the pixel, and control logic that defines a modulation period during which a signal corresponding to the intensity value will be asserted on the pixel and updates the signal during a plurality of the time intervals so that the pixel displays the intensity value. The control logic defines a modulation period with a number of time intervals equal to the quotient of the number of rows in the pixel array and (m), where (m) is a common divisor of the number of rows in the pixel array.

Yet another aspect of the present invention relates to a method for driving a pixel array using multiple pixel control units. The method includes the steps of defining a plurality of modulation periods during which electrical signals corresponding to intensity values are asserted on pixels in the rows of an array, dividing each of the modulation periods into a plurality of time intervals, associating each of the rows in the array with one of a plurality of sets of rows, receiving a plurality of multi-bit data words indicative of intensity values, and updating the electrical signals asserted on the pixels in a plurality of rows during each time interval with a plurality of pixel control units. According to this method, each of the pixel control units update only the rows associated with a particular set of rows.

A novel display driver for this aspect of the present invention is also disclosed. The display driver includes a timer that generates a series of time values each associated with one of a plurality of time intervals, a data input terminal set for receiving a plurality of multi-bit data words that each defines an intensity value to be displayed by a corresponding pixel, and control logic having a plurality of pixel control units. The control logic is operative to define a plurality of modulation periods having a number of time intervals equal to n times the number of rows in the pixel array, to associate each row in the pixel array with one of the pixel control units, and to update the electrical signals asserted on at least some of the rows of pixels during each time interval with at least some of the pixel control units such that each pixel control unit updates only the rows associated with it.

The invention is also directed to non-transitory, electronically-readable storage media that store code for causing an electronic device to perform methods of the invention. The term "non-transitory" is intended to distinguish storage media from transitory electrical signals. However, rewritable memories are considered to be "non-transitory".

BRIEF DESCRIPTION OF THE DRAWINGS

The present invention is described with reference to the following drawings, wherein like reference numbers denote substantially similar elements:

FIG. 11 is a table showing an update schedule for the modulation scheme of FIG. 10 based on a particular data word;

FIG. 12 is a table showing row schedules for several of the time intervals in the modulation scheme of FIG. 10;

FIG. 13A is one half of a chart combining the modulation scheme of FIG. 10, the update schedule of FIG. 11, and the row schedule of FIG. 12 for rows 0-23 of the display in FIG. 8;

FIG. 13B is the other half of the chart shown in FIG. 13A;

FIG. 16A is a table showing input and output values of the read address generator shown in FIG. 15;

FIG. 20 is a table showing an update schedule for the modulation scheme of FIG. 19 based on a particular data word;

FIG. 21A is a table showing the row schedule for the first time interval in the modulation scheme of FIG. 19;

FIG. 21B is a table showing the row schedule for the second time interval in the modulation scheme of FIG. 19;

FIG. 21C is a table showing the row schedule for the third time interval in the modulation scheme of FIG. 19;

FIG. 21D is a table showing the row schedule for the fourth time interval in the modulation scheme of FIG. 19;

FIG. 22 shows portions of a chart combining the modulation scheme of FIG. 19, the update schedule of FIG. 20, and the row schedules of FIGS. 21A-21D;

FIG. 31 is a table showing an update schedule and a generic row schedule for the modulation scheme of FIG. 30 based on a particular data word;

FIG. 34 is a chart showing an update schedule and a generic row schedule for the modulation scheme of FIG. 33 based on a particular data word;

FIG. 35A is a table showing the row schedule for the first time interval in the modulation scheme of FIG. 33;

FIG. 35B is a table showing the row schedule for the second time interval in the modulation scheme of FIG. 33;

FIG. 35C is a table showing the row schedule for the third time interval in the modulation scheme of FIG. 33;

FIG. 35D is a table showing the row schedule for the fourth time interval in the modulation scheme of FIG. 33;

FIG. 37 is a timing chart showing a modulation scheme according to still another embodiment of the present invention;

FIG. 38 is a chart showing an update schedule and some row schedules for the modulation scheme of FIG. 37 based on a particular bit code;

DETAILED DESCRIPTION

This application discloses subject matter which is similar to the following co-pending U.S. patent applications, which are incorporated herein by reference in their entireties.

U.S. patent application Ser. No. 11/154,984, filed on Jun. 16, 2005, and entitled "Asynchronous Display Driving Scheme and Display";

U.S. patent application Ser. No. 11/171,496, filed on Jun. 30, 2005, and entitled "Single Pulse Display Driving Scheme and Display";

U.S. patent application Ser. No. 11/172,622, filed on Jun. 30, 2005, and entitled "System and Method for Discarding Data Bits During Display Modulation";

U.S. patent application Ser. No. 11/172,621, filed on Jun. 30, 2005, and entitled "Display Driving Scheme and Display";

U.S. patent application Ser. No. 11/172,382, filed on Jun. 30, 2005, and entitled "Display Debiasing Scheme and Display"; and U.S. patent application Ser. No. 11/172,623, filed on Jun. 30, 2005, and entitled "System and Method for Using Current Pixel Voltages to Drive Display".

The present invention overcomes the problems associated with the prior art, by providing a display and driving circuit and method wherein the bandwidth and power requirements of the display driver and imager are equalized over the entire frame. In the following description, numerous specific details are set forth (e.g., display start-up operations, particular bit schedules, etc.) in order to provide a thorough understanding of the invention. Those skilled in the art will recognize, however, that the invention may be practiced apart from these specific details. In other instances, details of well known display driving methods and components have been omitted, so as not to unnecessarily obscure the present invention.

The invention will be described first with reference to an embodiment where the imager includes only 48 rows in order to simplify the explanation of the basic aspects of the invention. Then, a more complicated embodiment of the invention where the display has 1112 rows will be described. It should be understood, however, that the invention can be applied to systems for displaying image data having any number of rows.

Figure 1:
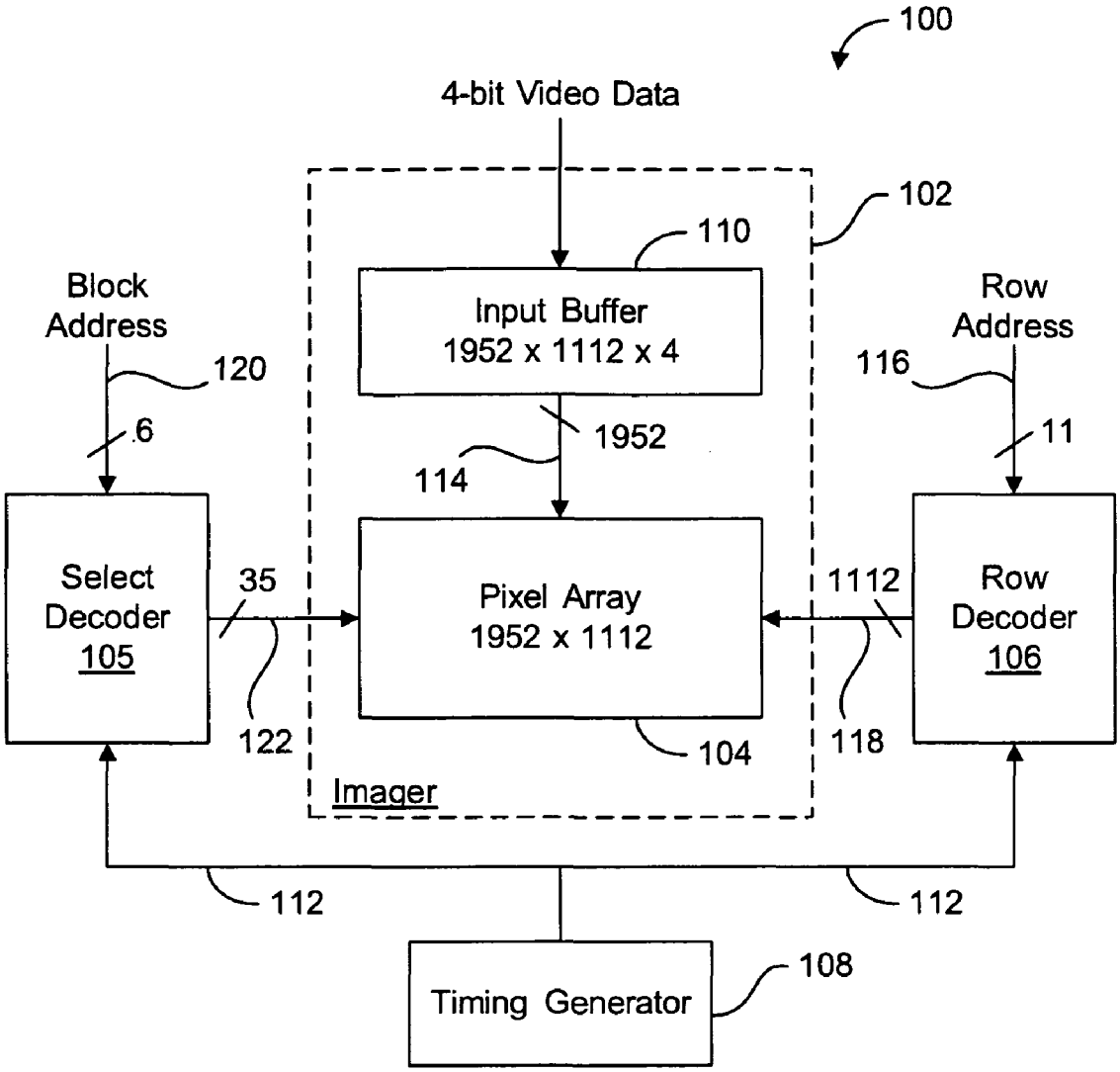
FIG. 1 Prior Art
FIG. 1 is a block diagram of a prior art display driving system.
Figure 2A:
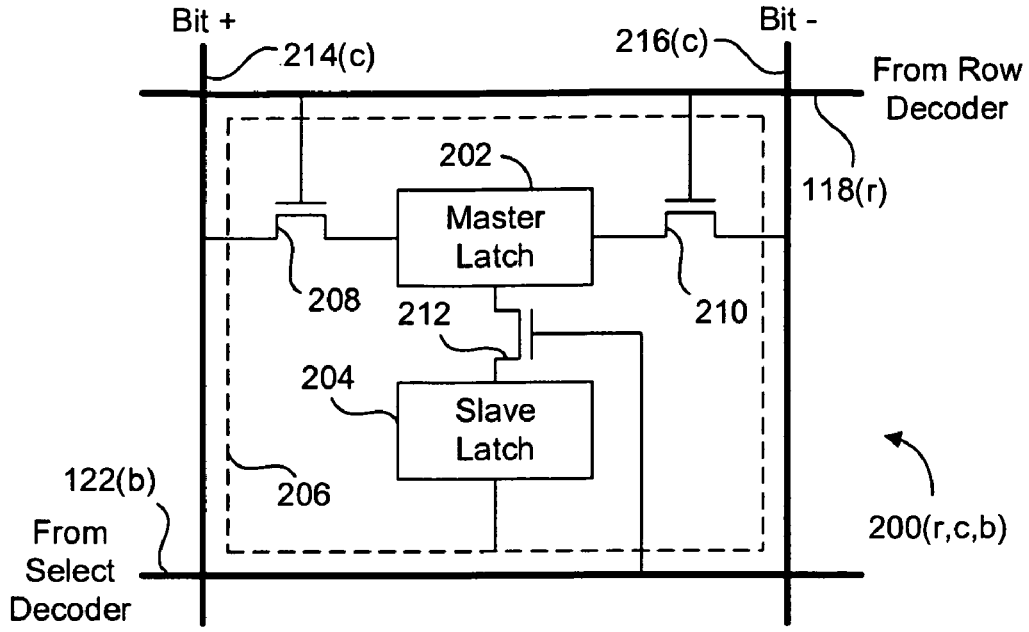
FIG. 2A Prior Art
FIG. 2A is a block diagram of a single pixel cell of the pixel array of FIG. 1.
Figure 2B:
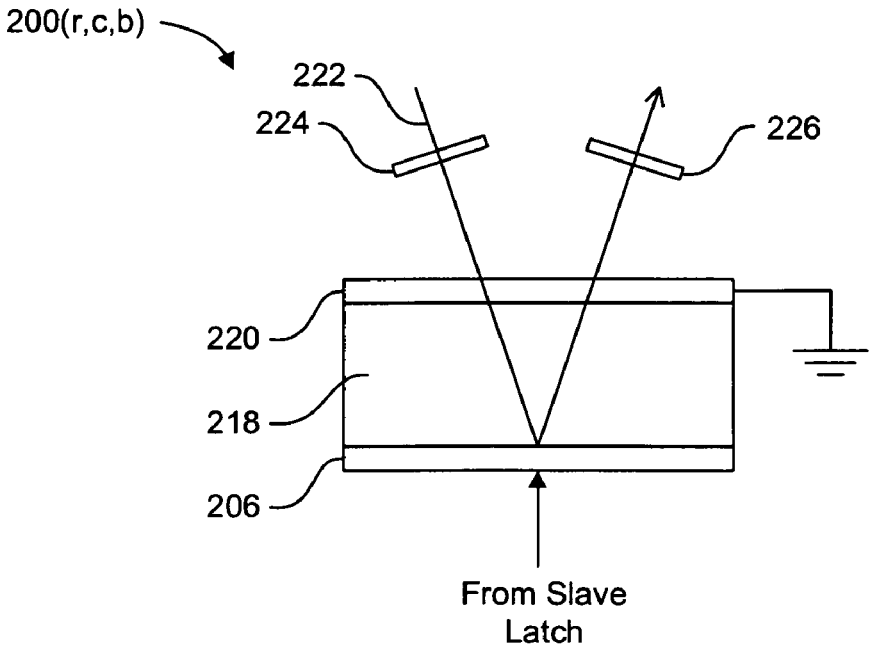
FIG. 2B Prior Art
FIG. 2B is a side elevational view of the light modulating portion of the pixel cell of FIG. 2A.
Figure 3:
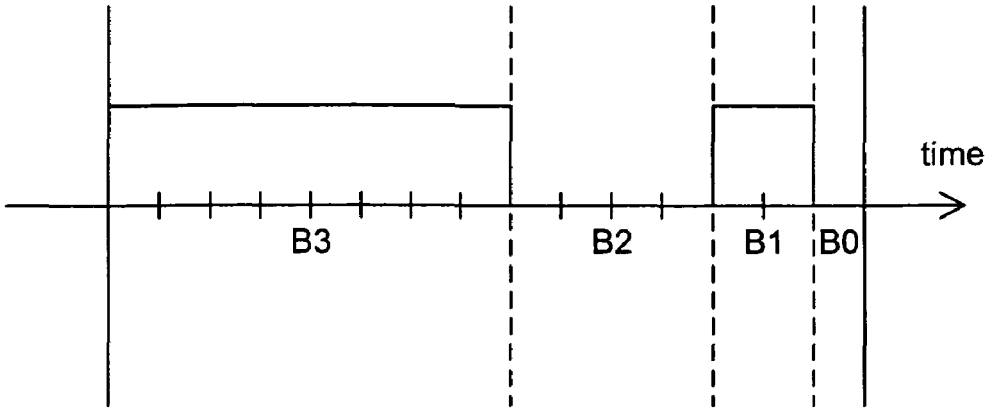
FIG. 3 Prior Art
FIG. 3 shows one frame of 4-bit pulse-width modulation data.
Figure 4:
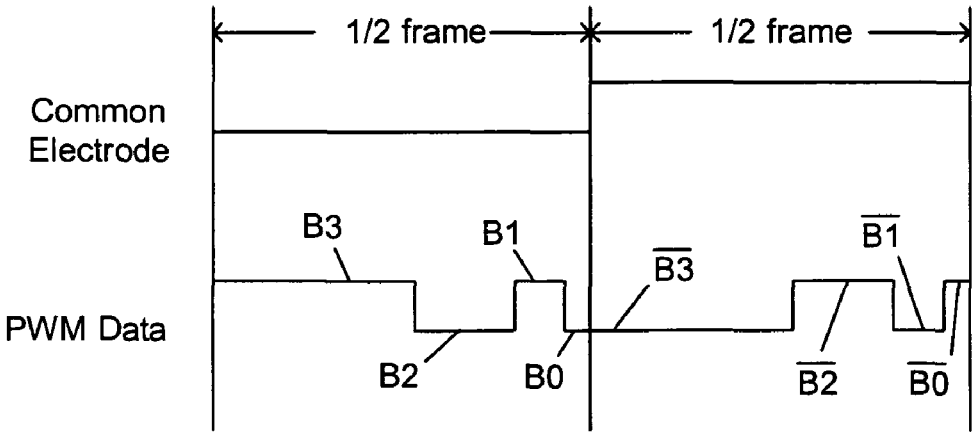
FIG. 4 Prior Art
FIG. 4 shows a split frame application of the 4-bit pulse-width-modulation data of FIG. 3 resulting in a net DC bias of 0 volts.
Figure 5:
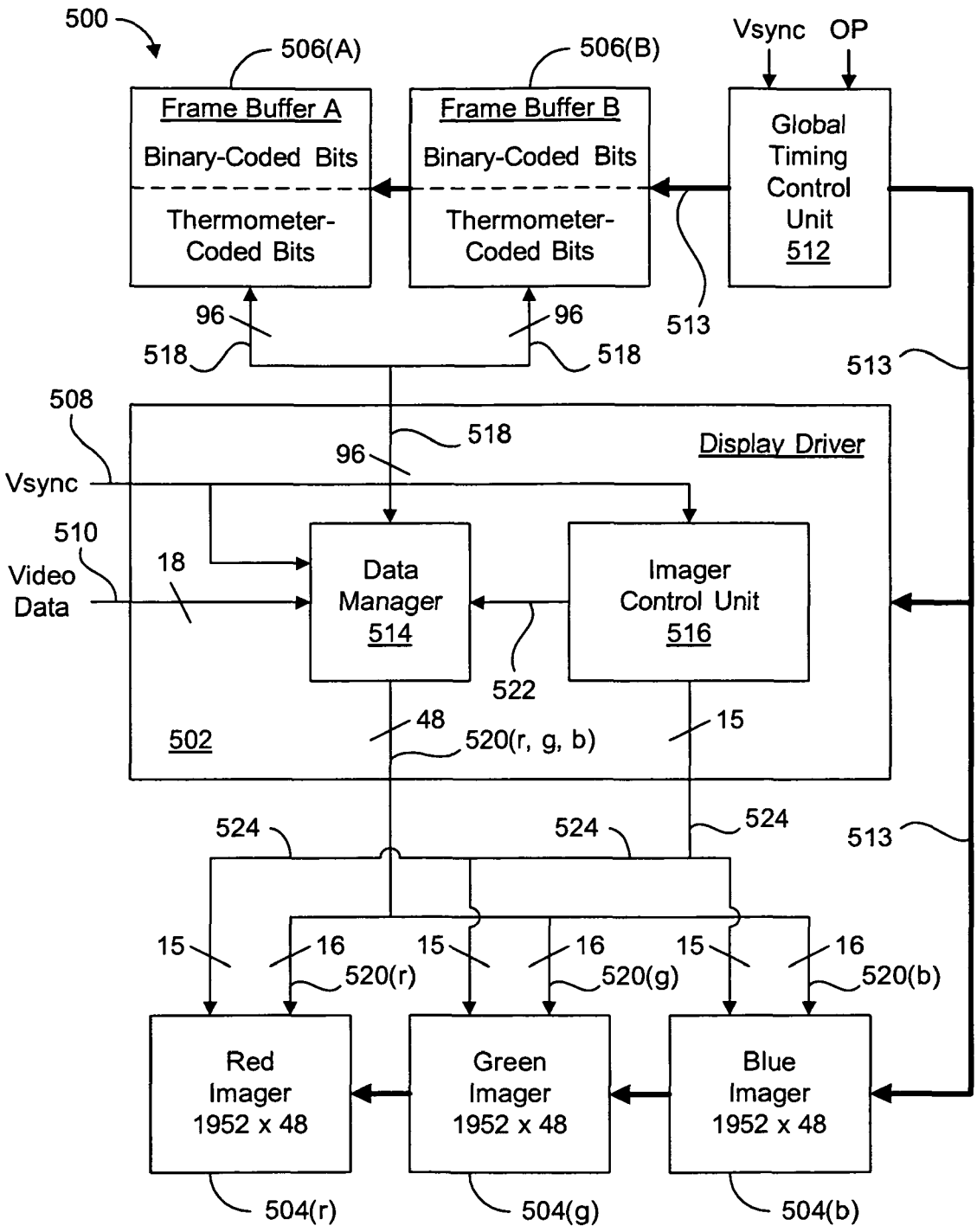
FIG. 5 is a block diagram of a display driving system according to one embodiment of the present invention.

FIG. 5 is a block diagram showing a display system 500 according to one embodiment of the present invention. Display system 500 includes a display driver 502, a red imager 504(*r*), a green imager 504(*g*), a blue imager 504(*b*), and a pair of frame buffers 506(A) and 506(B). Each of imagers 504(*r, g, b*) contain an array of pixel cells (not shown in FIG. 5) arranged in 1952 columns and 48 rows for displaying an image. Display driver 502 receives a plurality of inputs from a system (e.g., a computer system, television receiver, etc., not shown) including a vertical synchronization (Vsync) signal via Vsync input terminal 508 and video data via a video data input terminal set 510.

Display system 500 also includes a global timing control unit 512 that asserts clock signals and operational instructions on a global control bus 513 to coordinate the operation of display driver 502, imagers 504(*r, g*, and *b*) and frame buffers 506(A and B). For example, global timing control unit 512 asserts clock signals on bus 513, which the other components of display system 500 use to perform their various functions. Global timing control unit 512 generates clock signals at a frequency sufficient to allow the components of display system 500 to fully carry out their various functions. In addition, global timing control unit 512 receives operational codes ("opcodes") from a system (not shown), decodes the opcodes into operational instructions, and asserts operational instructions (e.g., no-op instructions, data write commands, load row address commands, etc.) on bus 513 to administer the global operations of display system 500. According to the present invention, one important function of global timing control unit 512 is to spread unused frame time (caused by too high of a clock frequency) over the entire frame.

It should be noted that bus 513 is in communication with the various elements of display system 500. However, bus 513 is represented generally so as not to unnecessarily obscure the other aspects of the present invention.

Display driver 502 includes a data manager 514 and an imager control unit (ICU) 516. Data manager 514 is coupled to Vsync input terminal 508, video data input terminal set 510, and to bus 513 (not shown directly). In addition, data manager 514 is coupled to each of frame buffers 506(A) and 506(B) via 96-bit buffer data bus 518. Data manager 514 is also coupled to each imager 504(*r, g, b*) via a plurality (16 in the present embodiment) of imager data lines 520(*r, g, b*), respectively. Therefore, in the present embodiment, bus 518 has twice the bandwidth of imager data lines 520(*r, g, b*) combined. Finally, data manager 514 is coupled to a coordination line 522. Imager control unit 516 is also coupled to synchronization input 508 and to coordination line 522, and to each of imagers 504(*r, g, b*) via a plurality (15 in the present embodiment) of common imager control lines 524.

Display driver 502 controls and coordinates the driving process of imagers 504(*r, g, b*). Data manager 514 receives binary video data via video data input terminal set 510, separates the video data by color, converts the binary video data into compound video data having binary-coded and thermometer-coded video data, and provides the compound video data to one of frame buffers 506(A-B) via buffer data bus 518. Data manager 514 also retrieves video data from one of frame buffers 506(A-B) and provides each color (i.e., red, green, and blue) of video data to the respective imager 504(*r, g, b*) via imager data lines 520(*r, g, b*). Note that imager data lines 520 (*r, g, b*) each include 16 lines. As will be described later, each pixel is driven with an 8-bit compound data word. Therefore, two pixels worth of data can be transferred at once to each imager 504(*r, g, b*) via data lines 520(*r, g, b*). It should be understood, however, that a greater number of data lines 520 (*r, g, b*) could be provided to reduce the number of transfers required for each frame. Data manager 514 utilizes the coordination signals received via coordination line 522 to ensure that the proper data is provided to each of imagers 504(*r, b, g*) at the proper time. Finally, data manager 514 utilizes the synchronization signals provided at synchronization input 508 and the clock signals and instructions received via bus 513 to coordinate and route video data between the various components of display driving system 500.

Data manager 514 reads and writes data from and to frame buffers 506 (A and B) in alternating fashion. In particular, data manager 514 reads data from one of the frame buffers (e.g., frame buffer 506(A)) and provides the data to imagers 504 (*r, g, b*), while data manager writes the next frame of data to the other frame buffer (e.g., frame buffer 506(B)). After the first frame of data is written from frame buffer 506(A) to imagers 504 (*r, g, b*), then data manager 514 begins providing the second frame of data from frame buffer 506(B) to imagers 504(*r, g, b*), while writing the new data being received into frame buffer 506(A). This alternating process continues as data streams into display driver 502, with data being written into one of frame buffers 506(A-B) while data is read from the other of frame buffers 506(A-B).

Imager control unit 516 controls the modulation of the pixel cells of each imager 504(*r, g, b*). Imagers 504(*r, g, b*) are arranged such that video data provided by data manager 514 can be asserted to form a full color image once each of the colored images are superimposed. Imager control unit 516 supplies various control signals to each of imagers 504(*r, g, b*) via fifteen common imager control lines 524. Imager control unit 516 also provides coordination signals to data manager 514 via coordination line 522, such that imager control unit 516 and data manager 514 remain synchronized and the integrity of the image produced by imagers 504(*r, g, b*) is maintained. Finally, imager control unit 516 receives synchronization signals from synchronization input terminal 508, such that imager control unit 516 and data manager 514 are resynchronized with each frame of data.

Responsive to the video data received from data manager 514 and to the control signals received from imager control unit 516, imagers 504(*r, g, b*) modulate each pixel of their respective displays according to the video data associated with that pixel. Each pixel of imagers 504(*r, g, b*) are modulated with a reduced number of pulses, rather than a conventional pulse width modulation scheme. In addition, each row of pixels of imagers 504(*r, g, b*) are driven asynchronously such that the rows are processed during distinct modulation periods that are temporally offset. In addition, as will be described later, each modulation period is divided into a plurality of time intervals, such that an equal number of rows are updated during each time interval. These and other advantageous aspects of the present invention will be described in further detail below.

Although FIG. 5 shows a three-imager display system 500, the present invention also provides its many advantages when used in field-sequential display systems. In field-sequential display systems, a single imager modulates each color of light rather than a separate imager for each color. Accordingly, if display system 500 were modified for field-sequential operation, imager control unit 516 would drive a single imager via a plurality of imager control lines. Similarly, data manager 514 would transfer display data for each color to the same single imager. Note also that the components in a field-sequential display system may be different than those in display system 500 in order to carry out the various aspects of the present invention.

Figure 6:
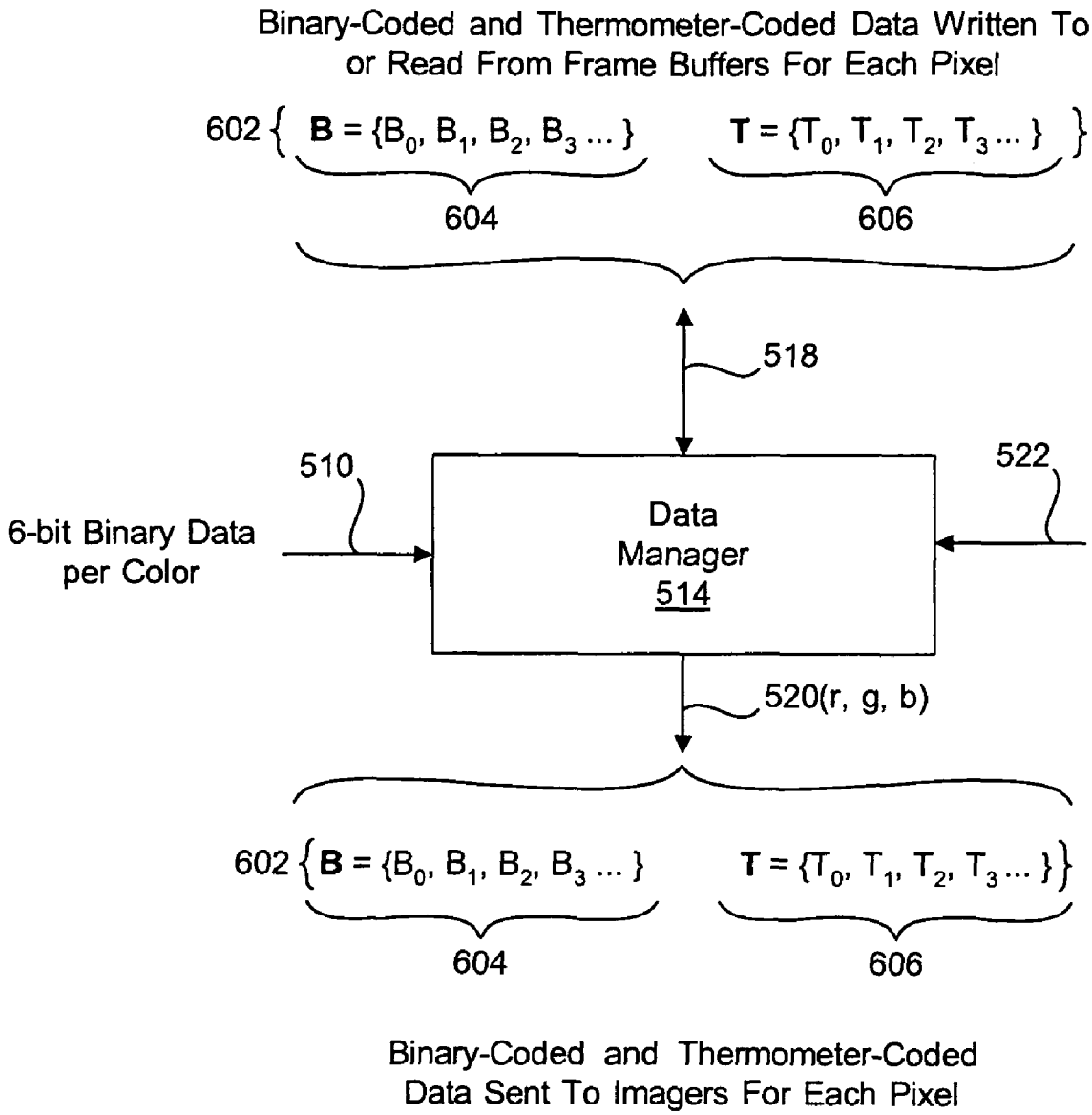
FIG. 6 is a block diagram illustrating the operation of the data manager shown in FIG. 5.

FIG. 6 is a block diagram illustrating the flow of video data through data manager 514 and how data manager 514 converts binary video data into compound video data including binary-coded data and thermometer coded data. For example, 18-bit binary-coded video data (six bits per color) enters data manager 514 from video data input terminal set 510. Data manager 514 then divides the video data by color into 6-bit, binary-coded data words and converts each 6-bit binary-coded data word into a compound data word 602, and stores the compound data words 602 for each pixel in one of frame buffers 506(A-B). Each compound data word 602 includes a plurality of binary-coded bits 604 and thermometer-coded bits 606. Note that binary-coded data is denoted with a "B" and thermometer-coded data is denoted with a "T."

According to one aspect of the present invention, data manager 514 converts 6-bit binary video data for each pixel in each imager 504(*r, g, b*) into a data word 602 subject to the following limitations. In particular, data manager 514 converts each binary-weighted data word into a compound data word 602 wherein the sum of the weighted values of the binary-coded bits 604 and the thermometer-coded bits 606 is equal to an integer multiple (n) of the number of rows of pixels in one of imagers 504(*r, g, b*). In the present embodiment, n is equal to one, and the number of rows in each imager 504(*r, g, b*) is forty-eight (48). Therefore, the sum of the weighted values of the bits in each combination data word 602 should equal forty-eight. A second requirement for this aspect of the present invention is that the number of bits, b, in the bit code of data word 602 is evenly divisible by n. Because n equals one in this embodiment, this limitation is automatically met. By setting the number of non-zero intensity values that can be defined by a compound data word 602 equal to an integer multiple of the number of rows in the imager's display, an equal number of rows in the display can be updated during each time interval. This facilitates 100% data efficiency between the display driver 502 and each imager 504(*r, g, b*).

According to a more particular aspect of the present invention that will be described in further detail later on, an imager includes a plurality of pixel control circuitries, each controlling the modulation of a set of rows in the display. To facilitate 100% operating efficiency of each pixel control circuitry in the imager, each pixel control circuitry must update the same number of rows in that single imager during each time interval. To ensure this result, data manager 514 converts binary data words into compound data words 602 according to the following additional limitations. First, the number of bits in the bit code of compound data word 602 must be evenly divisible by (s*n), where s is the number of pixel control circuitries in each imager. Second, the sum of the weighted values of the bits in the bit code of compound data word 602 must be evenly divisible by (s*n). Finally, an equal number of rows in the display assigned to each of the s sets must be updated during each time interval.

Assigning each row of pixels in the display in imagers 504(*r, g, b*) to one of two sets (i.e., s=2) provides a useful example. In particular, the even-numbered rows in a display can be assigned to one set and the odd-numbered rows in the display can be assigned to a second set. According to this example, data manager 514 converts binary data words into compound data words 602 having a number of bits evenly divisible by 2n. In addition, the sum of the weighted values of the bits in each data word 602 is evenly divisible by 2n. Finally, the bit code of data words 602 must produce row update schedules for each time interval wherein an equal number of even- and odd-numbered rows are updated during each time interval.

Note that the bit-code of compound data words 602 is completely arbitrary (in the number of bits and their respective weights) as long as the constraints described in the preceding paragraphs are satisfied depending on the aspect of the present invention that is implemented. In the present embodiment, data manager 514 converts each six bit binary-coded data word into an eight bit compound data word 602. Each compound data word 602 includes four binary-coded bits 604 having weighted values of $2^0$, $2^1$, $2^2$, and $2^3$. The remaining four thermometer-coded bits 606 would have weights of 9, 8, 8, and 8, respectively. Therefore, according to this example, the bit code (in weights) for each data word 602 is 1, 2, 4, 8, 9, 8, 8, 8.

This exemplary bit code for compound data word 602 meets all the constraints described above for n is equal to one and s is equal to two. For example, the sum of the weighted values equals forty-eight, which is equal to the number of pixel rows in each imager 504(*r, g, b*). Second, the number of bits (i.e., eight) in the bit code is evenly divisible by two (i.e., 2*1). In addition, the sum of the weights of the bit code (i.e., 48) is evenly divisible by two (i.e., 2*1). Finally, as will be described in greater detail below, an equal number of even-numbered and odd-numbered rows are updated during each time interval.

When data manager 514 receives a six-bit, binary-weighted data word for a particular pixel, data manager determines what intensity value the data represents, and then converts the six-bit data word into a combination data word 602 corresponding to the same intensity value. As will be described later, data manager 514 assigns a digital ON value or a digital OFF value to bits 604 and 606 such that the electrical signal written to a particular pixel will experience a number of pulse transitions that is less than or equal to the number of pulses experienced in conventional pulse-width modulation while still producing the desired intensity value.

Figure 7:
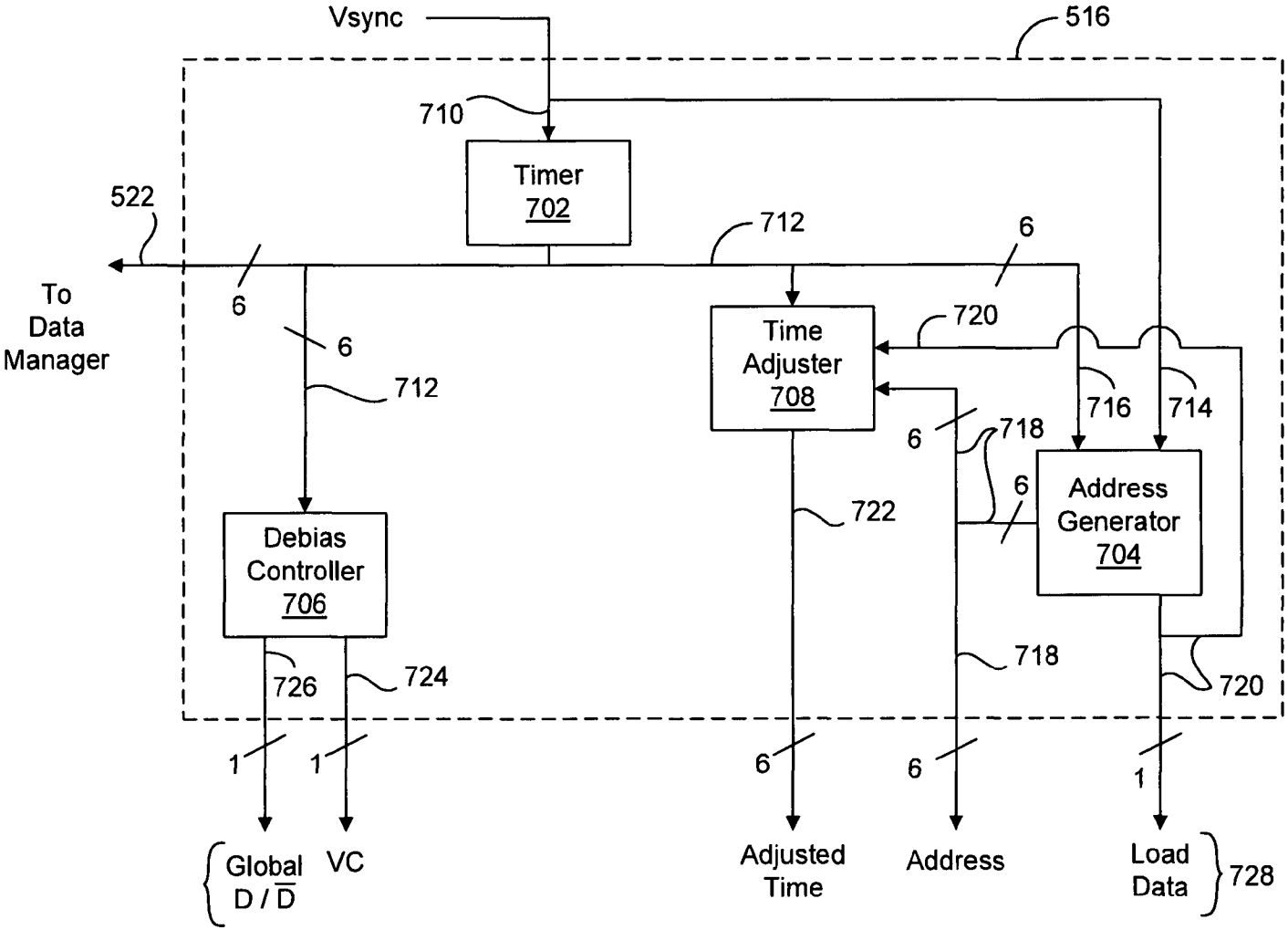
FIG. 7 is a block diagram showing the imager control unit of FIG. 5 in greater detail.

FIG. 7 is a block diagram showing imager control unit 516 in greater detail. Imager control unit 516 includes a timer 702, an address generator 704, a debias controller 706, and a time adjuster 708. Timer 702 coordinates the operations of the various components of imager control unit 516 by generating a sequence of time values that are used by the other components during operation. In the present embodiment, timer 702 is a counter that includes a synchronization input 710 for receiving the Vsync signal and a time value output bus 712 for outputting the timing signals generated thereby. The number of timing signals generated by timer 702 is equal to an integer (n) multiple of the number of pixel rows (r) in each imager 504(*r, g, b*). In the present embodiment, n is equal to one, and r is equal to forty-eight. Accordingly, timer 702 counts consecutively from zero (0) to forty-seven (47). Once timer 702 reaches a value of forty-seven, timer 702 loops back such that the next timing signal output has a value of zero. Each timing value is provided as a timing signal on time value output bus 712. Time value output bus 712 provides the timing signals to coordination line 522 (and thereby to data manager 514), address generator 704, debias controller 706, and time adjuster 708.

At initial startup or after a video reset operation caused by the system (not shown), timer 702 is operative to start generating timing signals after receiving a first Vsync signal on synchronization input 710. In this manner, timer 702 is synchronized with data manager 514. Thereafter, timer 702 provides timing signals to data manager 514 via bus 712 and coordination line 522, such that data manager 514 remains synchronized with imager control unit 516. Once data manager 514 receives the first synchronization signal via synchronization input 508 and the first timing signal via coordination line 522, data manager 514 begins transferring video data as described above.

Address generator 704 provides row addresses to each of imagers 504(*r, g, b*) and to time adjuster 708. Address generator 704 has a plurality of inputs including a synchronization input 714, a timing input 716, and a plurality of outputs including 6-bit address output bus 718, and a single bit load data output 720. Synchronization input 714 is coupled to receive the Vsync signal from synchronization input 508 of display driver 502, and timing input 716 is coupled to time value output bus 712 of timer 702 to receive timing signals therefrom. Responsive to receiving timing values via timing input 716, address generator 704 is operative to generate row addresses and to consecutively assert the row addresses on address output bus 718. Address generator 704 generates 6-bit row addresses and asserts each bit of the generated row addresses on a respective line of address output bus 718. Furthermore, depending on whether the row address generated by address generator 704 is a "write" address (e.g., to write data into imager memory) or a "read" address (e.g., to read data from imager memory), address generator 704 will assert a load data signal on load data output 720. In the present embodiment, a digital HIGH value asserted on load data output 720 indicates that address generator 704 is asserting a write address on address output bus 718, while a digital LOW value indicates a read address. The reading and writing of data from/to memory of the display will be described in greater detail below.

Time adjuster 708 adjusts the time value output by timer 702 based on the row address received from address generator 704. Time adjuster 708 receives 6-bit time values from bus 712, load data signals from load data output 720 of address generator 704, and 6-bit row addresses from address output bus 718 of address generator 704. Time adjuster 708 outputs 6-bit adjusted time values on adjusted timing output bus 722.

Responsive to the signal asserted on load data output 720 and the row address asserted on address output bus 718, time adjuster 708 adjusts the time values asserted on bus 712 and asserts the adjusted time value on adjusted timing output bus 722. The load data value asserted on output 720 indicates to time adjuster 708 whether the row address asserted on bus 718 is a write address (e.g., a digital HIGH signal) or a read address (e.g., a digital LOW signal). Time adjuster 708 adjusts the time values asserted on bus 712 only for read row addresses. Accordingly, when the load data signal asserted on output 720 is HIGH, indicating that a write address is being output by address generator 704, time adjuster 708 ignores the row address and does not update the adjusted timing value output on adjusted timing output bus 722.

Time adjuster 708 can be created from a variety of different components, however in the present embodiment, timing adjuster 708 is a subtraction unit that decrements the time value output by timer 702 based upon the row address asserted on row address output bus 718. In another embodiment, time adjuster 708 is a look-up table that returns an adjusted time value depending on the time value asserted on bus 712 and the row address received on bus 718.

Debias controller 706 controls the debiasing process of each of imagers 504(*r, g, b*) in order to prevent deterioration of the liquid crystal material therein. Debias controller 706 is coupled to time value output bus 712 and includes a common voltage output 726 and a global data invert output 726. Debias controller 706 receives timing signals from timer 702 via bus 712, and depending on the value of the timing signal, asserts one of a plurality of predetermined voltages on common voltage output 724 and a HIGH or LOW global data invert signal on global data invert output 726. The voltage asserted by debias controller 706 on common voltage output 724 is asserted on the common electrode (e.g., an Indium-Tin Oxide (ITO) layer) of the pixel array of each of imagers 504(*r, g, b*). In addition, the global data invert signals asserted on global data invert output 726 determine whether data asserted on each of the electrodes of the pixel cells of imagers 504(*r, g, b*) is asserted in a normal or inverted state.

The operation of debias controller 706 is discussed in detail in U.S. patent application Ser. No. 11/172,382, filed on Jun. 30, 2005, and entitled "Display Debiasing Scheme and Display," which is incorporated herein by reference in its entirety. Indeed, debias controller 706 can employ any of the debiasing methods described in U.S. Ser. No. 11/172,382 to effectively debias the pixel arrays of imagers 504(*r, g, b*).

Finally, imager control lines 728 convey the outputs of the various elements of imager control unit 516 to each of imagers 504(*r, g, b*). In particular, imager control lines 728 include adjusted timing output bus 722 (six lines), address output bus 718 (six lines), load data output 720 (one line), common voltage output 724 (one line), and global data invert output 726 (one line). Accordingly, imager control lines 728 are composed of fifteen control lines, each providing signals from a particular element of imager control unit 516 to each imager 504(*r, g, b*). Each of imagers 504(*r, g, b*) receive the same signals from imager control unit 516 such that imagers 504(*r, g, b*) remain synchronized.

Figure 8:
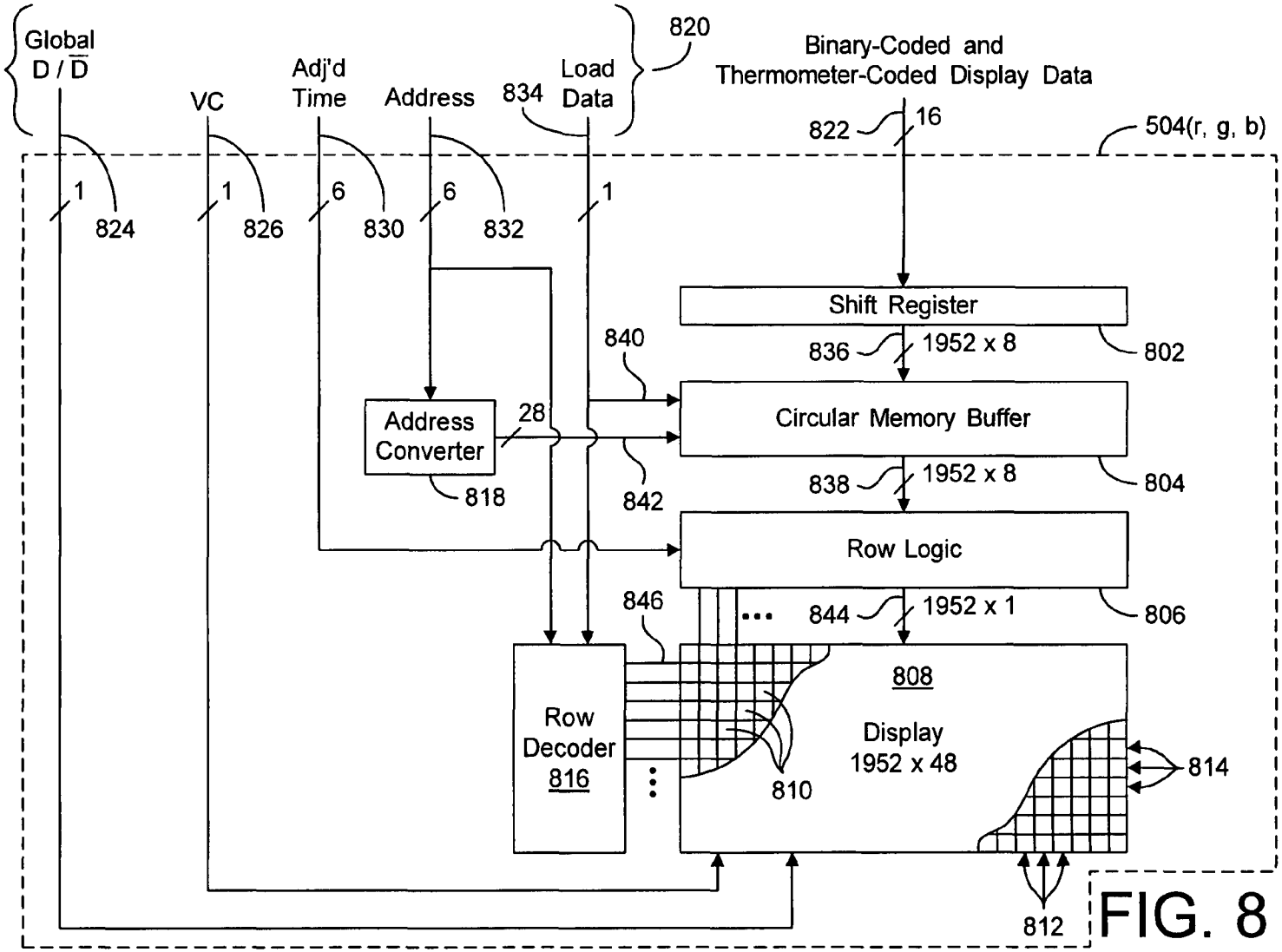
FIG. 8 is a block diagram showing one of the imagers of FIG. 5 in greater detail.

FIG. 8 is a block diagram showing one of imagers 504(*r, g, b*) in greater detail. Imager 504(*r, g, b*) includes a shift register 802, a circular memory buffer 804, row logic 806, a display 808 including an array of pixel cells 810 arranged in 1952 columns 812 and 48 rows 814, a row decoder 816, an address converter 818, a plurality of imager control inputs 820, and a display data input 822. Imager control inputs 820 include a global data invert input 824, a common voltage input 826, an adjusted timing input 830, an address input 832, and a load data input 834. Global data invert input 824, common voltage input 826, logic selection input 828, and load data input 834 are all single line inputs and are coupled to global data invert line 726, common voltage line 724, and load data line 720, respectively, of imager control lines 524. Similarly, adjusted timing input 830 is a six line input coupled to adjusted timing output bus 722 of imager control lines 524, and address input 832 is a six line input coupled to address output bus 718 of imager control lines 524. Finally, display data input 822 is a sixteen line input coupled to the respective sixteen imager data lines 520(*r, b, g*), for receiving red, green or blue display data thereby.

Note that because display data input 822 includes sixteen lines, two, eight-bit compound data words 602 (i.e., two pixels worth of data) can be received simultaneously. It should be understood, however, that in practice, more data lines can be provided to increase the amount of data that can be transferred at one time. The numbers have been kept relatively low in this example, for the sake of clear explanation.

Shift register 802 receives and temporarily stores display data for a single row 814 of pixel cells 810. Display data is written into shift register 802 sixteen bits at a time via data input 822 until display data for a complete row 814 has been received and stored. In the present embodiment, shift register 802 is large enough to store eight bits (i.e., one combination data word 602) of video data for each pixel cell 810 in a row 814. In other words, shift register 802 is able to store 15,616 bits (e.g., 1952 pixels/row×8 bits/pixel) of video data. Once shift register 802 contains data for a complete row 814 of pixel cells 810, the data is transferred from shift register 802 into circular memory buffer 804 via data lines 836 (1952×8).

Circular memory buffer 804 receives rows of 8-bit display data output by shift register 802 on data lines 836, and stores the video data for an amount of time sufficient for a signal corresponding to the grayscale value of the data to be asserted on an appropriate pixel 810 of display 808. Responsive to control signals, circular memory buffer 804 asserts the 8-bit display data associated with each pixel 810 of a row 814 onto data lines 838 (1952×8).

To control the input and output of data, circular memory buffer 804 includes a single-bit load input 840 and a 28-bit address input 842. Depending on the signals asserted on load input 840 and address input 842, circular memory buffer 804 either loads a row of 8-bit compound data words 602 being asserted on data lines 836 from shift register 802 or provides a row of previously stored 8-bit compound data words 602 to row logic 806 via data lines 838 (1952×8). For example, if a signal asserted on load input 840 was HIGH indicating a write address was output by address generator 704, then circular memory buffer 804 loads the bits of video data asserted on data lines 836 into memory. The memory locations into which the bits are loaded are determined by address converter 816, which asserts converted memory addresses onto address inputs 842. If on the other hand, the signal asserted on load input 840 is LOW, indicating a read row address output by address generator 704, then circular memory buffer 804 retrieves a row of 8-bit compound data words 602 from memory and asserts the data onto data lines 838. The memory locations from which the previously stored display data are obtained are also determined by address converter 816, which asserts converted read memory addresses onto address inputs 842.

Row logic 806 writes single bits of data to the pixels 810 of display 808 depending on the adjusted time value received on adjusted timing input 830. Row logic 806 receives an entire row of 8-bit compound data words 602 via data lines 838, and based on the display data and adjusted time value, updates the single bits asserted on pixels 810 of the particular row 814 via display data lines 844. Row logic 806 writes appropriate single-bit data to each pixel 810 in a row 814, such that the duration of the pulse(s) on each pixel equal the intensity value defined by an associated compound data word 602.

It should be noted that row logic 806 updates each row 814 of display 808 a plurality of times during the row's modulation period in order to assert the intensity value on each pixel 810 for the proper duration. The process of updating a row 814(0-47) involves row logic 806 updating the electrical signals on each pixel 810 in a particular row 814(0-47). Therefore, the phrase "updating a row" is intended to mean row logic 806 updating the single bit data stored in and asserted on each pixel 810 in the particular row 814(0-47).

It should also be noted that, in the present embodiment, row logic 806 is a "blind" logic element. In other words, row logic 806 does not need to know which row 814 of display 808 it is processing. Rather, row logic 806 receives an 8-bit compound data word 602 for each pixel 810 of a particular row 814 and an adjusted time value on adjusted timing input 830. Based on the display data and the adjusted time value, row logic 806 writes the appropriate bit of compound data words 602 to the pixels 810 for the particular adjusted time value.

Display 808 is a reflective or transmissive liquid crystal display (LCD), having 1952 columns 812 and 48 rows 814 of pixel cells 810. Each row 814 is enabled by an associated one of a plurality of word lines 846. Because display 808 includes 48 rows of pixels 810, there are also 48 word lines 846. In addition, one data line 844 communicates data between row logic 806 and each column 812 of display 808 to an enabled pixel 810 in the particular column.

Display 808 also includes a common electrode (e.g., an Indium-Tin-Oxide layer, not shown) overlying all of pixels 810. Voltages can be asserted on the common electrode via common voltage input 826. In addition, the voltage asserted on each pixel 810 by the single bit stored therein can be inverted (i.e., switched between normal and inverted values) depending upon the signal asserted on global data invert input 824. The signal asserted on global data invert input 824 is provided to each pixel cell 810 of display 808.

The signals asserted on global data invert terminal 824 and the voltages asserted on common voltage input 826 are used to debias display 808. As is well known in the art, liquid crystal displays will degrade due to ionic migration in the liquid crystal material when the net DC bias across the liquid crystal is not zero. Such ionic migration degrades the quality of the image produced by the display. By debiasing display 708, the net DC bias across the liquid crystal layer is retained at or near zero and the quality of images produced by display 708 is kept high. Again, a debiasing process for use with the present invention is described in greater detail in U.S. patent application Ser. No. 11/172,382 entitled "Display Debiasing Scheme and Display."

Row decoder 816 asserts a signal on one of word lines 846 at a time, such that the single bit data asserted by row logic 806 on display lines 844 is latched into the enabled row 814 of pixels 708. Row decoder 816 receives a 6-bit row address from address input 832 and a disable signal (i.e., the load data signal) via load data input 834. Note that a 6-bit row address is required to uniquely define each of the 48 rows 814 of display 808. Depending upon the row address received on address input 832 and the value of the signal received on load data input 834, row decoder 816 is operative to enable one of word lines 846 (e.g., by asserting a digital HIGH value). A digital HIGH value asserted on load data input 834 indicates that the row address received by row decoder 816 is a "write" address, and that data is being loaded into circular memory buffer 804. Accordingly, when the signal asserted on load data input 834 is a digital HIGH, then row decoder 816 ignores the row address asserted on address input 832 and does not enable a new one of word lines 846. On the other hand, if the signal on load data input 834 is a digital LOW, then row decoder 816 enables one of word lines 750 associated with the row address asserted on address input 832.

Address converter 818 receives the 6-bit row addresses via address input 832, converts each row address into a plurality of memory addresses, and provides the memory addresses to circular memory buffer 804. In particular, address converter 818 provides a memory address for each bit of display data, which are stored independently in circular memory buffer 804. For example, in the present 8-bit driving scheme, address converter 818 converts a row address received on address input 832 into eight different memory addresses, each associated with a different bit of data word 602. Depending upon the load data signal asserted load data input 834, circular memory buffer 804 loads data into or retrieves data from the particular locations in circular memory buffer 804 identified by the memory addresses output by address converter 818 for each bit of display data.

Finally, it should be noted that the components of imager 504(*r, g, b*), other than display 808, comprises the pixel control circuitry that carries out the modulation of display 808. As will be discussed in greater detail below, a single imager 504(*r, g, b*) can include multiple pixel control circuitries where each pixel control circuitry is responsible for modulating a defined set of rows in display 808. Incorporating multiple iterations of the pixel control circuitry in a single imager 504(*r, g, b*) advantageously reduces the number of operations that a single iteration of pixel control circuitry would have to perform. In other words, an imager 504(*r, g, b*) including multiple pixel control circuitries can update pixels more times per frame than can an imager 504(*r, g, b*) with only one pixel control circuitry.

Figure 9:
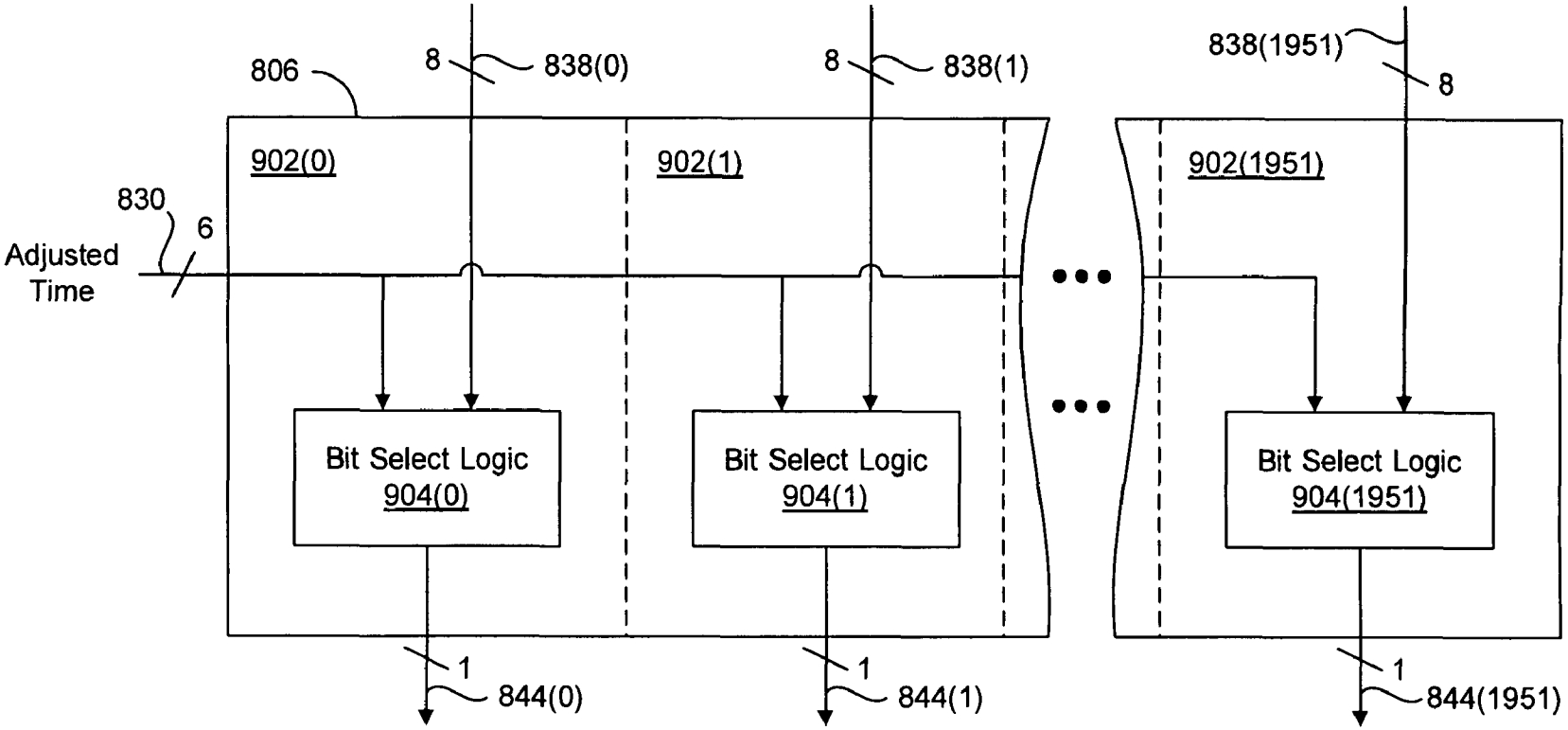
FIG. 9 is a block diagram showing the row logic of the imager of FIG. 8 in greater detail.

FIG. 9 is a block diagram showing row logic 806 in greater detail. Row logic 806 includes a plurality of logic units 902 (0-1951), each of which is responsible for updating the electrical signals asserted on the pixels 810 of an associated column 812 via a respective one of display data lines 844(0-1951). Each logic unit 902(0-1951) includes a respective bit select logic 904(0-1951) that selects a bit to assert on the respective data line 844(0-1951).

When updating a particular row 814 of pixels 810, each bit select logic 904(0-1951) receives a full compound data word 602 from circular memory buffer 804 via a respective set of data lines 838(0-1951) for a particular column 812 of pixels 810. In addition, each bit select logic 904(0-1951) also receives an adjusted time value via adjusted timing input 830 for the particular row 814 of pixels 810. Depending on the adjusted time value asserted on adjusted timing input 830, each bit select logic 904(0-1951) selects the appropriate bit of the compound data word 602 for the particular pixel 810 in the associated column 812 and asserts that bit (i.e., either a digital ON value or a digital OFF value) on the respective data line 844(0-1951). The selection process of bit select logic 904 will be described in further detail below.

Figure 10:
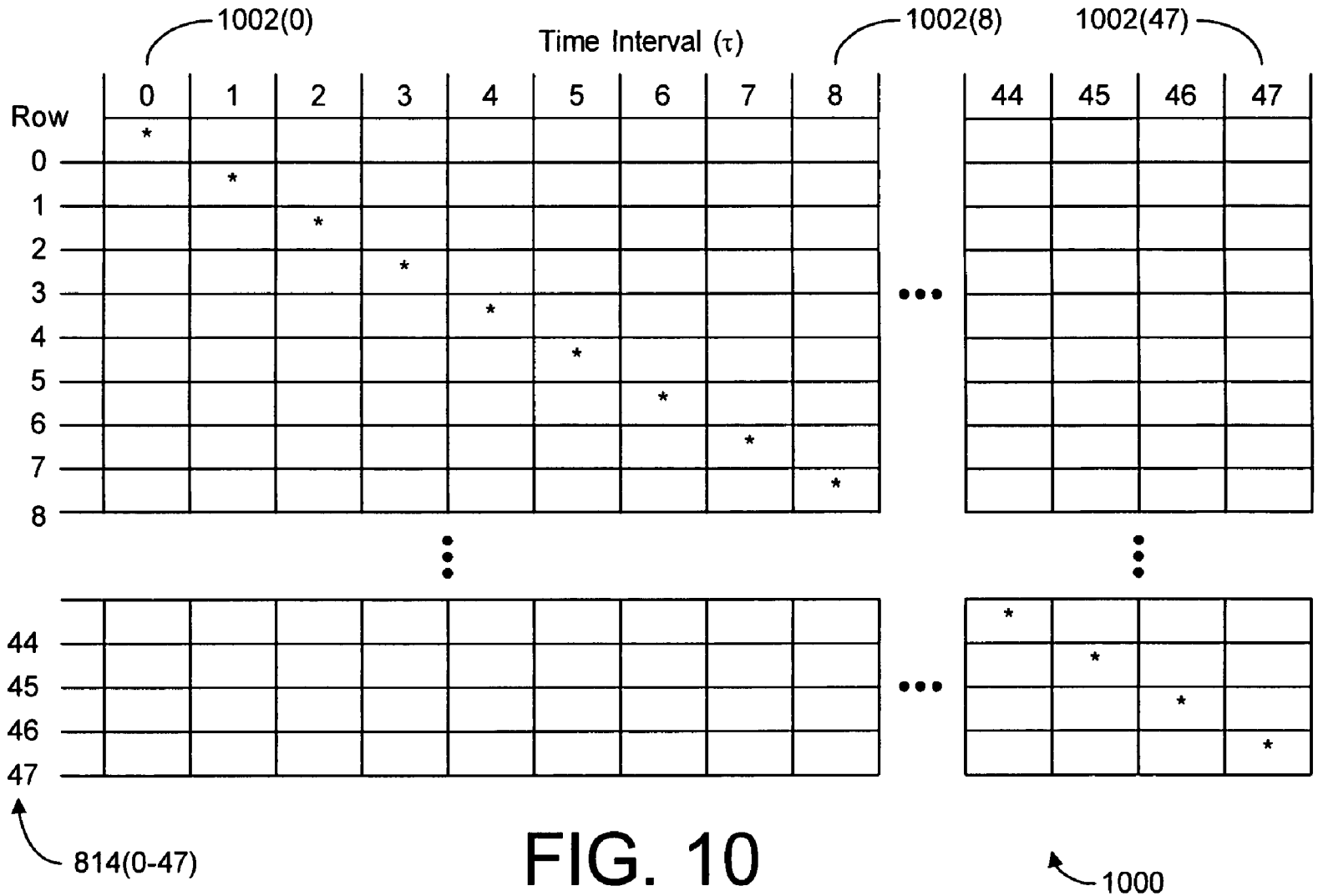
FIG. 10 is a timing chart showing a modulation scheme according to the present invention.

FIG. 10 is a timing chart 1000 showing a modulation scheme according to the present invention. Timing chart 1000 shows a modulation period for each row 814(0-47) in display 808 divided into a plurality of coequal time intervals 1002(0-47). Rows 814(0-47) are arranged vertically in diagram 1000, while time intervals 1002(0-47) are arranged horizontally across chart 1000. The modulation period of each row 814(0-47) is a time period that is divided into n*r coequal time intervals 1002(0-47), where (n) is an integer greater than zero and (r) equals the number of rows 814 in display 808. Because n equals one in the present embodiment, each row 814's modulation period is forty-eight time intervals 1002 long.

Electrical signals corresponding to particular intensity values are written to the pixels in each row 814(0-47) by row logic 806 within the row's respective modulation period. Because the number of rows 814(0-47) is equal to the number of time intervals 1002(0-47), each row 814(0-47) has a modulation period that begins at the beginning of one of time intervals 1002(0-47) and ends after the lapse of forty-eight time intervals 1002(0-47) thereafter. Accordingly, the modulation periods of rows 814(0-47) are equal in duration. For example, row 814(0) has a modulation period that begins at the beginning of time interval 1002(0) and end after the lapse of time interval 1002(47). Row 814(1) has a modulation period that begins at the beginning of time interval 1002(1) and ends after the lapse of time interval 1002(0). Row 814(2) has a modulation period that begins at the beginning of time interval 1002(2) and ends after the lapse of time interval 1002(1). This trend continues for the modulation periods for rows 814(3-46), ending with the row 814(47), which has a modulation period starting at the beginning of time interval 1002(47) and ending after the lapse of time interval 1002(46). The beginning of each row 814's modulation period is indicated in FIG. 10 by an asterisk (*).

The modulation period for each row 814(0-47) is temporally offset with respect to every other row 814(0-47) in display 808. For example, the modulation period of row 814(1) is temporally offset with respect to the modulation period of row 814(0) by one time interval 1002. Similarly, the modulation period of row 814(2) is temporally offset from the modulation period of row 814(1) by one time interval 1002. Likewise, the modulation period of row 814(3) is temporally offset from the modulation period of row 814(2) by one time interval 1002. This pattern continues for the remaining rows 814(4-47) of display 808. Thus, the rows of the display are driven asynchronously. Stated another way, signals corresponding to gray scale values of one frame of data will be asserted on the pixels of some rows at the same time signals corresponding to grayscale values from a preceding or subsequent frame of data are asserted on other rows. According to this scheme, the system begins to assert image signals for one frame of data on some rows of display 808 before the previous frame of data is completely asserted on other rows. Stated yet another way, a particular row 814's modulation period is temporally offset from the preceding row's modulation period by n time intervals.

It should be noted that the modulation period associated with each row 814(0-47) forms a frame time for that row 814(0-47). Accordingly, signals corresponding to a complete intensity value are written to each row 814(0-47) during each row's own frame time. However, data can be written to pixels 810 more than once per frame. For example, a row's frame time may include a multiple (e.g., two, three, four, etc.) of modulation periods, such that data is written to each pixel 808 of a row repeatedly during the frame time of that row 814. Writing data multiple times during each row's frame time significantly reduces flicker in the image produced by display 808.

It should also be noted that the modulation periods assigned to the rows 814 can be mixed up rather than be in the consecutive order that is shown in chart 1000. For example, a different row (e.g., row 814(28)) could be assigned to the modulation period associated with row 814(0). Indeed, the row 814 that is assigned to each modulation period can be arbitrary as long as it is carried through to any other components (e.g., data manager 514, address generator 704, etc.) that rely on the same modulation period assignments.

FIG. 11 is a table 1100 showing an update schedule for a pixel based on the bit code of data word 602. As discussed above, data word 602 includes four binary-coded bits 604 and four thermometer-coded bits 606. Binary-coded bits 604 are labeled B0-B3 in a first column 1102, while thermometer-coded bits 606 are labeled B4-B7 in the same column. Each bit in column 1102 has a corresponding weight, which is given in a second column 1104 in the same row as the particular bit. Note that each bit weight in column 1104 is given in a number of time intervals 1002. For example, B0 has a weight of one time interval 1002, B1 has a weight of two time intervals 1002, B2 has a weight of 4 time intervals 1002, and so on.

A third column 1106 indicates an update schedule for data word 602's bit code. In particular, a bit in column 1102 is written to a particular pixel 810 during the update time interval 1002 in column 1106 in that pixel's modulation period. Note that the update time intervals 1002 given in column 1106 are for an unadjusted modulation period. In other words, the update time intervals 1002 in column 1106 assume that the pixel's modulation period begins at time interval 1002(0) and ends after time interval 1002(47). For example, B0 is written to a pixel 810 during time interval 1002(0) in that pixel's modulation period. Similarly, bits B1, B2, B3, B4, B5, B6, and B7 are written to pixel 810 in time intervals 1002(1), 1002(3), 1002(7), 1002(15), 1002(24), 1002(32), and 1002(40), respectively, in the same pixel's modulation period.

In general, a particular bit in column 1102 will be written to pixel 810 during a time interval 1002(*x*) in that pixel's modulation period, where x is equal to the sum of the weights of the bits previously written to pixel 810. For example, bit B3 is written to pixel 810 in time interval 1002(7) in that pixel's modulation period. Note that the sum of the weights of B0-B2 is equal to 7 (i.e., 1+2+4=7). Similarly, B6 is written to pixel 810 in time interval 1002(32) because the sum of the weights of bits B0-B5 is equal to 32 (i.e. 1+2+4+8+9+8=32).

As stated above, the bit code in column 1102 is completely arbitrary as long as it meets the constraints set forth above in FIG. 6 for various aspects of the invention. Recall that the bit code in column 1104 meets those constraints. In particular, the sum of the weights (in time intervals 1002) in column 1104 equals an integer multiple of the number or rows 814 in display 808. Meeting this criterion ensures that an equal number of rows are updated during each time interval.

The bit code for data words 602 in column 1104 also ensures that if imagers 504(*r, g, b*) contained two iterations of pixel control circuitry (i.e., s equals two), then an equal number of even- and odd-numbered rows will be updated during each time interval. For example, the sum of the weights in column 1104 is evenly divisible by two, and the number of bits in code 1104 is also evenly divisible by two. In addition, the update time intervals in column 1106 indicate that the bit code in column 1104 produces row schedules where an equal number of rows 814 assigned to a first set (e.g., even-numbered rows) and a second set (e.g., odd-numbered rows) are updated during each time interval 1002. Column 1106 indicates the number of even and odd rows 814 that are updated during each time interval 1002 because the number of rows 814 and the number of time intervals 1002 are equal. In this example, column 1106 contains four even update time intervals 1002(0), 1002(24), 1002(32), and 1002(40) and four odd update time intervals 1002(1), 1002(3), 1002(7), and (15). Therefore, four even-numbered rows and four odd-numbered rows 814 will be updated during each time interval 1002.

Also note that in the present embodiment, the binary bits 604 are able to define 16 intensity values and have a combined bit weight equal to 15 (i.e., 1+2+4+8=15). Accordingly, although it is not necessary, it is beneficial to assign each thermometer bit 606 a weight that is less than or equal to the combined weight of binary bits 604 to ensure that all intensity values can be defined by data word 602. It should also be noted that the number of thermometer bits 606 can be reduced (i.e., by increasing the thermometer bits' weights) while still generating all intensity values if row logic 806 could read the prior pixel value and use the prior value and the at least one bit of data word 602 to determine a new value to assert on the pixel. This pixel-read process is described in U.S. patent application Ser. No. 11/172,623 which is entitled "System and Method for Using Current Pixel Voltages to Drive Display" and is incorporated herein by reference. Reducing the number of thermometer bits 606 in turn reduces the bandwidth required to drive imager 504 and display 808.

Finally, it should also be noted that bits in column 1102 and the weights in column 1104 can be arranged in any particular order in table 1100. However, to maintain uniformity in the display image, the order should not be changed once the update time intervals in column 1106 have been calculated.

FIG. 12 is a table 1200 showing the row schedule for the first five time intervals 1002(0-4). Table 1200 includes a first column 1202 and a second column 1204, which reproduce columns 1102 and 1106 of FIG. 11, respectively, for convenience. The other columns in table 1200 show the row schedules for time intervals 1002(0-4), which are calculated from the update schedule in column 1106 in FIG. 11.

Generally, the row schedule for each time interval 1002(0-47) is determined by the following formula:

$$\text{Row}=(r-T_\text{event})+\tau,$$

where "Row" denotes a row 814 that will be updated during the particular time interval 1002(τ), (r) represents the total number of rows 814 in display 808, T_event is the update time interval in column 1106, 1204 for a particular bit, and (τ) is the number of the time interval 1002 that the row schedule is being calculated for. In the present embodiment, r equals forty-eight because there are forty-eight rows 814 in display 808, the T_Event values are given in column 1204, and τ can be any number ranging from zero to forty-seven which correspond to time intervals 1002(0-47). Note that the value Row is constrained between zero to forty-seven because there are only forty-eight rows in display 808. Therefore, when subtracting or adding in the above equation, the value of (r−T_Event) or Row should not go negative or above forty-seven, but should loop forward or backward to the appropriate row value between zero and forty-eight inclusive.

Column 1206 shows the row schedule for time interval 1002(0) (i.e., τ=0) which was calculated from the equation given above. During time interval 1002(0), B0 bits are written to each pixel 810 in row 814(0), B1 bits are written to each pixel 810 in row 814(47), B2 bits are written to each pixel 810 in row 814(45), B3 bits are written to each pixel 810 in row 814(41), B4 bits are written to each pixel 810 in row 814(33), B5 bits are written to each pixel 810 in row 814(24), B6 bits are written to each pixel 810 in row 814(16), and B7 bits are written to each pixel 810 in row 814(8). Note that four even-numbered rows 814 and four odd-numbered rows 814 are updated during time interval 1002(0).

Similarly, the row schedule for time interval 1002(1) (i.e., τ=1) shown in column 1208 indicates that B0 bits are written to each pixel 810 in row 814(1), B1 bits are written to each pixel 810 in row 814(0), B2 bits are written to each pixel 810 in row 814(46), B3 bits are written to each pixel 810 in row 814(42), B4 bits are written to each pixel 810 in row 814(34), B5 bits are is written to each pixel 810 in row 814(25), B6 bits are written to each pixel 810 in row 814(17), and B7 bits are written to each pixel 810 in row 814(9). Again, note that four even-numbered rows and four odd-numbered rows are updated during time interval 1002(1).

This trend continues for the remaining time intervals. For instance, in time interval 1002(2) shown in column 1210, bits B0-B7 are written to rows 814(2), 814(1), 814(47), 814(43), 814(35), 814(26), 814(18), and 814(10), respectively, for each pixel in those rows. The row schedules for time interval 1002(3) and 1002(4) are given in columns 1212 and 1214, respectively. Again, the bit code of data word 602 facilitates four even- and four odd-numbered rows 814 to be updated during each time interval 1002.

It should be noted that because the number of time intervals 1002 is equal to n times the number of rows 814, the row schedule for each time interval 1002 will contain a number of row updates equal to the number of bits (b) in data word 602 divided by n (i.e., b/n). In this case, where b equals eight and n equals one, there are eight rows 814 are updated during each time interval 1002(0-47).

FIGS. 13A-B each display half of a chart 1300 combining the modulation scheme shown in timing chart 1000, the update schedule shown in table 1100, and the row schedules shown in table 1200. Like chart 1000, chart 1300 shows that the modulation periods for rows 814(0-47) are temporally offset from one another and are each 48 time intervals 1002 long. In addition, chart 1300 shows the row schedule, which was calculated based upon the update schedule in column 1106 of FIG. 11, for each time interval 1002(0-47).

Chart 1300 illustrates several aspects of the driving scheme of the present invention. In particular, chart 1300 indicates when each of bits B0-B7 are written to a row 814 of pixels during that row's modulation period. In addition, chart 1300 indicates which rows are updated during each time interval 1002(0-47) independent of their modulation period. A box in chart 1300 with a number in it indicates the bit that is written to a row 814 in an associated row of chart 1300 during the time interval 1002 in the same column. For example, B4 bits are written to row 814(8) during time interval 1002(23). As another example, B7 bits are written to row 814(39) during time interval 1002(31).

Looking across the rows in chart 1300, particular bits of a compound data word 602 are written to a row 814 based on their weight within that row's modulation period. For example, row logic 806 updates row 814(0) during time intervals 1002(0), 1002(1), 1002(3) 1002(7), 1002(15), 1002(24), 1002(32) and 1002(40). Note that the time between when particular bits are written to row 814(0) corresponds to the weights of the individual bits in the bit code of data word 602. For example, bit B4 has a weight of 9 time intervals 1002, and there are 9 time intervals 1002 between when row logic 806 writes B4 and when row logic 806 writes B5 to row 814(0).

The remaining rows 814(1-47) are updated during the same time intervals 1002(0-47) as row 814(0) when the time intervals 1002(0-47) are adjusted for a particular row's modulation period. For example, with the time intervals 1002(0-47)

numbered as shown, row 814(1) is updated during time intervals 1002(1), 1002(2), 1002(4), 1002(8), 1002(16), 1002(25), 1002(33), and 1002(41). However, row 814(1) has a modulation period beginning one time interval later than row 814(0). If the time intervals 1002(0-47) were adjusted (i.e., by subtracting one from each time interval) such that row 814(1) became the reference row, then row 814(1) would be updated during time intervals 1002(0), 1002(1), 1002(3), 1002(7), 1002(15), 1002(24), 1002(32), and 1002(40), which are the same as row 814(0). Therefore, each row 814(0-47) is updated at different times when viewed with respect to one particular row's (i.e., row 814(0)) modulation period, however each row 814(0-47) is updated according to the same algorithm. The algorithm just starts at a different time for each row 814(0-47).

In addition, regardless of modulation period, each column in chart 1300 shows a row schedule for each time interval 1002(0-47). For example, the first five columns indicate the row schedules shown in columns 1206, 1208, 1210, 1212, and 1214 in FIG. 12. Chart 1300 also clearly shows that eight rows are updated during each time interval 1002. Therefore, display system 500 is 100% efficient at transferring data between display driver 502 and imagers 504(*r, g, b*). In addition, the present invention reduces power requirement variations of display system 500 over time intervals 1002(0-47).

Row logic 806 and row decoder 816, under the control of signals provided by imager control unit 516 (FIG. 5), update rows 814(0-47) according to the row schedules shown for each time interval 1002(0-47) shown in FIGS. 13A-13B. As stated above, row logic 806 updates eight rows 814 per time interval 1002. To update a row 814, row logic 806 receives a data word 602 for each pixel 810 in the row 814. Row logic 806 also receives an adjusted time value via adjusted timing input 830. Based on the adjusted time value, each logic unit 902(0-1951) in row logic 806 selects the appropriate bit of data word 602 to assert on the associated pixel 810 during the particular time interval 1002. Accordingly, row logic 806 asserts the appropriate bits for an entire row on data lines 844(0-1951) (i.e., one bit per line).

As row logic 806 is asserting data bits on data lines 844 during a time interval 1002, row decoder 816 receives row addresses from address input 832 that are associated with the rows 814(0-47) of pixels that are being updated during the particular time interval 1002. For each row address received and where the load data signal on load data input 834 is LOW, row decoder 816 decodes the row address and enables the word line 846(0-47) associated with the particular row 814(0-47) that needs to be updated. Each pixel 810 in the enabled row 814 then latches the data asserted on the respective data line 844 and asserts the latched data onto its pixel electrode.

Time adjuster 708 (FIG. 7) ensures that the time values generated by timer 702 are adjusted for each row 814(0-47), such that row logic 806 writes the appropriate bit to each row 814(0-47) during a particular time interval. For example, for a row address associated with row 814(0), time adjuster 708 does not adjust the timing signal received from timer 702. For a row address associated with row 814(1), time adjuster 708 decrements the time value received from timer 702 by one. For a row address associated with row 814(2), time adjuster 708 decrements the time value received from timer 702 by two. This trend continues for all rows 814, until finally for a row address associated with row 814(47), time adjuster 708 decrements the time value received from timer 702 by forty-seven (47).

It should be noted that time adjuster 708 does not produce negative time values, but rather loops the time value back to 47 to finish the time adjustment if the adjustment value needs to be decremented below a value of zero. For example, if timer 702 generated a value of 11 and time adjuster 708 received a row address associated with row 814(19), then time adjuster 610 would output an adjusted time value of 40. The time value of 40 is the time in row 814(19)'s (adjusted) modulation period when bit B7 should be written to the pixels in row 814(19).

Because each bit B0-B7 is written to a row 814(0-47) during the same time intervals in that row's respective modulation period, time adjuster 708 need only output eight different adjusted time values. In the present embodiment, the adjusted time values are 0, 1, 3, 7, 15, 24, 32, and 40. Depending on what adjusted time value row logic 806 receives determines what bit row logic 806 outputs. For example, if row logic 806 receives an adjusted time value of 0, then row logic outputs B0 onto data lines 844(0-1951). Similarly, if row logic 806 receives an adjusted time value of 24, then row logic 806 asserts bits B5 for an entire row of pixels onto data lines 844(0-1951). This process occurs eight times per time interval 1002. Row logic 806 does not need to know which row it is updating because the adjusted time value alone tells row logic 806 which bit plane to assert for each pixel in a row 814 on data lines 844.

Note that the adjusted time values are the same update time intervals shown in column 1106 in FIG. 11. Additionally, the bit that row logic 806 writes to the pixels is also determined by the update schedule in table 1100. In this embodiment, B0 bits are output for an entire row when row logic 806 receives an adjusted time value of zero, B1 bits are output for an adjusted time value of one, B2 bits are output for an adjusted time value of three, B3 bits are output for an adjusted time value of seven, B4 bits are output for an adjusted time value of fifteen, B5 bits are output for an adjusted time value of twenty-four, B6 bits are output for an adjusted time value of thirty-two, and B7 bits are output for an adjusted time value of forty. As noted above in FIG. 11, this schedule may change depending on the bit code of data word 602 and the weights of its bits.

Row logic 806 sequentially updates each row 814(0-47) of display 808 that is supposed to be updated in a particular time interval 1002(0-47). For example, during time interval 1002(0), row logic 806 will update rows 814(0), 814(8), 814(16), 814(24), 814(33), 814(41), 814(45), and 814(47). The particular order that row logic 806 updates the rows 814 in each time interval 1002(0-47) can be predefined or arbitrary. However, row logic 806 must update all rows 814 scheduled in a particular time interval 1002 before the time interval has lapsed.

The update schedule in column 1106 in FIG. 11 provides another useful function in that it determines in large part the size of circular memory buffer 804. In particular, circular memory buffer 804 includes a predetermined amount of memory allocated for storing each bit of a compound data word 602 for each pixel in display 808. Accordingly, in the present embodiment, circular memory buffer 804 includes eight memory sections, one for each of bits B0-B7 for each pixel 810 in display 808.

In general, a bit of data is stored in circular memory buffer 804 only as long as the bit is needed for row logic 806 to assert the bit onto an associated pixel 810. Therefore, the size of a memory section associated with a particular bit is calculated based on the same principle. Note from column 1106 in FIG. 11 (and the modulation period of row 814(0) in FIG. 13) that each bit of a compound data word 602 can be discarded after the lapse of the following number of time intervals:

| Bit Evaluated | Time Interval 1002 |
|---|---|
| B0 | 0 |
| B1 | 1 |
| B2 | 3 |
| B3 | 7 |
| B4 | 15 |
| B5 | 24 |
| B6 | 32 |
| B7 | 40 |

Therefore, because bit B0 associated with a pixel 814 is no longer needed after time interval 1002(0), bit B0 can be discarded (or over-written) after the lapse of time interval 1002(0). Similarly, bit B1-B7 can be discarded (e.g., over-written) any time after the lapse of time intervals 1002(1), 1002(3), 1002(7), 1002(15), 1002(24), 1002(32), and 1002 (40), respectively.

The size of each memory section of circular memory buffer 804 for a particular column of pixels depends on the number of bits in each data word 602 and the number of time intervals 1002 that a particular bit is needed in a modulation period. Accordingly, each column 812 in display 808 needs the following amounts of memory in circular memory buffer 804:

| Bit | Memory Size (bits/column) |
|---|---|
| B0 | 1 |
| B1 | 2 |
| B2 | 4 |
| B3 | 8 |
| B4 | 16 |
| B5 | 25 |
| B6 | 33 |
| B7 | 41 |

Therefore, circular memory buffer 804 contains (1952×1) bits of memory for B0 bits, (1952×2) bits of memory for B1 bits, (1952×4) bits of memory for B2 bits, (1952×8) bits of memory for B3 bits, (1952×16) bits of memory for B4 bits, (1952×25) bits of memory for B5 bits, (1952×33) bits of memory for B6 bits, and (1952×41) bits of memory for B7 bits. As a result, circular memory buffer 804 contains 253.8 Kbits of memory. In contrast, if circular memory buffer 804 was a prior-art frame buffer that stored 8 bits of video data for each pixel for the entire frame, it would contain 749.6 Kbits of data. Therefore, circular memory buffer 804 is approximately 34% the size of a prior art input buffer (like buffer 110), and therefore requires substantially less area on imager 504(*r, g, b*). Finally, it should be noted that the above values assume that one row 814 of new video data is written to circular memory buffer 804 during each time interval 1002.

It should also be noted that additional memory-saving alterations can be made to the present invention. For example, the size of circular memory buffer 706 can be reduced if different bits of particular data words 1202 are written to circular memory buffer 706 at different times. As another example, circular memory buffer 804 could be situated outside imager 504 and transfer bits directly to row logic 806. In such a case, memory in the imager 504 could be reduced at the expense of higher bandwidth between display driver 502 and imagers 504(*r, g, b*).

Those skilled in the art will realize that the specific amounts of memory associated with each section of circular memory buffer 706 can be modified as necessary. For example, the amount of memory in each memory section might be increased to conform with a standard memory size and/or standard counters, or to account for data transfer timing requirements. As another example, the size of one memory section could be increased while the size of another memory section could be reduced. Indeed, many modifications are possible. Furthermore, the functionality of circular memory buffer 804 is discussed in more detail in U.S. patent application Ser. No. 11/172,622 entitled "System and Method for Discarding Data Bits During Display Modulation," which is incorporated by reference in its entirety.

Address converter 818 indicates to circular memory buffer 804 the locations to store and retrieve each bit of display data based on the 6-bit row address it receives via address input 832 and the size of each section of circular memory buffer 804. Address converter 818 converts the 6-bit row address received via input 832 into a memory address for each section of memory in circular memory buffer 804 associated with a bit of data word 602. The converted memory addresses are then asserted onto address input 842 such that circular memory buffer 804 either loads data into or reads data from the associated memory locations within circular memory buffer 804. In particular, address converter 818 uses the following algorithms to convert a row address into a memory address for each bit of data word 602 stored in circular memory buffer 804:

Bit B0: (Row Address) MOD (B0 Memory Size)
Bit B1: (Row Address) MOD (B1 Memory Size)
Bit B2: (Row Address) MOD (B2 Memory Size)
Bit B3: (Row Address) MOD (B3 Memory Size),
Bit B4: (Row Address) MOD (B4 Memory Size)
Bit B5: (Row Address) MOD (B5 Memory Size)
Bit B6: (Row Address) MOD (B6 Memory Size)
Bit B7: (Row Address) MOD (B7 Memory Size), where MOD is the remainder function.

The number of lines in address input 842 is determined based on the size of the memory section for each bit in data word 602. In particular, one line is needed to uniquely address each memory location for both bits B0 and B1, two lines are needed to uniquely address each memory location for bits B2, three lines are needed to uniquely address each memory location for bits B3, four lines are needed to uniquely address each memory location for bits B4, five lines are needed to uniquely address each memory location for bits B5, and six lines are needed to uniquely address each memory location for bits B6 and B7. Accordingly, address input 842 includes twenty-eight address lines. It should be noted that because B0 only requires one bit of memory (for each column 812 of pixels 810), this bit of memory does not necessarily need to be separately addressed. Rather, each B0 bit can be written into circular memory buffer 804 in the same B0 memory location, thereby eliminating one line from address input 842. However, address input 842 is shown to include twenty-eight lines for ease of explanation.

Figure 14A:
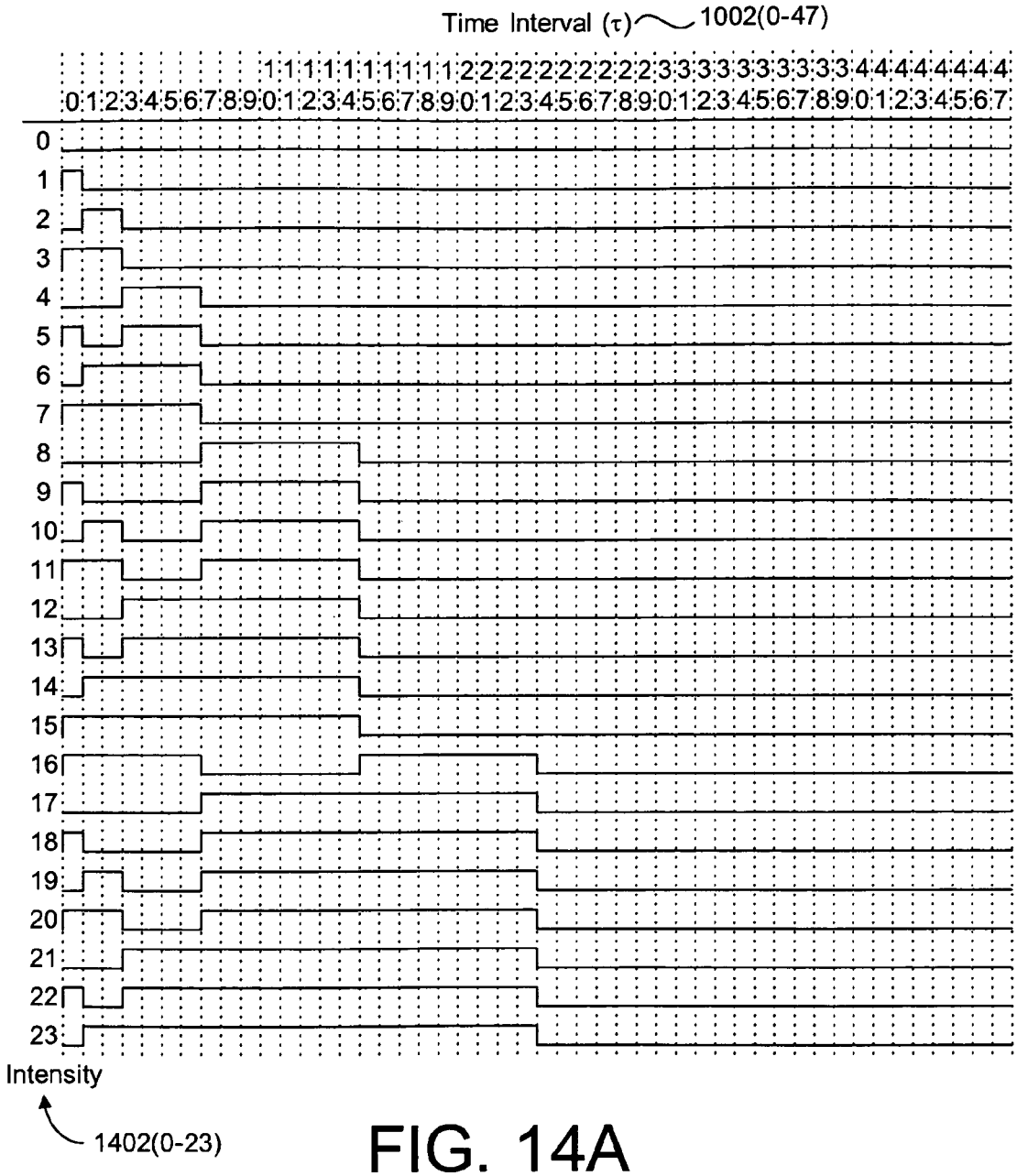
FIG. 14A shows a portion of the waveforms for particular intensity values that can be asserted by the row logic of FIG. 9 onto pixels of the display of FIG. 8.
Figure 14B:
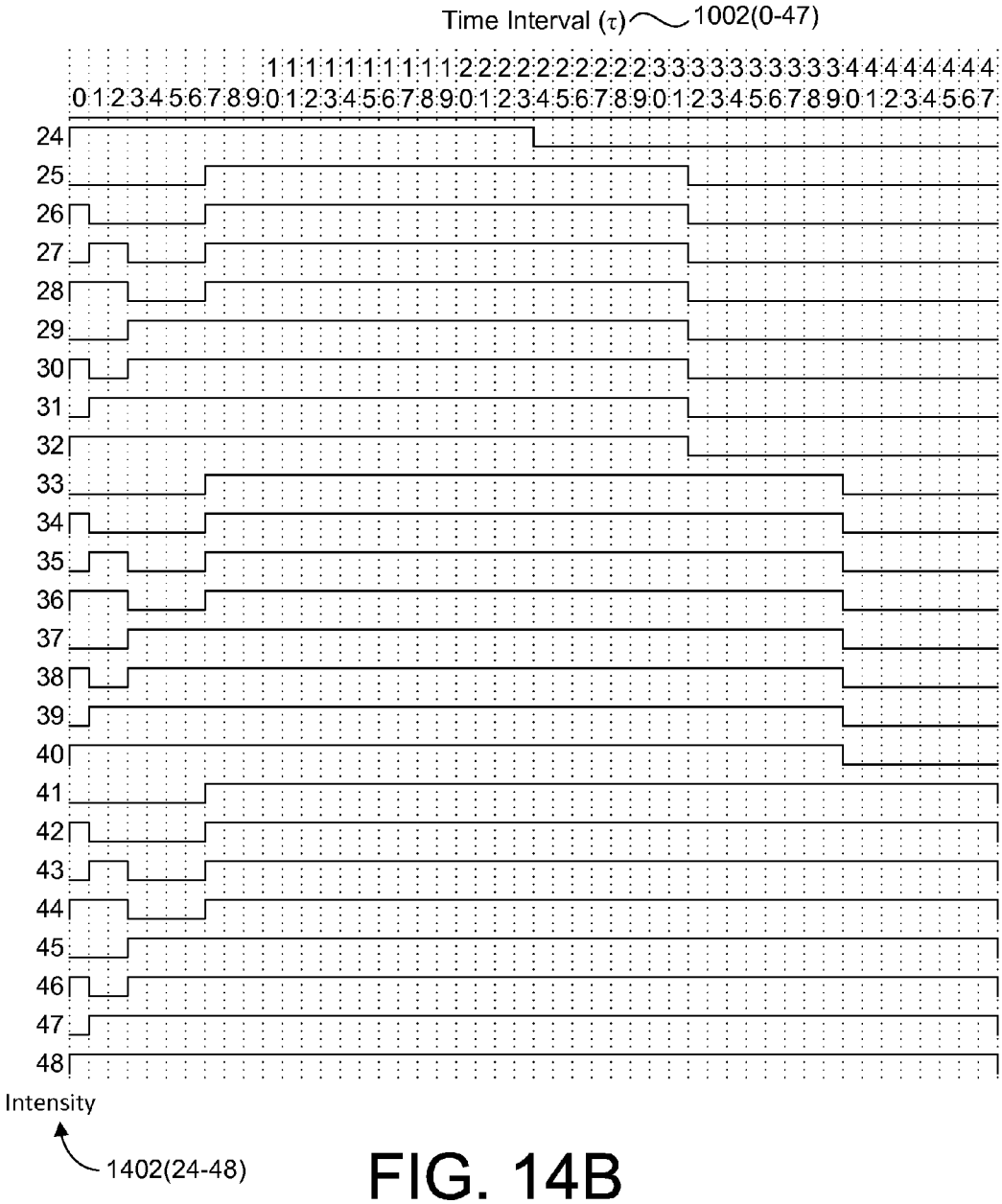
FIG. 14B shows the rest of the intensity waveforms of FIG. 14A.

FIGS. 14A-B show the 49 intensity waveforms 1402(0-48) (i.e., 48 states plus the zero state) that row logic 906 can assert on each pixel 810 based on the value of the bits of compound data word 602. By writing each bit of data word 602 to a pixel 810, row logic 806 either writes a digital ON value or digital OFF value to the pixel 810. In other words, row logic 806 initializes an electrical signal on the pixel 810 by writing a digital ON value, and it terminates the electrical signal by writing a digital OFF value to the pixel 810. The sum of the time periods 1002 that a pixel 810 has a digital ON value corresponds to a particular intensity value 1402(0-48).

According to the present invention, the number of pulses needed to write an intensity value to a pixel is equal to or less than the conventional PWM scheme. For example, intensity values 1402(4) and 1402(5) are written to a pixel 810 with the same number of pulse transitions (i.e., two and four transitions respectively) as a convention PWM scheme. In contrast, intensity value 1402(17) is written with only two pulse transitions, whereas to write the same intensity value using conventional PWM requires four pulse transitions. Therefore, the present driving method advantageously reduces the number of pulse transitions required to assert some intensity values 1402 over conventional PWM methods.

It should be noted that data manager 514 has the flexibility to define intensity values 1402(0-48) based on the bit coding of compound data word 602. In particular, depending on the number and respective weights of binary-coded bits 604 and thermometer-coded bits 606 in data word 602, data manager 514 may be able to define particular intensity values 1402 in several ways. For example, intensity value 1402(17) can be defined as shown where B3=1 (weight=8) and B4=1 (weight=9). The result is a single pulse waveform that can be asserted on a pixel 810 with a single pulse (i.e., only two transitions in the electrical signal). In contrast, intensity value 1402(17) can also be defined by setting B0=1 (weight=1), B3=1 (weight=8), and B5=1 (weight=8), which requires three different pulses, and six transitions in the electrical signal asserted on pixel 810. Accordingly, depending on the bit code of compound data word 602, data manager 514 can be configured to assign values to the particular bits of compound data word 602 to produce a grayscale value 1402 with the fewest number of pulse transitions possible. In any case, data manager 514 is not limited in how it defines particular intensity values 1402, but may be configured to define intensity values 1402 depending on specific design goals or driver requirements.

The intensity waveforms 1402(0-48) also indicate the particular bit (i.e., one of B0-B7) that row logic 806 writes to particular pixel 810 at a particular time interval 1002(0-47). As described above, because only one bit of a data word 602 is required to turn a pixel ON or OFF during a particular time interval 1002, the present invention facilitates a significant reduction in the memory requirement of imagers 504, as described above.

A general description of the operation of display driving system 500 will now be provided with reference to FIGS. 1-14 as described thus far.

Initially, at startup or upon a video reset, data manager 514 receives a first Vsync signal via synchronization input terminal 508 and a first timing signal via coordination line 522 from timer 602, and begins supplying display data to imagers 504(*r, g, b*). To provide display data to imagers 504(*r, g, b*), data manager 514 receives video data from video data input terminal 510, divides the video data based on color (e.g., red, green, and blue) into, converts the display data into compound data word 602 including binary-coded bits 604 and thermometer-coded bits 606, temporarily stores the compound data words 602 in frame buffer 506A, subsequently retrieves the video data from frame buffer 506A (while writing the next frame of data to frame buffer 506B), and provides the appropriate colored video data to each of imagers 504(*r, g, b*) via the respective imager data lines 520(*r, g, b*). Accordingly, before or during a particular timing signal value (e.g., 0-47), data manager 514 supplies display data to each of imagers 504(*r, g, b*) for each pixel 810 of a row 814 whose modulation period begins in the particular time interval 1002. Because the number of non-zero intensity values (and thus time intervals 1002) are equal to the number of rows 814 of pixels 810 in display 808, data manager 514 provides colored display data to imagers 504(*r, g, b*) at a rate that is sufficient to provide at least one row 814 of video data to imagers 504(*r, g, b*) within the duration of one of time intervals 1002(0-47).

Colored video data is received by each imager 504(*r, g, b*) via data input 822 and is loaded into shift register 802 sixteen bits at a time. When enough video data is accumulated for an entire row 814 of pixels 810, shift register 802 outputs eight bits of video data (e.g., a compound data word 602) for each pixel 810 on a respective one of the 1952×8 data lines 836. The video data output from shift register 802 is loaded into circular memory buffer 804.

Circular memory buffer 804 loads the data asserted on data lines 836 when a HIGH "load data" signal is generated by address generator 704 of imager control unit 516 and asserted on load input 840. A row address associated with the video data asserted on data lines 836 is simultaneously generated by address generator 704 and is asserted on address input 832. The address is converted by address converter 818 into a memory address associated with circular memory buffer 804. Then a memory address associated with each bit of data word 602 for each pixel 810 is asserted on address input 842 of circular memory buffer 804 such that each bit of the 8-bit data word 602 is stored in an associated memory location in circular memory buffer 804.

When circular memory buffer 804 receives memory addresses from address converter 818 and the signal on load input 840 is LOW, then circular memory buffer 804 outputs video data for each pixel 810 in a row 814 associated with the converted row address to row logic 806 via data lines 838. Each logic unit 902(0-1951) in row logic 806 receives and temporarily stores the 8-bit combination data word 602 associated with one of pixels 810. Row logic 806 simultaneously receives a 6-bit adjusted time value via adjusted timing input 830 indicative of an adjusted time interval for the particular row 814 that is going to be updated. Based on the adjusted time value, each of bit select logics 904(0-1951) selects a bit and assert the selected bit on a respective one of data lines 844(0-1951).

Row decoder 816 simultaneously receives the row addresses from address generator 704 via address input 832 as well as disable signals via load data input 834. When the signal asserted on load data input 834 is LOW, row decoder 816 enables one of word lines 846 corresponding to each row address asserted on address input 832. When a row 814 of pixels 810 is enabled by one of word lines 846, the value of the data bit asserted on each pixel 810 by row logic 806 is latched into the associated storage element of the pixels 810 in the particular row 814. If a HIGH signal is asserted on load data input 834, row decoder 816 ignores the address asserted on address input 832 because the address received thereon corresponds to a row address of data being loaded into circular memory buffer 804.

It should be noted that for each timing signal output by timer 702, data manager 514, imager control unit 516, and imagers 504(*r, g, b*) process (i.e., update electrical signals on) eight rows 814 of display 808. For example, as shown in FIGS. 13A-B, when timer 702 outputs a timing signal having a value of zero, identifying time interval 1002(0), imager control unit 516, and imagers 504(*r, g, b*) must update rows 814(0), 814(8), 814(16), 814(24), 814(33), 814(41), 814(45), and 814(47). Accordingly, address generator 704 outputs the row addresses of each of the foregoing rows. Note that address generator 704 can output the row addresses associated with rows 814(0), 814(8), 814(16), 814(24), 814(33), 814(41), 814(45), and 814(47) in any particular order.

Responsive to receiving a timing signal and row addresses, time adjuster 708 adjusts the time value output by timer 702 for the modulation period associated with each row 814 that is updated in a particular time interval. For example, in time interval 1002(0), time adjuster 708 does not adjust the time value output by timer 702 for row 814(0). For row address 814(8), time adjuster 708 decrements the time value (i.e., zero) by 8, and outputs an adjusted time value of 40. For row address 814(16), time adjuster 708 decrements the time value by 16, and outputs an adjusted time value of 32. For row address 814(24), time adjuster 708 decrements the time value by 24, and outputs an adjusted time value of 24. For row address 814(33), time adjuster 708 decrements the time value by 33, and outputs an adjusted time value of 15. For row address 814(41), time adjuster 708 decrements the time value by 418, and outputs an adjusted time value of 7. For row address 814(45), time adjuster 708 decrements the time value by 45, and outputs an adjusted time value of 3. Finally, for row address 814(47), time adjuster 708 decrements the time value by 47, and outputs an adjusted time value of 1.

It should be noted that a timing signal output by timer 702 having a value of zero (0) marks the beginning of a new modulation period for row 814(0). Accordingly, data manager 514 must provide new display data for row 814(0) to each imager 504(*r, g, b*) before row logic 806 can update row 814(0) for the first time in its first/next modulation period. Accordingly, data manager 514 can provide data for row 814(0) to imagers 504(*r, g, b*) at a variety of different times. For example, data manager 514 could provide the display data all at the beginning of time interval 1002(0) before row 814(0) is updated by imager control unit 516 and imagers 504(*r, g, b*). Alternately, data manager 514 could transfer the display data for row 814(0) to imagers 504(*r, g, b*) during (e.g., at the end of) the previous time interval 1002(47). In either case, display data for at least one of rows (0-47) should be transferred to imagers 504(*r,g,b*) during each time interval 1002(0-47). In the present embodiment, it will be assumed that data manager 514 loads display data for row 814(0) during time interval 1002(47) after all rows in time interval 1002(47)'s row schedule have been updated.

Because shift register 802 contains enough memory to store display data for an entire row 814 of pixels, data manager 514 can load display data for a row 814 to imagers 504(*r, g, b*) without being synchronized with address generator 704. Thus, the data storage provided by shift register 802 advantageously decouples the processes of providing display data to imagers 504(*r, g, b*) and the loading of the display data into circular memory buffer 804.

No matter what scheme for providing display data to imagers 504(*r, g, b*) is used, address generator 704 will assert a "write" address for each row 814 of display data provided to imagers 504(*r, g, b*) by data manager 514 at an appropriate time. For example, address generator 704 might sequentially assert a write address for a row 814 (e.g., row 814(0)) of display data stored in shift register 802 after all rows are processed during the preceding time interval (e.g., time interval 1002(47)). Alternately, address generator could assert each write address for the stored row 814 (e.g., row 814(0)) at the beginning of time interval (e.g., time interval 1002(0)). In either case, it is important to note that display data should be supplied to each of imagers 504(*r, g, b*) in the same order as the rows 814 are assigned to modulation periods. In the present embodiment, display data is supplied to imagers 504 (*r, g, b*) in order from row 814(0) through row 814(47).

When a "write" address is asserted on address output bus 718, address generator 704 will also assert a HIGH load data signal on load data output 720, causing circular memory buffer 804 to store the display data being asserted on data lines 836 by shift register 802. In addition, the HIGH load data signal asserted on load data output 720 also temporarily disables row decoder 816 from enabling a new word line 846 associated with the write address, and prevents time adjuster 708 from altering the adjusted timing signal asserted on adjusted timing output 722.

While the displays 808 of imagers 504(*r, g, b*) are being modulated, debias controller 706 is coordinating the debiasing process of display 808 of each imager 504(*r, g, b*) by asserting data invert signals on global data invert output 726 and a plurality of common voltages on common voltage output 724. Debias controller 706 debiases display 808 of each imager 504(*r, g, b*) to prevent deterioration of the displays 808. Debias controller 706 debiases each display 808 by causing the electrical signals asserted on each pixel 810 to be asserted in a first bias direction during a first group of time intervals 1002(0-47), and causing the electrical signals to be asserted in a second bias direction during a second group of time intervals 1002(0-47). The bias directions are relative to the common electrode overlying each display 808.

Because the operation of data manager 514, the components of imager control unit 516, and each of imagers 504(*r, g, b*) is either directly or indirectly dependent upon the timing signals produced by timer 702, displays 808 in each imager 504(*r, g, b*) remains synchronized during the display driving process. Therefore, a coherent, full color image is formed when the images produced by displays 808 of imagers 504(*r, g, b*) are superimposed.

As described thus far, the present invention provides many advantages over prior art display driving systems. First, because the present invention sets the number of non-zero intensity states (i.e., grayscales) equal to an integer multiple of the number of rows in the display, data and instruction transfer from display driver 502 to imagers 504(*r, g, b*) (and among other elements of display system 500) is 100% efficiency over the entire frame of display data. In the example described above, the signals on eight rows are updated during each time interval. Furthermore, the fact that each row in the display is assigned to its own modulation period and driven asynchronously aids in equalizing the bandwidth. In particular, the total number of row updates can be spread over the entire frame, which becomes more and more beneficial as the number of rows and bits in compound data words increases.

The present invention also provides the advantage that the same number of rows that are assigned to particular sets (e.g., even- and odd-numbered rows) can be updated during each time interval 1002. As will be described in greater detail below, this enables different rows 814 of the display 808 to be driven by different pixel control circuitries in the same imager. Because an equal number of rows that are assigned to each set are updated during each time interval 1002, each pixel control circuitry controlling a set of rows in display 808 will be operating at 100% efficiency during each time interval 1002. In addition, driving different sets of rows 814 in display 808 with different modulation circuitries in the same imager enables the pixels 810 in display 808 to be updated more times per frame.

The present invention also facilitates writing intensity values to pixels using fewer pulse transitions than conventional pulse width modulation driving schemes. This advantageously improves the displayed image because the liquid crystal material in the pixel cell is charging and discharging fewer times per frame, thereby improving contrast, reducing visual artifacts such as ghosting, and reducing lateral field effects.

Finally, recall that the present invention is equally applicable to field-sequential display systems where a single imager sequentially processes each color of display data. If the present invention is used to drive a field-sequential display, the various components of display system and the imager may be modified as necessary. For example, circular memory buffer 806 might be modified to contain image data for each color of display data. As another example, fewer display data lines 520 between data manager 514 and the imager may be needed in a field-sequential display system. These and other modifications will become apparent in view of this disclosure of the present invention.

Figure 15:
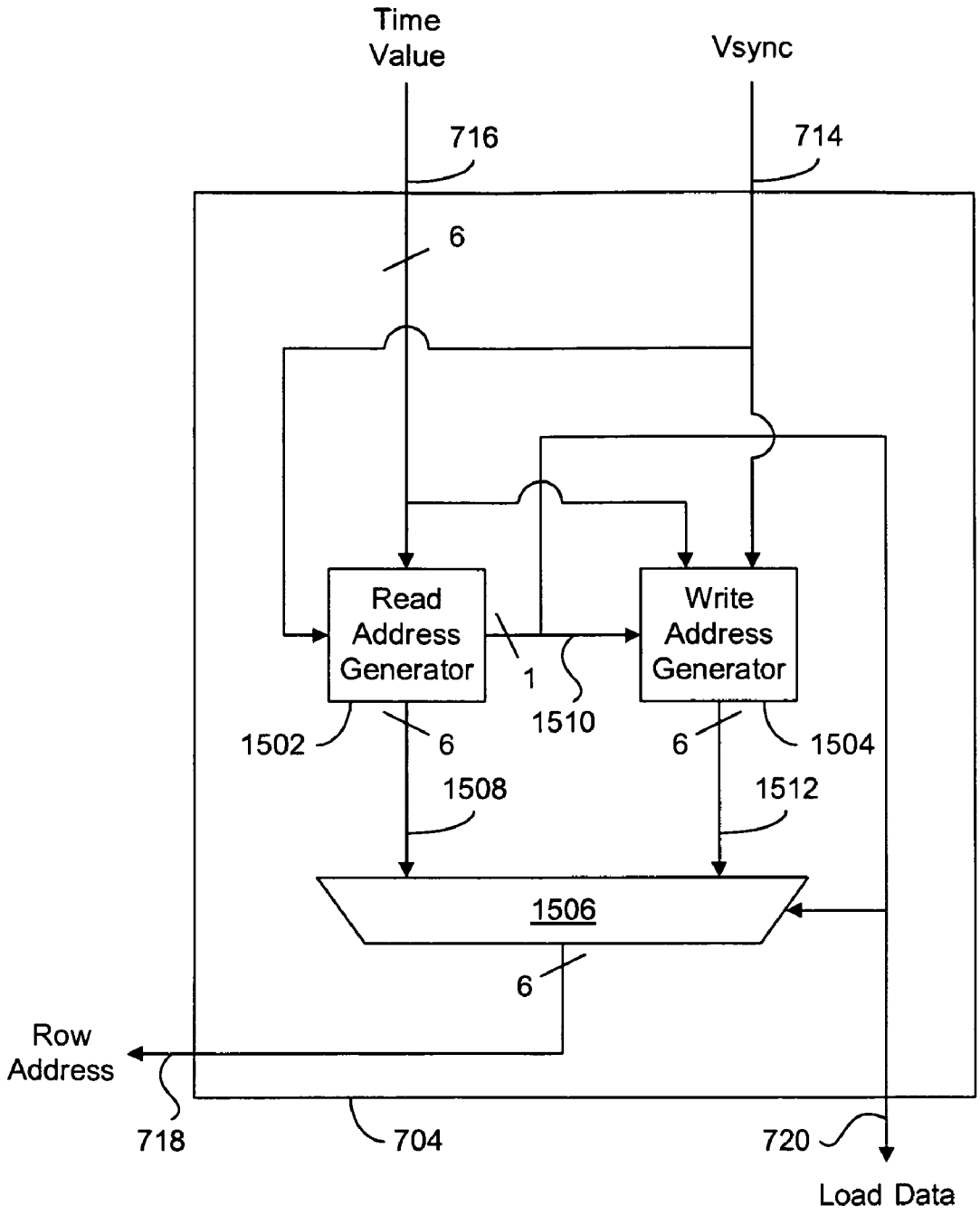
FIG. 15 is a block diagram showing the address generator of FIG. 7 in greater detail.

FIG. 15 is a block diagram showing address generator 704 in greater detail. Address generator 704 includes a read address generator 1502, a write address generator 1504, and a multiplexer 1506.

Read address generator 1502 receives 6-bit time values from timer 702 via timing input 716 and Vsync signals via synchronization input 714. Based on the time value, read address generator 1502 sequentially outputs row addresses that are updated during that time value onto 6-bit read address lines 1508. While read address generator is outputting read row addresses onto lines 1508, read address generator also asserts a LOW write enable signal on a write enable line 1510. Write enable line 1510 is coupled to write address generator 1504, to the control terminal of multiplexer 1508, and to load data output 720. A LOW write enable signal disables write address generator 1504, and instructs multiplexer 1506 to couple read address lines 1508 with address output bus 718, such that "read" row addresses are delivered to time adjuster 708 and to imagers 504(*r, g, b*).

A LOW write enable signal asserted on load data output 720 serves as a LOW load data signal for time adjuster 708, circular memory buffer 804, and row decoder 816. Accordingly, while write enable signal remains LOW, time adjuster 708 adjusts the time value generated by timer 702 for each read row address generated by read address generator 1502, circular memory buffer 804 outputs bits of display data associated with each read row address, and row decoder 816 enables word lines 846 corresponding to each read row address.

A short time after read address generator 1502 has generated a final read row address for the particular time value, read address generator 1502 asserts a HIGH write enable signal on write enable line 1510. In response, write address generator 1504 generates a "write" row address and asserts the write address on write address lines 1512 such that a new row of data can be written into circular memory buffer 804. In addition, when a HIGH write enable signal is asserted on write enable line 1510, multiplexer 1506 is operative to couple write address lines 1512 with address output bus 718, thereby delivering write addresses to time adjuster 708 and imagers 504(*r, g, b*). A HIGH write enable signal (i.e., a HIGH load data signal) also disables time adjuster 708 and row decoder 816, and causes circular memory buffer 804 to load a row of new display data from shift register 802 into memory locations associated with the generated write row addresses.

Write address generator 1504 also receives timing signals indicative of a time interval 1002 via timing input 716, and Vsync signals via synchronization input 714. When the write enable signal is HIGH, write address generator 1504 outputs a row address for a row 814 whose modulation period is beginning in the subsequent time interval 1002. For example, if the time value on timing input 716 was zero, corresponding to time interval 1002(0), then write address generator 1504 would generate a write row address for row 814(1). Similarly, if the time value was one, then write address generator 1504 would generate a write row address for row 814(2). As another example, if the time value was 47, then write address generator 1504 would generate a write row address for row 814(0). In this manner, rows of display data stored in shift register 802 can be written into circular memory buffer 804 before they are needed by row logic 806 to modulate display 808.

FIG. 16A is a table 1602 indicating the row addresses output by read address generator 1502 for each particular time value received from timer 702. As shown in FIG. 16A, read address generator 1502 outputs eight different row addresses for a particular time value. For example, for time interval 1002(0), read address generator 1502 outputs row addresses for rows 814(0), 814(47), 814(45), 814(41), 814(33), 814(24), 814(16), and 814(8). Similarly, for time interval 1002(1), read address generator 1502 outputs row addresses for rows 814(1), 814(0), 814(46), 814(42), 814(34), 814(25), 814(17), and 814(9). In general, read address generator 1502 outputs rows 814 associated with the row schedule determined in FIG. 12 for a particular time interval 1002.

Figure 16B:
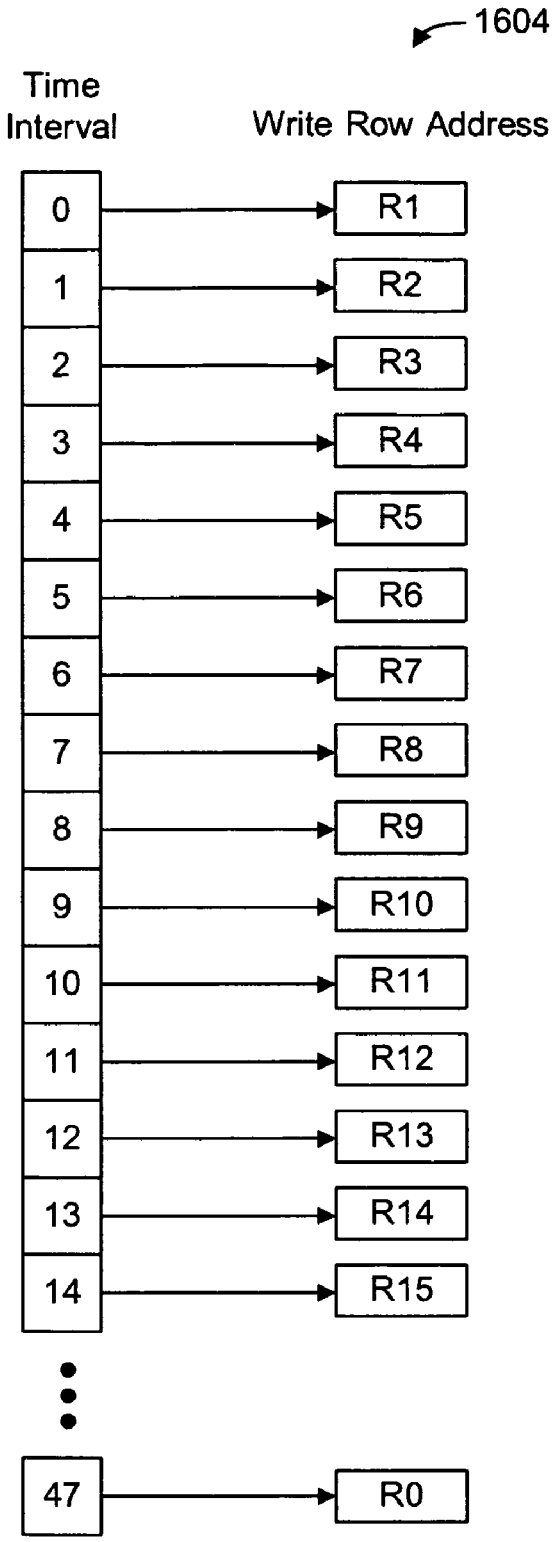
FIG. 16B is a table showing input and output values of the write address generator shown in FIG. 15.

FIG. 16B is a table 1604 indicating the write row address output by write address generator 1504 for each particular time value received from timer 702 via timing input 716. As shown in FIG. 16B, for a particular time value indicative of a time interval 1002, write address generator 1504 outputs a row address for the row 814 whose modulation period starts in the subsequent time interval 1002. Because the number of non-zero intensity states (and thus time intervals 1002) is equal to the number of rows 814 in display 808, only one row of data needs to be written to circular memory buffer 804 during each time interval 1002.

Figure 17A:
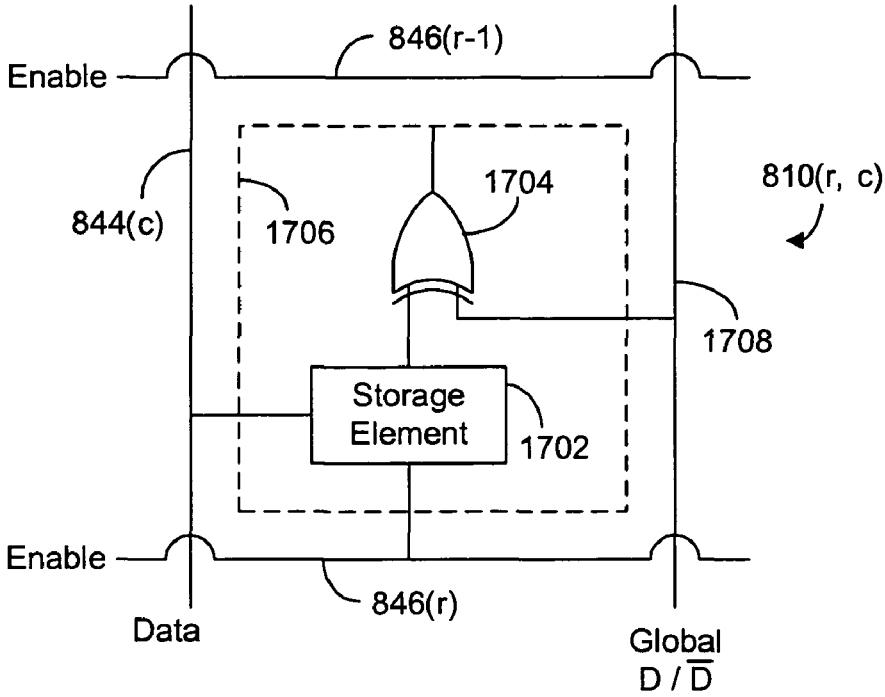
FIG. 17A is a block diagram of a pixel cell according one embodiment of the present invention.

FIG. 17A shows a first embodiment of a pixel 810(*r, c*) in greater detail, where (r) and (c) represent the intersection of a row and column in which pixel 810 is located. In the embodiment shown in FIG. 17A, pixel 810 includes a storage element 1702, an exclusive or (XOR) gate 1704, and a pixel electrode 1706. Storage element 1702 is a static random access memory (SRAM) latch. A control terminal of storage element 1702 is coupled to a word line 846(*r*) associated with the row 814(*r*) in which pixel 810 is located, and a data input terminal of storage element 1702 is coupled to display data line 844(*c*) associated with the column 812(*c*) in which pixel 810 is located. An output of storage element 1702 is coupled to one input of XOR gate 1704. The other input of XOR gate 1704 is coupled to global data invert input 824 via a global data invert line 1708. A write signal on word line 846(*r*) causes the value of an update signal (e.g., a digital ON or OFF voltage) asserted on data line 844(*c*) from row logic 806 to be latched into storage element 1702.

Depending on the signals asserted on the inputs of XOR gate 1704 by storage element 1702 and global data invert line 1708 (via global data invert input 824), XOR gate is operative to assert either a HIGH or a LOW driving voltage onto pixel electrode 1706. For example, if the signal asserted on data invert line 1708 is a digital HIGH, then voltage inverter 1704 asserts the inverted value of the voltage output by storage element 1702 onto pixel electrode 1706. On the other hand, if the signal asserted on data invert line 1708 is a digital LOW, then voltage inverter 1704 asserts the value of the voltage output by storage element 1702 onto pixel electrode 1706. Thus, either the data bit latched in storage element 1702 will be asserted on pixel electrode 1706 (normal state) or the inverse of the latched bit will be asserted on pixel electrode 1706 (inverted stated), depending on the signal asserted on global data invert line 1708 via global data invert input 824.

Figure 17B:
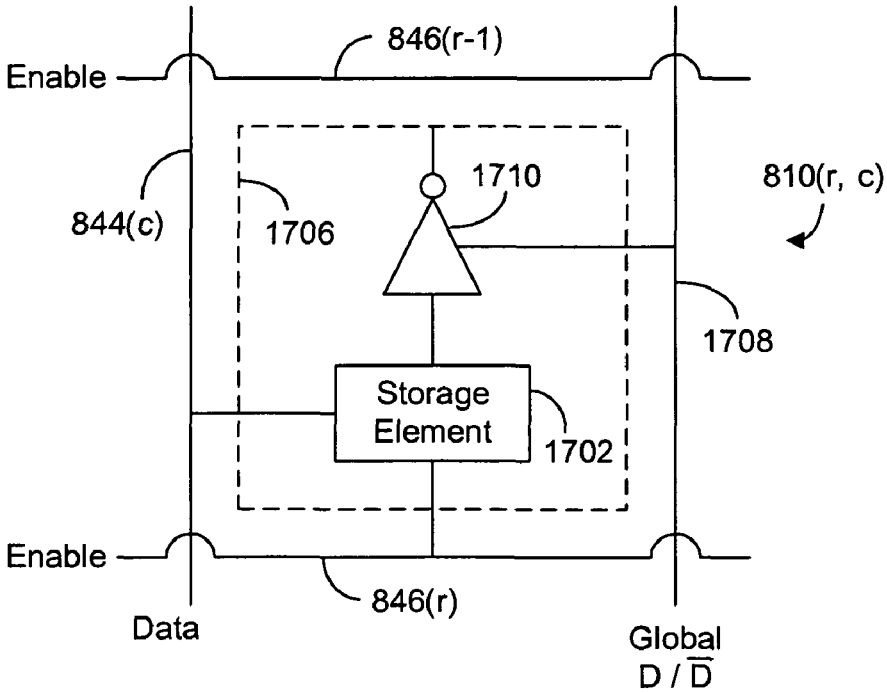
FIG. 17B is a block diagram of a pixel cell according to another embodiment of the present invention.

FIG. 17B shows an alternate embodiment of pixel 8101(*r, c*) according to the present invention. In the alternate embodiment, pixel 810(*r, c*) is the same as the embodiment shown in FIG. 17A, except that XOR gate 1704 is replaced with a controlled voltage inverter 1710. Voltage inverter 1710 receives the voltage output by storage element 1702 on its input terminal, has a control terminal coupled to global data invert line 1708, and asserts its output onto pixel electrode 1706. Controlled inverter 1710 provides the same output responsive to the same inputs as XOR gate 1704 of FIG. 17A. Indeed, any equivalent logic may be substituted for XOR gate 1704 or inverter 1710.

Note that pixel cells 810 are advantageously single latch cells. In addition, because the voltages applied to pixel electrodes 1706 can be inverted simply by switching the output of voltage inverter 1704 or 1710, display 808 can be easily debiased without rewriting data to pixels 810, thereby decreasing the required bandwidth as compared to the prior art.

In the embodiments shown in FIGS. 17A and 17B, pixels 810 are reflective. Accordingly, pixel electrodes 1806 are reflective pixel mirrors. However, it should be noted that the present invention can be used with other light modulating devices including, but not limited to, transmissive displays and deformable mirror devices (DMDs).

Figure 18:
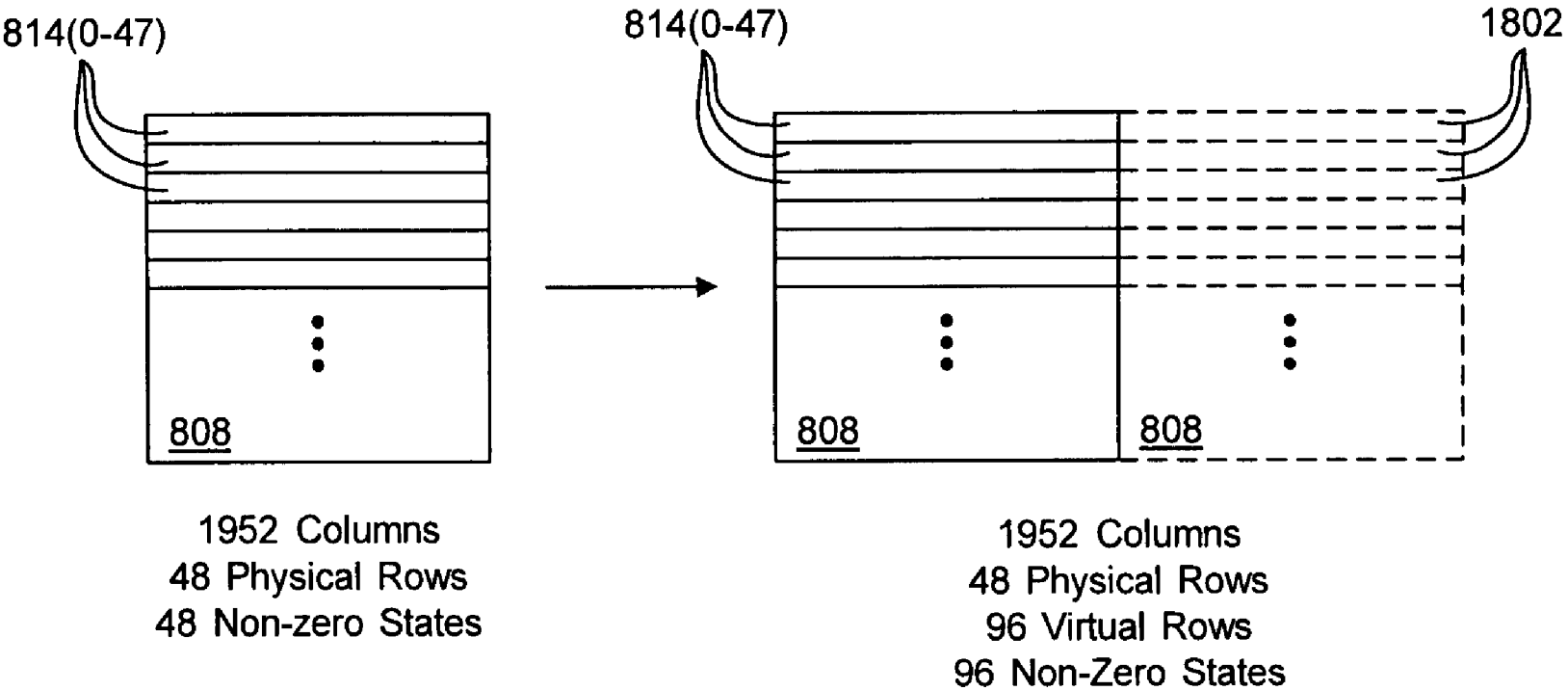
FIG. 18 shows a method for conceptually increasing the number of intensity values that a pixel of FIG. 8 can display according to the present invention.

FIG. 18 graphically shows a method for increasing the number of displayable intensity values for imager 504(*r, g, b*) according to the present invention. By conceptually placing two displays 808 side by side, the number of physical rows 814 of pixels 810 remains the same, but additional virtual rows 1802 are created, thereby allowing more intensity values to be defined and the advantages of the present invention to be maintained. Imager 504A shows two displays 808 conceptually placed side-by-side, thereby creating ninety-six virtual rows 1802. In other words, FIG. 18 shows the case where n=2.

Increasing the value of n increases the number of non-zero intensity values (e.g., grayscales) that that each pixel 810 in display 808 can produce. Recall that each pixel 810 can produce (nr+1) intensity values (including zero), where n is an integer greater than zero. In the previous embodiment, timer 702 generated forty-eight time values because n equaled one and r equaled forty-eight. However, in the present embodiment, timer 702 generates ninety-six (96) time values because n equals two and r equals forty-eight. In other words, by setting n equal to two, each pixel 810 can display twice as many non-zero intensity values as there are physical rows 814 in display 808.

Figure 19:
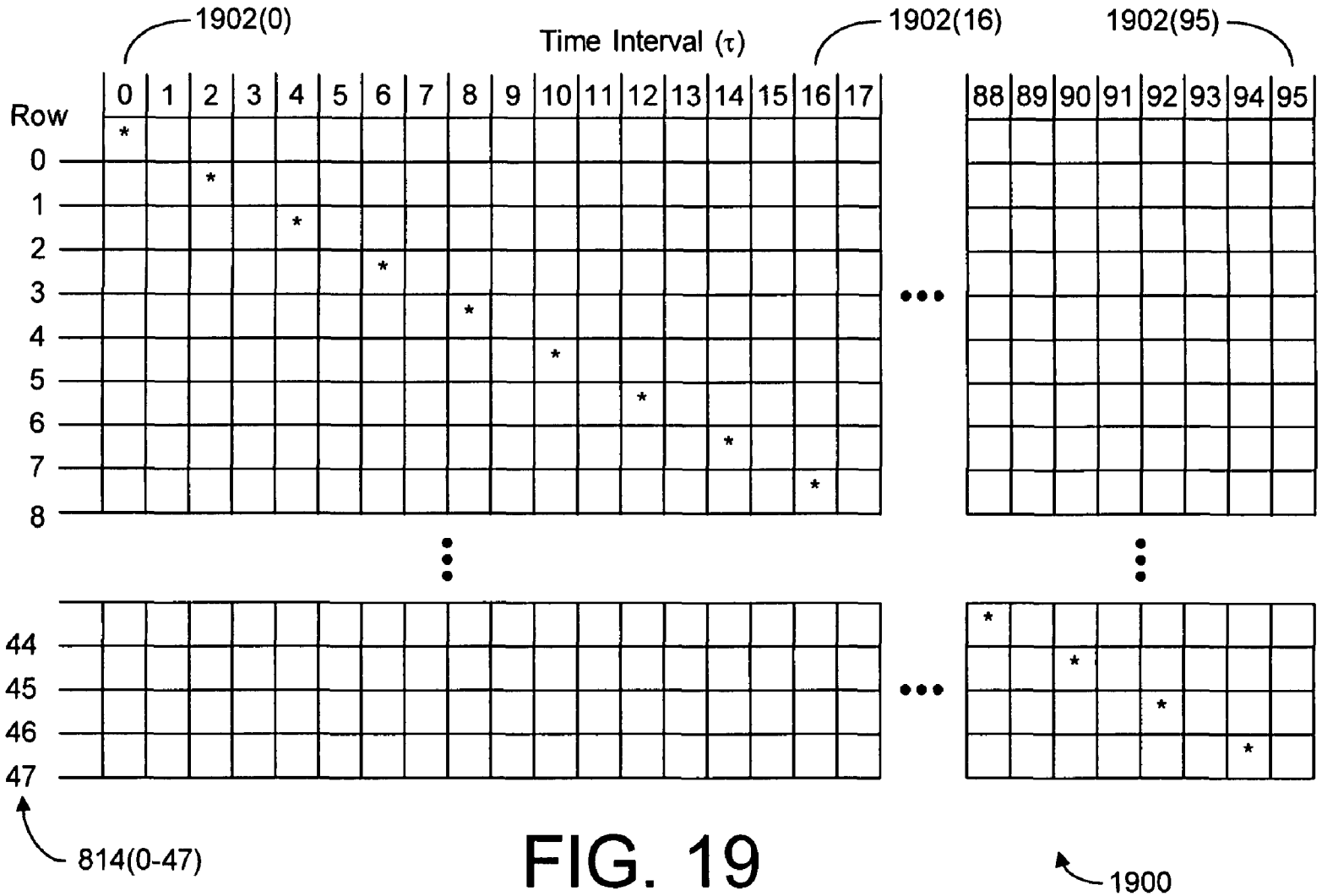
FIG. 19 is a timing chart showing a modulation scheme according to another embodiment of the present invention.

FIG. 19 is a timing chart 1900 showing a modulation scheme for modulating display 808 for n equals two. Timing chart 1900 shows the modulation period of each physical row 814(0-47) in display 808 divided into 96 time intervals 1902 (0-95). The modulation period of each row 814(0-47) is a time period that is divided into n*r coequal time intervals 1902(0-95), where r equals the number of physical rows 814(0-47) in display 808. In the present embodiment, timer 702 generates 95 time values, each corresponding to one time interval 1902 (0-95).

Electrical signals corresponding to particular grayscale values are written to the pixels in each physical row 814(0-47) by row logic 806 within the row's respective modulation period. Because the number of rows 814(0-47) is only half of the number of time intervals 1902(0-95), the modulation periods of rows 814(0-47) begin during every other one of time intervals 1902(0-47) and ends after the lapse of 96 time intervals 1902 from the start of the respective modulation period. For example, row 814(0) has a modulation period that begins at the beginning of time interval 1902(0) and end after the lapse of time interval 19002(95). Similarly, row 814(1) has a modulation period that begins at the beginning of time interval 1902(2) and ends after the lapse of time interval 1902(1). Like in FIG. 10, the beginning of each row 814's modulation period is indicated in FIG. 19 by an asterisk (*).

Like the previous embodiment, each row 814's modulation period is temporally offset by n time intervals 1902 from the previous row's modulation period. For example, the modulation period of row 814(1) is temporally offset with respect to the modulation period of row 814(0) by two time intervals 1902. Thus, rows 814(0-47) are still driven asynchronously. In addition, as previously suggested, data can be written to pixels 810 more than once per frame by defining a frame time to include multiple modulation periods to improve the quality of the displayed image.

FIG. 20 is a table 2000 showing an alternate bit code for a data word 602A and an update schedule for display 808 based on data word 602A. In the present embodiment (i.e., n=2), data word 602A includes four binary-coded bits 604A and eight thermometer-coded bits 606A. Binary-coded bits 604A and thermometer-coded bits 606A are represented as bits B0-B3 and B4-B11, respectively, in a first column 2002. Each bit in column 2002 has a corresponding weight, which is given in second column 2004 in each bit's respective row. Again, the weight of each bit corresponds to its weight in time intervals 1902(0-95).

Like data word 602, the sum of the weighted values of bit code in data word 602A meets the constraints of the first aspect of the present invention. In particular, the sum of the weights in column 2004 add up to an integer multiple of the number of rows 814. Here, the sum of the weights in column 2004 equal ninety-six, which is two times the number of physical rows. In addition, the number of bits in the bit code in column 2004 is evenly divisible by n. In particular, there are twelve bits in the code in column 2004, which when divided by two (n=2), yields six. Therefore, the bit code of data word 602A shown in column 2004 facilitates updating the same number of rows 814 in display 808 during each time interval 1902.

The bit code of data word 602A also meets the constraints of the second aspect of the present invention. In particular, the number of bits in data word 602A (i.e., twelve bits) is evenly must be evenly divisible by 2n (i.e., four). In addition, the sum of the weighted values of the bits in compound data word 602A in column 2004 must be evenly divisible by 2n. Here, the quotient of 96 and 4 is 24. Finally, as described in more detail below, the bit code in column 2004 produces row schedules for each time interval 1902 wherein an equal number of even-numbered rows and odd-numbered rows 814 are updated during each time interval 1902. If the bit code of data word 602A meets these limitations, then both iterations of pixel control circuitry in an imager 504 will operate at 100% efficiency during each time interval 1902 because each will perform the same number of row updates.

A third column 2006 in table 2000 indicates the update time intervals 1902 during which particular bits are written the pixels 810 in each row 814 during that row's adjusted modulation period. Recall that an adjusted modulation period assumes that the row 814's modulation period begins at time interval 1902(0) and ends after time interval 1902(95). For example, B0 is written to a pixel 810 in row 814 during time interval 1902(0) (i.e., the first time interval) during that row's adjusted modulation period. Similarly, bits B1, B2, B3, B4, B5, B6, B7, B8, B9, B10, and B11 are written to the pixel 810 in time intervals 1902(1), 1902(3), 1902(7), 1902(15), 1902(26), 1902(36), 1902(45), 1902(54), 1902(64), 1902(74), and 1902(85), respectively.

In general, a particular bit in column 2002 will be written to pixel 810 in a particular row 814 during a time interval 1902 (*x*) in that row's modulation period, where x is equal to the sum of the weights of the bits previously written to pixel 810. For example, bits B3 are written to a row of pixels 810 in time interval 1902(7) of that row 814's modulation period. Note that the sum of the weights of B0-B2 is equal to seven (i.e., 1+2+4=7). Similarly, bits B7 are written to a row of pixels 810 in time interval 1902(45), and the sum of the weights of bits B0-B6 is equal to 45 (i.e. 1+2+4+8+11+10+9=45).

A generic row schedule, from which other generic row schedules can be generated, is shown in a fourth column 2008 and is determined based on the update time intervals 1902 calculated in column 2006. The generic row schedule shown in column 2008 is calculated according to the following formula:

$$\text{Row} = \text{INT}\left(\frac{(nr) - \text{T_Event}}{n}\right),$$

where n is a non-zero integer, r is the number of physical rows 814 in display 808, T_Event represents an update time interval given in column 2006, and INT is the integer function. In the present embodiment, n equals two (2), such that the above equation can be simplified to the following:

$$\text{Row} = \text{INT}\left(\frac{96 - \text{T_Event}}{2}\right).$$

Recall that there are twice as many time intervals 1902(0-95) than there are physical rows 814(0-47). Therefore, the generic row schedule in column 2008 has to be divided in to n remainder groups, and the row schedule associated with each remainder group can then be used to generate a row schedule for each time interval 1902. This requirement also ensures that an equal number of rows 814 are updated during each time interval 1902. Accordingly, the row schedule in column 2008 is divided into n remainder groups according to the following formula:

$$\text{Remainder Group} = ((nr) - \text{T_Event})\ \%\ n,$$

where % is the remainder function.

A fifth column 2010 shows the remainder groups and their associated generic row schedules. From these generic row schedules, the row schedule for each time interval 1902(0-95) can be calculated based on a time interval's affiliation with a particular remainder group. As shown in columns 2010 and 2008, the generic row schedule for remainder group zero includes rows 814(0), 814(35), 814(30), 814(21), 814(16), and 814(11). The generic row schedule for remainder group one includes rows 814(47), 814(46), 814(44), 814(40), 814(25), and 814(5).

At this point, it is known that the bit code of data word 602A meets the constraints for both aspects of the present invention described above. In particular, each remainder group in column 2010 has an equal number of rows (i.e., six) assigned to it from the generic row schedule in column 2008. Therefore, six rows 814 will be updated during each time interval 1902(0-95). The bit code of data word 602A also produces generic row schedules that are even and odd balanced. Note from columns 2008 and 2010 that an equal number of even- and odd-numbered rows are assigned to each remainder group 0 and 1. This ensures that, if a display 808 is driven with two iterations of pixel control circuitry (one for odd-numbered and one for even-numbered rows), each pixel control circuitry will operate at 100% efficiency (i.e., update the same number of rows) during each time interval 1902(0-95).

FIG. 21A is a table 2102 showing the row schedule for time interval 1902(0) (i.e., Tau=0). A first column 2104 contains the generic row schedule for remainder group zero which includes the rows in column 2008 in FIG. 20 that are associated with a remainder of zero in column 2010. In other words, time interval 1902(0) is associated with the generic remainder group zero. A second column 2106 in FIG. 21 contains the generic row schedule in column 2104 with an adjustment counter value added to it. The adjusted row schedule in column 2106 indicates the rows 814 in display 808 that are updated during time interval 1902(0). A third column 2108 indicates the bit that is written to each pixel in the rows 814 that are updated in column 2106 during time interval 1902(0). In summary, during time interval 1902(0), B0 bits are written to each pixel in row 814(0), B5 bits are written to each pixel in row 814(35), B6 bits are written to each pixel in row 814(30), B8 bits are written to each pixel in row 814(21), B9 bits are written to each pixel in row 814(16), and B10 bits are written to each pixel in row 814(11). The rows do not necessarily have to be updated in any particular order.

The counter value is added to the generic row schedule for remainder group zero in column 2104 to adjust the row schedule for a particular physical row 814's modulation period. The counter value is constrained by the number of physical rows 814, so in the present embodiment the counter steps through values between zero (0) and forty-seven (47). In addition, the counter steps through each count value n times. Accordingly, where n=2, the counter outputs values ranging from 0 to 47 in the following pattern: 0, 1, 1, 2, 2, 3, 3, 4, 4, 5, . . . , 46, 46, 47, 47, 0. Note that the counter begins and ends at the same value.

FIG. 21B is a table 2110 showing the row schedule for time interval 1902(1) (i.e., Tau=1). A first column 2112 contains the generic row schedule for remainder group 1 because time interval 1902(1) is associated with remainder group one. A second column 2114 contains the row schedule in column 2112 with the counter value added to it. Note that in FIG. 21B the counter is incremented to a value of one. The adjusted row schedule in column 2114 indicates the rows 814 in display 808 that are updated during time interval 1902(1). Finally, a third column 2116 indicates the bits that are transferred to the pixels in the associated physical rows 814 shown in column 2114 during time interval 1902(1). In particular, during time interval 1902(1), row logic 806 writes bit B1 to each pixel in row 814(0), bit B2 to each pixel in row 814(47), bit B3 to each pixel in row 814(45), bit B4 to each pixel in row 814(41), bit B7 to each pixel in row 814(26), and bit B11 to each pixel in row 814(6).

FIG. 21C is a table 2118 showing the row schedule for time interval 1902(2) (i.e., Tau=2). First column 2120 contains the generic row schedule for remainder group 0 because time interval 1902(2) is associated with remainder group zero. The counter value still equals one, and second column 2122 contains the adjusted row schedule in column 2120 with the counter value added to it. The adjusted row schedule in column 2122 indicates the rows 814 in display 808 that are updated during time interval 1902(2). Finally, column 2124 indicates the bits that are transferred to the pixels in the associated physical rows 814 shown in column 2122 during time interval 1902(2). In particular, during time interval 1902(2), row logic 806 writes bit B0 to each pixel in row 814(1), bit B5 to each pixel in row 814(36), bit B6 to each pixel in row 814(31), bit B8 to each pixel in row 814(22), bit B9 to each pixel in row 814(17), and bit B10 to each pixel in row 814(12).

FIG. 21D is a table 2126 showing the row schedule for time interval 1902(3) (i.e., Tau=3). First column 2128 contains the generic row schedule for remainder group 1 because time interval 1902(3) is associated with remainder group one. The counter value has been incremented to a value of two, and second column 2130 contains the row schedule in column 2128 with the counter value added to it. The adjusted row schedule in column 2130 indicates the rows 814 in display 808 that are updated during time interval 1902(3). Finally, column 2132 indicates the bits that are transferred to the pixels in the associated physical rows 814 shown in column 2130 during time interval 1902(3). In particular, during time interval 1902(3), row logic 806 writes bit B1 to each pixel in row 814(1), bit B2 to each pixel in row 814(0), bit B3 to each pixel in row 814(46), bit B4 to each pixel in row 814(42), bit B7 to each pixel in row 814(27), and bit B11 to each pixel in row 814(7).

Based on FIGS. 21A-21D, particular time intervals 1902 are associated with one of n remainder groups. In the present embodiment, the even time intervals 1902(even) are associated with remainder group zero. Similarly, the odd time intervals 1902(odd) are associated with remainder group one.

Note again that (b/n) rows 814 are updated during each time interval 1902. In the present embodiment, b (the number of bits in data word 602A) equals 12, and n equals 2 such that six rows 814 are updated during each time interval 1902. In addition, row logic 806 updates an equal number (i.e., three) of even and odd rows during each time interval 1902. Thus, data transfer from the display system to the imager(s) is 100% efficient during each time interval. In addition, if the imager includes two iterations of pixel control circuitry (one for even-numbered and one for odd-numbered rows), then each pixel control circuitry can also operate at 100% efficiency during each time interval.

FIG. 22 is a chart 2200 combining the modulation scheme of FIG. 19, the update schedule of FIG. 20, and the row schedules of FIGS. 21A-21D. Due to the size of the chart, certain portions are omitted.

Chart 2200 indicates when particular bits of data word 602A are written to a particular row 814 of pixels during that pixel's modulation period (i.e., by reading across a row in chart 2200). For example, row logic 806 writes bit B0 to row 814(0) during time interval 1902(0), bit B1 during time interval 1902(1), bit B2 during time interval 1902(3), bit B3 during time interval 1902(7), bit B4 during time interval 1902(15) and so on. Note, with reference to FIGS. 21A-21 D, that the row schedule for even-numbered time intervals 1902 is calculated from the generic row schedule associated with remainder group zero. Conversely, the row schedule for odd numbered time intervals 1902 is calculated from the generic row schedule associated with remainder group one. Because an equal number of bits are associated with each of the n remainder groups, each row 814 will be updated during an equal number of even time intervals 1902 and odd time intervals 1902 during that row's modulation period. In summary, column 2006 in FIG. 20 indicates the update time intervals 1902 that the bits in column 2002 are written to a row 814 in that row's adjusted modulation period.

In general, the row schedule for each time interval 1902 is calculated from the generic row schedule associated with one of the n remainder groups (such as the remainder groups in column 2010). Accordingly, each time interval 1902 is associated with one of the n remainder groups. In the embodiment shown in FIG. 22, the even time intervals 1902(even) are associated with remainder group zero because their particular row schedules are determined from the generic row schedule associated with remainder group zero. Similarly, the odd time intervals 1902(odd) are associated with remainder group one because their particular row schedules are determined from the generic row schedule associated with remainder group one.

Furthermore, as noted above, because an equal number of bits in data word 602A are associated with each of the n remainder groups, each row 814 will be updated during an equal number of time intervals 1902 that are associated with each of the n remainder groups in that row's modulation period. In particular, each row 814 will be updated during (b/n) time intervals 1902 that are associated with each remainder group in the row's modulation period, where b represents the number of bits in data word 602A. In addition, because each row 814's modulation period consists of the same number of time intervals 1902, each row 814 will be updated during an equal number of time intervals 1902 associated with each remainder group regardless of the modulation period's temporal offset from row 814(0)'s modulation period.

Note again that row logic 806 updates the remaining rows 814(1-47) in the same time intervals 1902(0-47) as row 814 (0) when the time intervals 1902(0-47) are adjusted for a particular row's modulation period. For example, row 814(1) has a modulation period that is offset by two time intervals 1902 from row 814(0)'s modulation period. Accordingly, adding two to each update time interval 1902 associated with row 814(0) yields row 814(1)'s modulation period. In particular, row logic 806 writes B0 to row 814(1) during time interval 1902(2), B1 to row 814(1) during time interval 1902 (3), B2 to row 814(1) during time interval 1902(5), B3 to row 814(1) during time interval 1902(79), B4 to row 814(1) during time interval 1902(17), etc. In other words, rows 814(0-47) are updated at different times when viewed with respect to one particular row's (i.e., row 814(0)) modulation period, however each row 814(0-47) is updated according to the same algorithm. The algorithm just starts at a different time for each row 814(0-47).

Row logic 806 and row decoder 816 update each row 814(0-47) a predetermined number of times during the row's respective modulation period. In particular, row logic 806 and row decoder 816 will update a row 814 twelve times because compound data word 602A contains twelve bits. Like in the previous embodiment, based on the adjusted time value, each logic unit 902(0-1951) in row logic 806 selects the appropriate bit of data word 602A to assert on each pixel 810 during the particular time interval 1902 via a respective one of data lines 844(0-1951).

Chart 2200 also indicates the rows 814(0-47) that row logic 806 updates in any one given time interval 1902(0-95) and the bit plane transferred to each row during the particular time interval 1902. In other words, chart 2200 graphically represents the row schedules calculated in FIGS. 21A-21D. For example, in time interval 1902(1), row logic 806 updates rows 814(0), 814(47), 814(45), 814(41), 814(26), and 814(6) (rows 814(41) and 814(26) not shown).

In addition to row logic 806, the other components of display driver 502 are modified to conform to the current embodiment of the present invention. For example, time adjuster 708 decrements time values according to the present modulation scheme and outputs only twelve different adjusted time values, which are equal to the update time intervals in column 2006.

Additionally, in the present embodiment, circular memory buffer 804 would include twelve memory sections, one for each of bits B0-B11. Based on the values of column 2006, each bit of a data word 602A can be discarded after the lapse of the following time intervals 1902:

| Bit | Time Interval |
|---|---|
| B0 | 0 |
| B1 | 1 |
| B2 | 3 |
| B3 | 7 |
| B4 | 15 |
| B5 | 26 |
| B6 | 36 |
| B7 | 45 |
| B8 | 54 |
| B9 | 64 |
| B10 | 74 |
| B11 | 85 |

Accordingly, for each column 812 in display 808, at least the following amounts of memory in circular memory buffer 804 are needed:

| Bit | Memory Size (bits/column) |
|---|---|
| B0 | 1 |
| B1 | 2 |
| B2 | 4 |
| B3 | 8 |
| B4 | 16 |
| B5 | 27 |
| B6 | 37 |
| B7 | 46 |
| B8 | 55 |
| B9 | 65 |
| B10 | 75 |
| B11 | 86 |

Therefore, according to the present embodiment, circular memory buffer 804 contains 823.7 kilobits of memory. In contrast, if circular memory buffer 804 was a prior-art frame buffer that stored 12 bits of video data for each pixel for the entire frame, it would contain 1.124 megabits of data. Like before, the above values assume that one row 814 of video data is written to circular memory buffer 804 during each time interval. Because there are more memory sections in circular memory buffer 804, address converter 818 is also modified to generate memory addresses for the twelve memory sections based on the same algorithms described previously. The number of address lines in address input 842 is increased accordingly.

Figure 23:
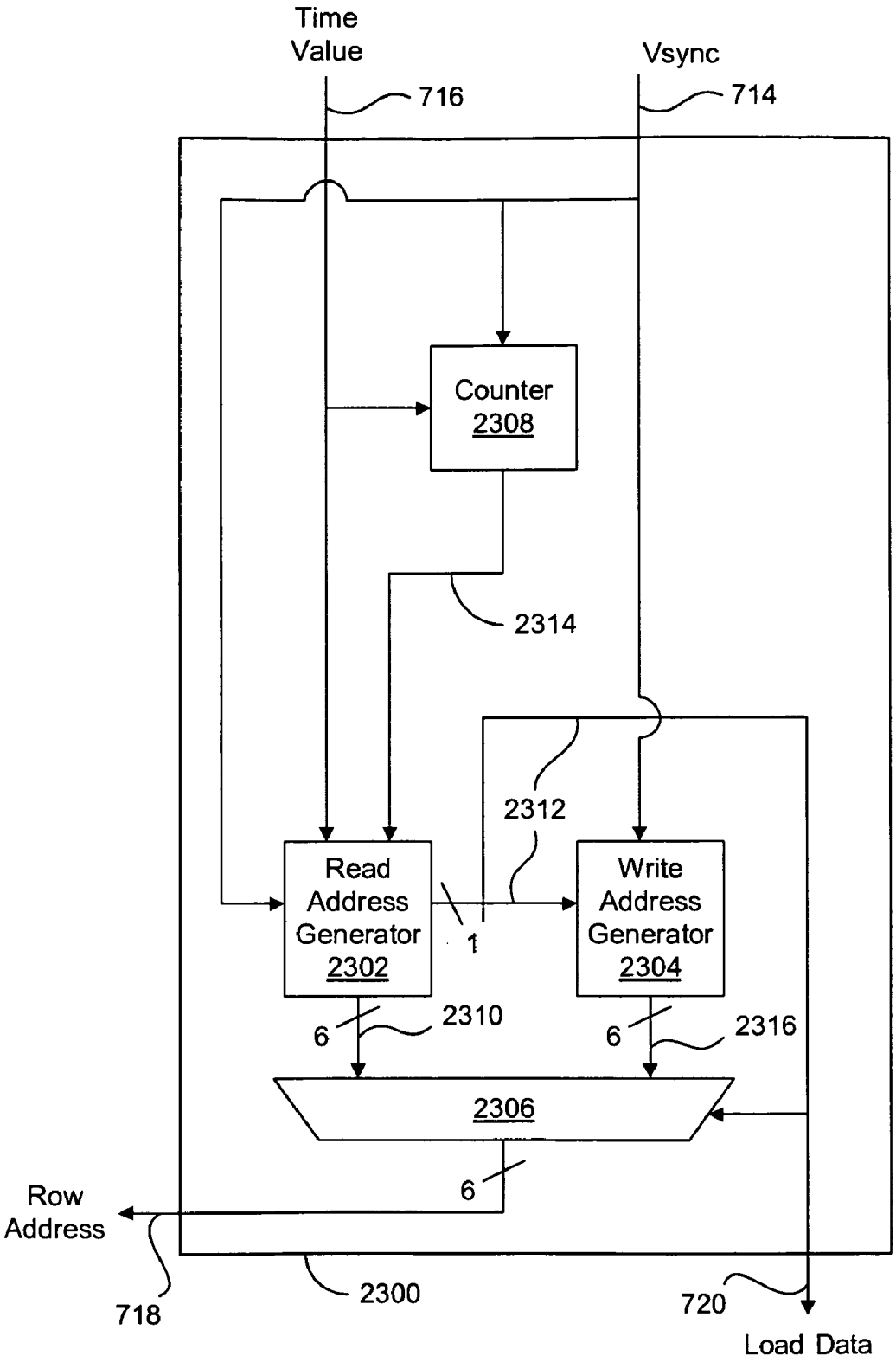
FIG. 23 is a block diagram showing an alternate embodiment of the address generator of FIG. 7 in greater detail.

FIG. 23 is a block diagram showing an address generator 2300 that would replace address generator 704 if imagers 504(*r, g, b*) were driven according to the modulation scheme shown in FIG. 19. Address generator 2300 includes a read address generator 2302, a write address generator 2304, a multiplexer 2306, and a counter 2308.

Read address generator 2302 receives 6-bit time values from timer 702 via timing input 716, Vsync signals via synchronization input 714, and counter values from counter 2308. Based on the time value and counter value, read address generator 2302 sequentially outputs row addresses onto 6-bit read address lines 2310 that are updated during the time interval 1902. While read address generator 2302 is outputting read row addresses onto lines 2310, read address generator 2302 also asserts a LOW write enable signal on a write enable line 2312. A LOW write enable signal disables write address generator 2304, and instructs multiplexer 2306 to couple read address lines 2310 with address output bus 718, such that "read" row addresses are delivered to time adjuster 708 and to imagers 504(*r, g, b*). A LOW write enable signal affects time adjuster 708, circular memory buffer 804, and row decoder 816 as described in previous embodiments.

Counter 2308 receives time values from timing input 716 and Vsync signals via synchronization input 714, generates a count sequence based on the time values received, and outputs the count sequence on 6-bit count lines 2314. In the present embodiment, counter 2308 generates a count sequence from 0 to r, counting through each value n times. As described in FIGS. 21A-21D, counter 2308 generates the following sequence 0, 1, 1, 2, 2, 3, 3, 4, 4, 5, . . . , 6, 46, 47, 47, 0. Counter 2308 generates one count value for each time value it receives via timing input 716, starting with zero. Counter utilizes the Vsync signals received via synchronization input 714 to synchronize itself with other components of address generator 2300 at startup. Note that counter 2308 could also comprise a look-up table that outputs a particular count value for a particular timing value input.

When read address generator 2302 receives a timing value and a count value, read address generator 2302 first determines if the timing value is associated with remainder group zero or remainder group one. Note that in FIGS. 21A-21D, all even-numbered time intervals 1902(0-95) are associated with remainder group 0 and all odd time intervals 1902(0-95) are associated with remainder group one. Once read address generator 2302 determines the remainder group that a time value is associated with, read address generator 2302 generates the row schedule associated with the remainder group. Read address generator 2302 then adds the counter value received via counter lines 2314 to each generated row address and outputs the modified row addresses onto read address lines 2310. Note that when adding count values to row address, read address generator 2302 will not generate a row address for a row greater than row 814(47). Instead, the row address will be looped back to the first row address 814(0).

A short time after read address generator 2302 has generated a final read row address for the particular time interval 1902, read address generator 2302 asserts a HIGH write enable signal on write enable line 2312. In response, write address generator 2304 generates a "write" row address and asserts the write address on write address lines 2316 such that a new row of data can be written into circular memory buffer 804. In addition, when a HIGH write enable signal is asserted on write enable line 2312, multiplexer 2306 is operative to couple write address lines 2316 with address output bus 718, thereby delivering write addresses to time adjuster 708 and imagers 504(*r, g, b*). A HIGH write enable signal (i.e., a HIGH load data signal) also disables time adjuster 708 and row decoder 816, and causes circular memory buffer 804 to load a row of new display data from shift register 802 into memory locations associated with the generated write row addresses.

Write address generator 2304 also receives timing signals indicative of a time interval 1902 via timing input 716, and Vsync signals via synchronization input 714. When the write enable signal is HIGH, write address generator 2304 outputs a row address for a row 814 whose modulation period is beginning in one of the next two time intervals 1902. For example, if the timing signal received via timing input 716 had a value of 0 or 1, corresponding to time intervals 1902(0) or 1902(1), then write address generator 2304 would generate row addresses for the row 814(1). Similarly, if the timing signal had a value of 2 or 3 indicative of time interval 1902(2) or 1902(3), then write address generator 1504 would generate a row address for row 814(2). As another example, if the timing signal had a value of 94 or 95, then write address generator 1504 would generate a row address for row 814(0). Note that because new rows of data are needed only every second time interval 1902 (see FIG. 22), write address generator 2304 does not necessarily need to generate a write address every time interval 1902. Similarly, read address generator 2302 may not assert a HIGH write enable signal on write enable line 2312 every time interval 1902.

Figure 24:
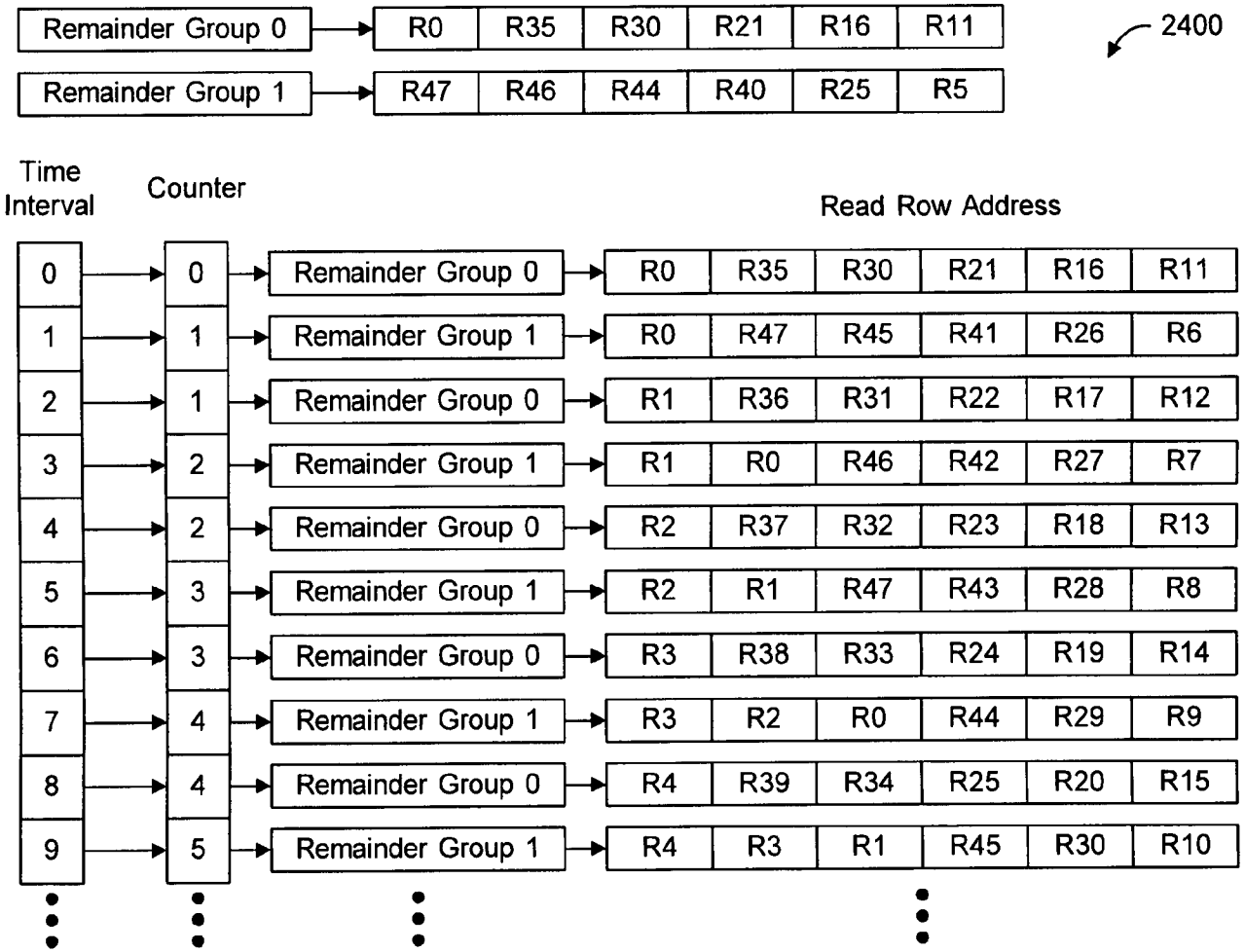
FIG. 24 is a table showing a portion of input and output values of the counter and the read address generator of FIG. 23.

FIG. 24 is a table 2400 showing the row addresses output by read address generator 2302 for the first 10 time intervals 1902(0-9). As shown in FIG. 24, for a particular time value, read address generator 2302 modifies the generic row schedule associated with a particular remainder group with the value received from counter 2308, and outputs six different read row addresses. For example, during time interval 1902 (0), read address generator 2302 receives a count value of 0, adds the count value to the generic row schedule associated with remainder group zero, and outputs the modified read row addresses, which are associated with rows 814(0), 814(35), 814(30), 814(21), 814(16), and 814(11). Similarly, during time interval 1902(7), read address generator 2302 receives a count value of 4 from counter 2308, adds the count value to the generic row schedule associated with remainder group one, and outputs the modified read row addresses, which are associated with rows 814(3), 814(2), 814(0), 814(44), 814 (29), and 814(9).

Figure 25:
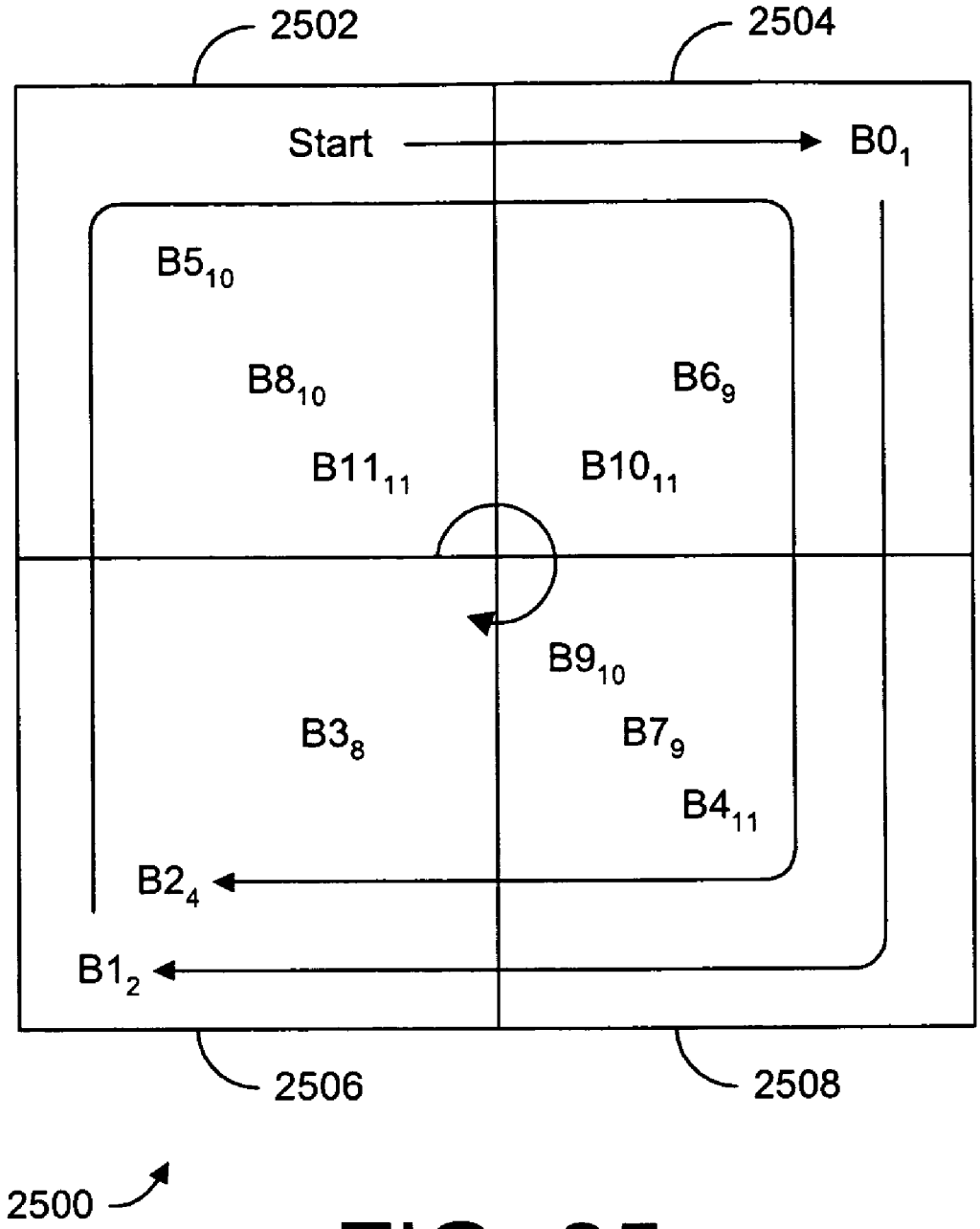
FIG. 25 shows a graphical method for validating a bit code for the modulation scheme of FIG. 19 according to the present invention.

FIG. 25 shows a graphical method for validating a bit code for both aspects of the present invention for compound data words 602A and the modulation scheme shown in FIG. 19. Recall that the bit code of data words 602A is arbitrary, so long as the bit code meets particular constraints. Meeting these requirements becomes somewhat tedious when the number of bits in a bit code is large and when n is greater than one. FIG. 25 can ease the bit-coding process.

FIG. 25 shows a quadrant-based diagram 2500 that includes, in a clock-wise manner, a first quadrant 2502, a second quadrant 2504, a third quadrant 2506, and a fourth quadrant 2506. Note that diagram 2500 includes four quadrants because there are two remainder groups (i.e., zero and one) and each row in the generic row schedule associated with each remainder group is assigned to one of two sets or rows (e.g., even-numbered and odd-numbered) that is associated with one of two pixel control circuitries. Diagram 2500 could include more quadrants if the value of n was greater than two or the number of sets that a particular row could be associated with was greater than two.

Based on FIG. 25, if the bit code in column 2004 (FIG. 20) will produce generic row schedules that each contain the same number of rows in total and an equal number of even- and odd-numbered rows, then each quadrant will contain three data bits (i.e., 12 bits/4 quadrants=3 bits/quadrant). Each bit in data word 602A, starting consecutively with the least significant bit B0 in the first quadrant 2502, "jumps" clockwise through a number of quadrants equal to its weight. Subsequent bits in data word 602A begin jumping in the same quadrant where the previous bit landed. In the end, if each quadrant 2502, 2504, 2506, and 2508 has an equal number of bits from data word 602A, then the bit code is balanced, such that each remainder group defines a row schedule having an equal number of rows, and each remainder group contains an equal number of even- and odd-numbered rows.

Based on the bit code in column 2004, B0 can only jump (clockwise) from first quadrant 2502 to second quadrant 2504 because bit B0 has a weight of one. B0, therefore, lands in second quadrant 2504. Next, bit B1, which has a weight of two, begins jumping clockwise from second quadrant 2504 because that is where bit B0 landed. Bit B1 jumps through third quadrant and into fourth quadrant 2508, where it lands. Next, bit B2, which has a weigh of four time intervals 1902, takes four jumps clockwise starting in fourth quadrant 2508 and lands back in fourth quadrant 2508. This process continues for the remaining bits B3-B11.

Because three bits have landed in each quadrant, it is known that the bit code shown in column 2004 will yields two generic row schedules, each containing an equal number of rows where half of the rows are even-numbered and half or the rows are odd-numbered.

Figure 26:
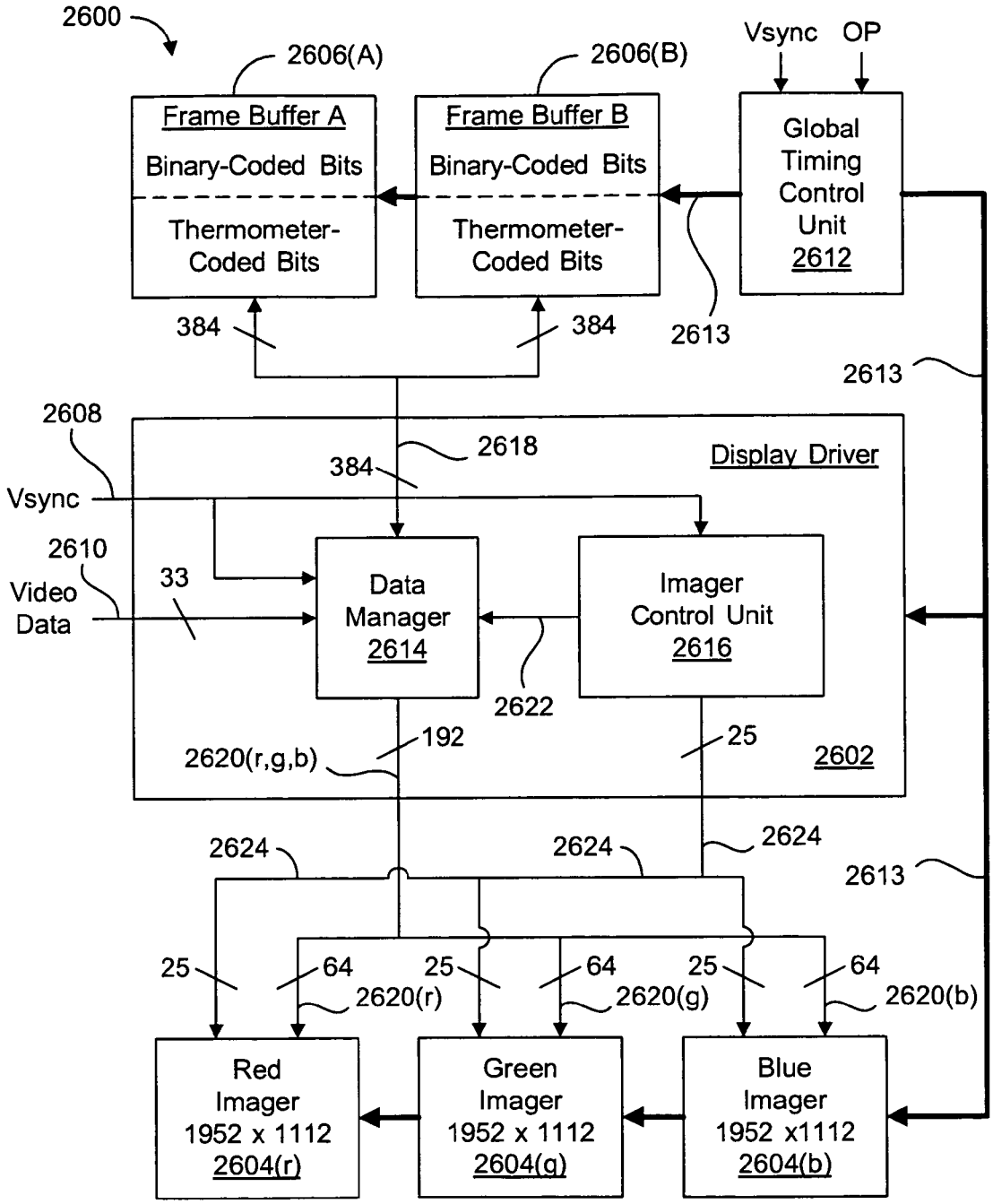
FIG. 26 is a block diagram of a display driving system according to another embodiment of the present invention.

FIG. 26 is a block diagram showing a display system 2600 according to another embodiment of the present invention. Display system 2600 is similar to display system 500 and includes a display driver 2602, a red imager 2604(*r*), a green imager 2604(*g*), a blue imager 2604(*b*), and a pair of frame buffers 2606(A) and 2606(B). Each of imagers 2604(*r, g, b*) contains an array of pixel cells (not shown in FIG. 26) arranged in 1952 columns and 1112 rows for displaying an image. Display driver 2602 receives a plurality of inputs from a system (e.g., a computer system, television receiver, etc., not shown), including a vertical synchronization (Vsync) signal via Vsync input terminal 2608 and video data via a video data input terminal set 2610.

Display system 2600 also includes a global timing control unit 2612 that asserts clock signals and operational instructions on a global control bus 2613 to control and coordinate the operation of display driver 2602, imagers 2604(*r, g*, and *b*) and frame buffers 2606(A and B). Timing control unit 2612 provides the same functions and advantages as timing control unit 512 including spreading unused frame time over the entire frame and between at least some time intervals. Again, bus 2613 communication with all elements of display system 2600 but is only represented generally so as not to unnecessarily obscure the other aspects of the present invention.

Display driver 2602 includes a data manager 2614 and an imager control unit (ICU) 2616, which are both coupled to the various components of display system 2600 like data manager 514 and ICU 516 of display system 500. However, in the present embodiment, data manager 2614 receives 33-bit binary video data (11 bits per color) via video data input terminal set 2610, separates the video data according to color, converts the binary video data into binary-coded and thermometer-coded video data and provides the compound video data to one of frame buffers 2606(A-B) via 384-bit buffer data bus 2618. Buffer data bus 2618 is substantially larger than buffer data bus 518 because data manager 2614 converts the 11-bit binary display data into compound display data having substantially more bits. Data manager 2614 also retrieves video data from one of frame buffers 2606(A-B), and provides each color (i.e., red, green, and blue) of video data to the respective imager 2604(*r, g, b*) via imager data lines 2620(*r, g, b*). Note that imager data lines 2620 (*r, g, b*) each include 64 lines. As will be described later, each pixel is driven with compound data words having 32 bits consisting of both binary- and thermometer-coded bits. Therefore, two pixels worth of data can be transferred at once to each imager 2604(*r, g, b*) via data lines 2620(*r, g, b*). Finally, because of the increased number of rows in imagers ICU 2605(*r, g, b*), ICU 2616 controls imagers 2604(*r, g*, and *b*) via 25 common imager control lines 2624 such that imagers 2604(*r, g*, and *b*) modulate each pixel of their respective displays according to the video data supplied by data manager 2614.

Like prior embodiments, the pixels of imagers 2604(*r, g, b*) are modulated with a reduced number of pulses than in a conventional pulse width modulation scheme. In addition, each row of pixels of imagers 2604(*r, g, b*) are driven asynchronously such that the rows are processed during distinct modulation periods that are temporally offset. Furthermore, each modulation period is divided into a plurality of time intervals such that a constant number of rows are updated during each time interval. These and other advantageous aspects of the present invention will be described in further detail below.

Like FIG. 5, FIG. 26 shows a three-imager display system 2600. However, the present invention also provides its many advantages when used in field-sequential display systems. Therefore, display system 2600 can be modified for field-sequential operation including, but not limited to, similar modifications to those described above in FIG. 5.

Figure 27:
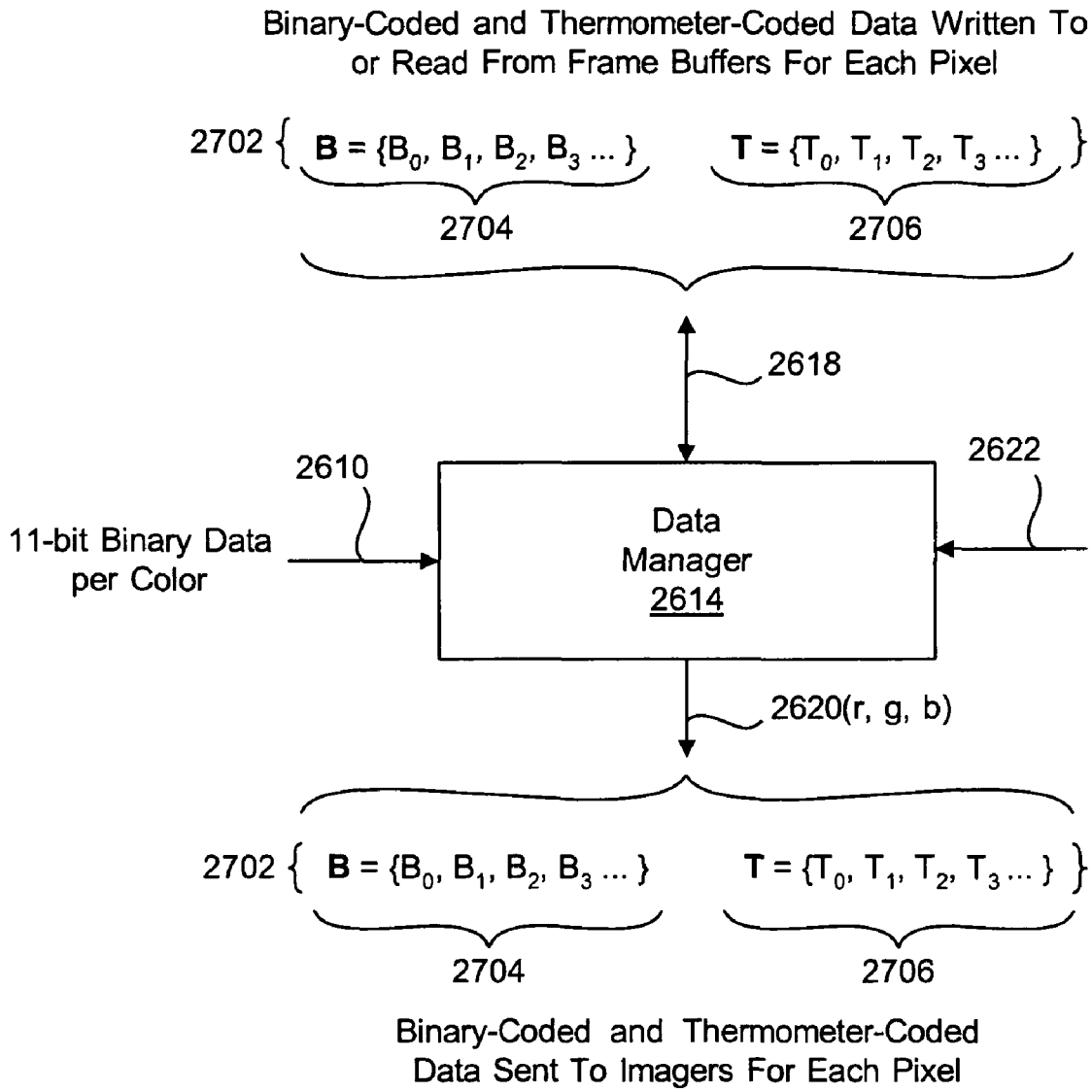
FIG. 27 is a block diagram illustrating the operation of the data manager of FIG. 26.

FIG. 27 is a block diagram illustrating the flow of video data through data manager 2614 and how data manager 2614 converts binary video data into compound video data including binary-coded data and thermometer coded data. For example, 33-bit binary video data (11 bits per color) enters data manager 2614 from video data input terminal set 2610. Data manager 2614 then divides the video data by color into 11-bit binary-weighted data words, converts each 11-bit binary weighted data word into a compound data word 2702 composed of a plurality of binary-weighted bits 2704 and a plurality of thermometer-coded bits 2706, and stores the combination data words 2702 for each pixel in one of frame buffers 2606(A-B) via bus 2618. Again, binary-coded data is denoted with a "B" and thermometer-coded data is denoted with a "T."

According to one aspect of the present invention, data manager 2614 converts 11-bit binary video data for each pixel in each imager 2604(*r, g, b*) into a data word 2702 subject to the following limitations. In particular, data manager 2614 converts each binary-weighted data word into a compound data word 2702 wherein the sum of the weighted values of the binary-coded bits 2704 and the thermometer-coded bits 2706 is equal to an integer multiple (n) of the number of rows of pixels in one of imagers 2604(*r, g, b*). In the present embodiment, n is equal to one again, and the number of rows in each imager 2604(*r, g, b*) is 1112. Therefore, the sum of the weighted values of the bits in each combination data word 2702 should equal 1112. A second requirement for this aspect of the present invention is that the number of bits, b, in the bit code of data word 2702 is evenly divisible by n. Because n equals one in this embodiment, this limitation is met. By setting the number of non-zero intensity values that can be defined by a compound data word 2702 equal to an integer multiple of the number of rows in the imager's display, an equal number of rows in the display can be updated during each time interval. This facilitates 100% data efficiency between the display driver 2602 and each imager 2604(*r, g, b*).

According to a more particular aspect of the present invention, an imager 2604 can include a plurality of pixel control circuitries, each controlling the modulation of a set of rows in the display. To facilitate 100% operating efficiency of each pixel control circuitry in the imager, each pixel control circuitry must update the same number of rows in that single imager during each time interval. To ensure this result, data manager 2614 converts binary data words into compound data words 2702 according to the following additional limitations. First, the number of bits in the bit code of compound data word 2702 must be evenly divisible by (s*n), where s is the number of pixel control circuitries in each imager. Second, the sum of the weighted values of the bits in the bit code of compound data word 2702 must be evenly divisible by (s*n). Finally, an equal number of rows in the display assigned to each of the (s) sets must be updated during each time interval.

Assigning each row of pixels in the display in imagers 2604(*r, g, b*) to one of two sets (i.e., s=2) provides a useful example. Again, the even-numbered rows in a display can be assigned to one set and the odd-numbered rows in the display can be assigned to a second set. According to this example, data manager 2614 converts binary data words into compound data words 2702 having a number of bits evenly divisible by 2n. In addition, the sum of the weighted values of the bits in each data word 2702 is evenly divisible by 2n. Finally, the bit code of data words 2702 must produce row update schedules for each time interval wherein an equal number of even- and odd-numbered rows are updated during each time interval.

As before, the number of bits and weighted values of each bit in combination data word 2702 are completely arbitrary so long as the above limitations are satisfied.

When data manager 2614 receives 11 bits of binary video data for a particular pixel, data manager determines what intensity value the data represents, and then converts the 11-bit data word into a compound data word 2702 corresponding to the same grayscale value. Each of the binary-coded bits 2704 and thermometer-coded bits 2706 in a data word 2702 are assigned a digital ON of OFF value such that the electrical signal written to a particular pixel will experience a number of signal transitions (i.e., pulses) that is less than or equal to the amount of signal transitions experienced in conventional pulse-width modulation such as described in FIGS. 14A-B, but for 1113 intensity values rather than 49.

Data manager 2614 also retrieves data from frame buffers 2606(A-B) and provides that data to imagers 2604(*r, g, b*) via imager data lines 2620(*r, g, b*) where the data is temporarily stored. Data manager 2614 provides the data words 2702 for each pixel to imagers 2604(*r, g, b*) before they are needed to drive electrical signals on the particular pixels in imagers 2604(*r, g, b*).

Figure 28:
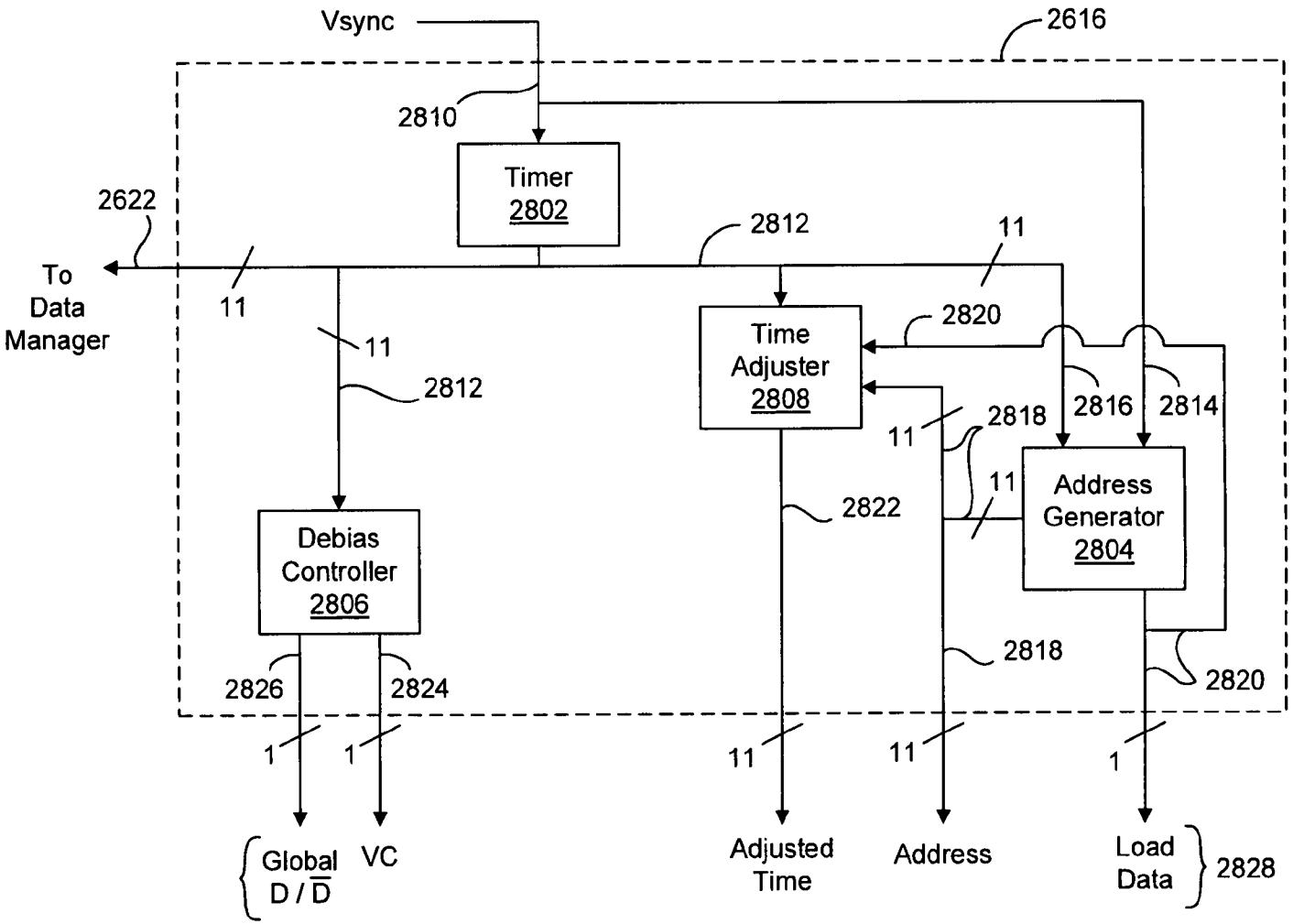
FIG. 28 is a block diagram showing the imager control unit of FIG. 26 in greater detail.

FIG. 28 is a block diagram showing imager control unit 2616 in greater detail. Imager control unit 2616 includes a timer 2802, an address generator 2804, a debias controller 2806, and a time adjuster 2808. Timer 2802, address generator 2804, debias controller 2806 and time adjuster 2808 perform generally the same functions as timer 702, address generator 704, debias controller 706, and time adjuster 708, respectively, shown and described in FIG. 7, except that they are modified to drive an imager having 1112 rows of pixels instead of only 48 rows of pixels.

For instance, timer 2802 coordinates the operations of the various components of imager control unit 2616 by generating a sequence of n*r time values, where n is an integer greater than zero and r equals the number of rows of pixels in imagers 2604(*r, g, b*). In the present embodiment, timer 2802 outputs consecutive time values from 0 to 1111 because n is equal to 1 and r is equal to 1112. Once timer 2802 reaches a value of 1111, timer 2802 loops back such that the next timing signal output has a value of 0. Timer 2802 asserts each time value on 11-bit time value output bus 2812, which provides the timing signals to coordination line 2622, address generator 2804, debias controller 2806, and time adjuster 2808.

Like address generator 704, responsive to timing signals on timing input 2816, address generator 2804 provides row addresses to each of imagers 2604(*r, g, b*) and to time adjuster 2808 via an 11-bit address output bus 2818. In the present embodiment, address generator 2804 generates 11-bit row addresses and asserts each bit of the generated row addresses on a respective line of address output bus 2818. Furthermore, depending on whether the row address generated by address generator 2804 is a "read" address (e.g., to read data from display memory) or a "write" address (e.g., to write data to display memory), address generator 2804 will assert a load data signal on load data output 2820. In the present embodiment, a digital LOW value asserted on load data output 2820 indicates that address generator 2804 is asserting a read address while a digital HIGH value indicates a write address.

Time adjuster 2808 adjusts the time value output by timer 2802 depending on the row address asserted on address output bus 2818. Time adjuster 2808 receives 11-bit time values from bus 2812, load data signals from load data output 2820, and 11-bit row addresses from address output bus 2818. Responsive to the signal asserted on load data output 2820 and the row address asserted on address output bus 2818, time adjuster 2808 adjusts the time values asserted on time value output bus 2812 and asserts the adjusted time value on adjusted timing output bus 2822. Again, time adjuster 2808 adjusts time values asserted on bus 2812 only for read row addresses (i.e., when the load data signal on output 2820 is LOW).

Debias controller 2806 controls the debiasing process of each of imagers 504(*r, g, b*) in order to prevent deterioration of the liquid crystal material therein. Debias controller 2806 is coupled to time value output bus 2812 and includes a common voltage output 2824 and a global data invert output 2826. Debias controller 2806 receives timing signals from timer 2802 via bus 2812, and depending on the value of the timing signal, asserts one of a plurality of predetermined voltages on common voltage output 2824 and a HIGH or LOW global data invert signal on global data invert output 2826. The voltage asserted by debias controller 2806 on common voltage output 2824 is asserted on the common electrode (e.g., an Indium-Tin Oxide (ITO) layer) of the pixel array of each of imagers 2604(*r, g, b*). In addition, the global data invert signals asserted on global data invert output 2826 determine whether data asserted on each of the electrodes of the pixel cells of imagers 2604(*r, g, b*) is asserted in a normal or inverted state.

Finally, the 25 imager control lines 2828 convey the outputs of the various elements of imager control unit 2616 to each of imagers 2604(*r, g, b*). In particular, imager control lines 2828 include address output bus 2818 (11 lines), load data output 2820 (1 line), adjusted timing output bus 2822 (11 lines), common voltage output 2824 (1 line), and global data invert output 2826 (1 line). Each of imagers 2604(*r, g, b*) receive the same signals from imager control unit 2616 such that imagers 2604(*r, g, b*) remain synchronized.

Figure 29:
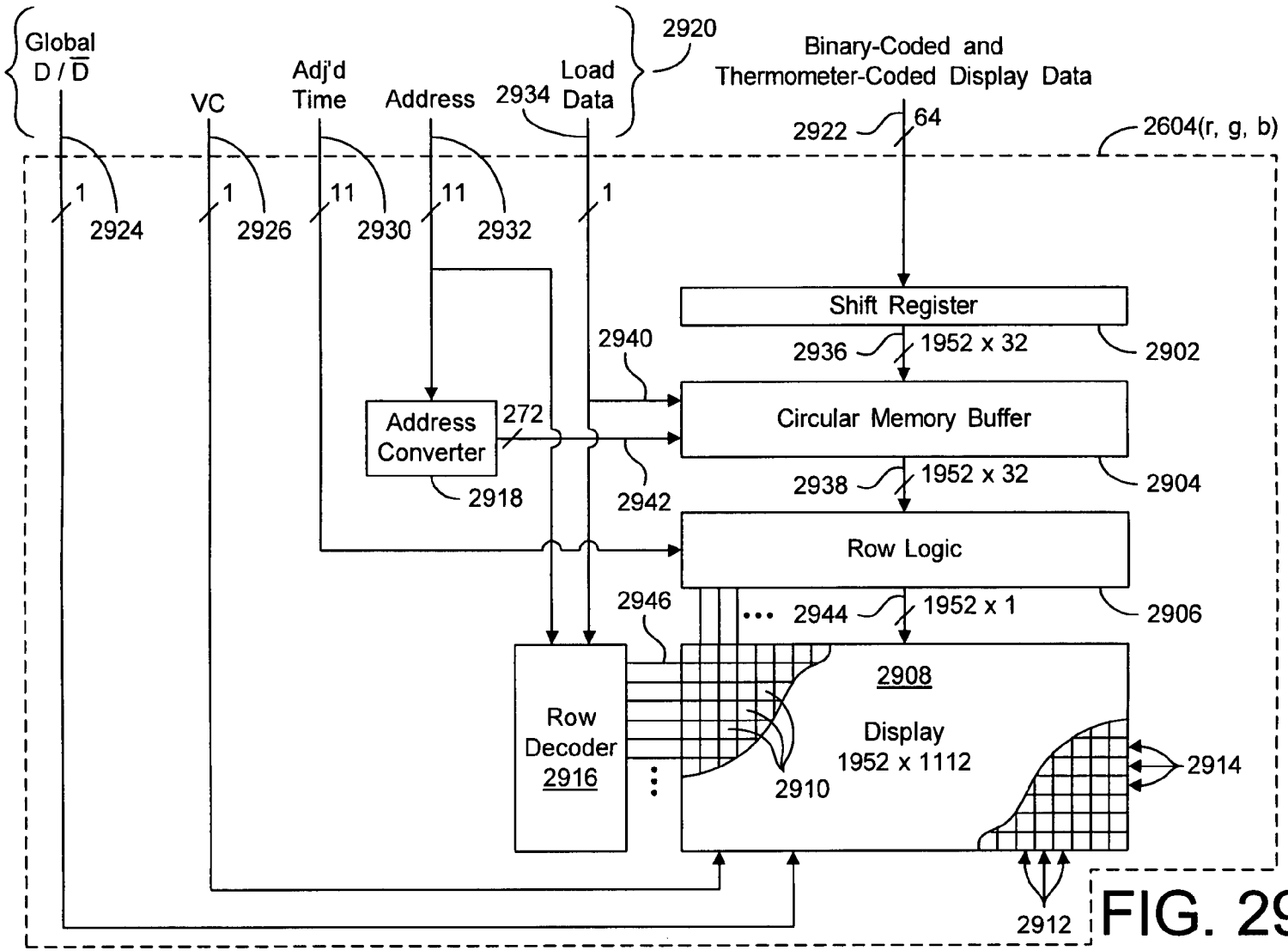
FIG. 29 is a block diagram showing one of the imagers of FIG. 26 in greater detail.

FIG. 29 is a block diagram showing one of imagers 2604(*r, g, b*) in greater detail. Imagers 2604(*r, g*, and *b*) are similar to imagers 504(*r, g*, and *b*), but are modified to drive 1112 rows of pixels rather than 48. Imager 2604(*r, g, b*) includes a shift register 2902, a circular memory buffer 2904, row logic 2906, a display 2908 including an array of pixel cells 2910 arranged in 1952 columns 2912 and 1112 rows 2914, a row decoder 2916, an address converter 2918, a plurality of imager control inputs 2920, and a display data input 2922. Imager control inputs 2920 include a global data invert input 2924, a common voltage input 2926, an adjusted timing input 2930, an address input 2932, and a load data input 2934. Inputs 2920 are coupled to the respective line outputs from ICU 2616. Similarly, 64-bit display data input receives colored, compound video data from data manager.

Shift register 2902 receives and temporarily stores display data for a single row 2914 of pixel cells 2910 of display 2908. Display data is written into shift register 2902 64 bits at a time via data input 2922 until display data for a complete row 2914 has been received and stored. Shift register 2902 receives two pixels worth of video data at a time and is large enough to store 32 bits (i.e., one combination data word 2902) of video data for each pixel cell 2910 in a row 2914. Once shift register 2902 contains data for a complete row 2914 of pixel cells 2910, the data transferred from shift register 2902 into circular memory buffer 2904 via data lines 2936 (1952×32).

Circular memory buffer 2904 receives rows of 32-bit display data output by shift register 2902 on data lines 2936, and stores the video data for an amount of time sufficient for a signal corresponding to grayscale value of the data to be asserted on an appropriate pixel 2910 of display 2908. Responsive to control signals, circular memory buffer 2904 asserts the 32-bit display data associated with each pixel 2910 of a row 2914 of display 2908 onto data lines 2938 (1952×32). To control the input and output of data, circular memory buffer 2904 includes a single bit load input 2940 and a 272-bit address input 2942. Responsive to HIGH signal on load input 2940, circular memory buffer 2904 loads the bits of video data asserted on data lines 2936 into memory. Responsive to a LOW signal, circular memory buffer retrieves a row of compound video data words 2702 from memory and asserts the data onto data lines 2938. Address converter 2918 determines the memory locations that display data bits are written to or read from.

Row logic 2906 writes single bits of data to the pixels 2910 of display 2908 depending on the adjusted time value received on adjusted timing input 2930. Row logic 2906 receives an entire row of 32-bit combination display data via data lines 2938 for each pixel in a row 2914, and based on the display data and adjusted time value, updates the single bits asserted on pixels 2910 of the particular row 2914 via display data lines 2944. Like row logic 806, row logic 2908 updates the electrical signals asserted on each pixel 2910 in a row 814(0-1111) for each read row address asserted by address generator 2804. Based on the display data and adjusted time value, row logic 2906 writes the appropriate bit of combination data word 2702 at the appropriate time such that the intensity value defined by combination data word 2702 is asserted on the appropriate pixel 2914.

Display 808 has 1952 columns 2912 and 1112 rows 2914 of pixel cells 2910. Each row 2914 is enabled by an associated one of a plurality of word lines 2946. Because display 2908 includes 1112 rows of pixels 2910, there are 1112 word lines 2946. In addition, one data line 2944 communicates data between row logic 2906 and each column 2912 of display 2908 to an enabled pixel 2910 in the particular column.

Display 2908 also includes a common electrode (e.g., an Indium-Tin-Oxide layer, not shown) overlying all of pixels 2910. Voltages can be asserted on the common electrode via common voltage input 2926. In addition, the voltage asserted on each pixel 2910 by the single bit stored therein can be inverted (i.e., switched between normal and inverted values) depending upon the signal asserted on global data invert input 2924. The signal asserted on global data invert input 2924 is provided to each pixel cell 2910 of display 2908. The signals asserted on global data invert terminal 824 and the voltages asserted on common voltage input 826 are used to debias display 808.

Row decoder 2916 asserts a signal on one of word lines 2946 at a time, such that the single bit data asserted by row logic 2906 on display lines 2944 is latched into the enabled row 2914 of pixels 2908. Like row decoder 816, when the signal asserted on load data input 2934 is a digital HIGH, then row decoder 2916 ignores the row address asserted on address input 2932 and does not enable a new one of word lines 2946.

It should be noted that the large number of lines between some of the components of imager 2604(*r, g, b*) will be reduced in practice. Indeed, as is well known in the art, large amounts of data can be transferred between electronic components over several clock cycles in order to reduce the bandwidth between those components. However, for the sake of clarity, imager 2604(*r, g, b*) is described with a large number of data lines between some of its components.

Like in imager 504(*r, g, b*), the components of imager 2604(*r, g, b*), other than display 2908, comprises the pixel control circuitry that carries out the modulation of display 2908. Similarly, imager 2604(*r, g, b*) can include multiple pixel control circuitries where each pixel control circuitry is responsible for modulating a defined set of rows in display 2908. This advantageously reduces the number of operations that one pixel control circuitry would have to perform. In other words, multiple pixel control circuitries can update the electrical signals on pixels more times per frame than one pixel control circuitry alone.

Figure 30:
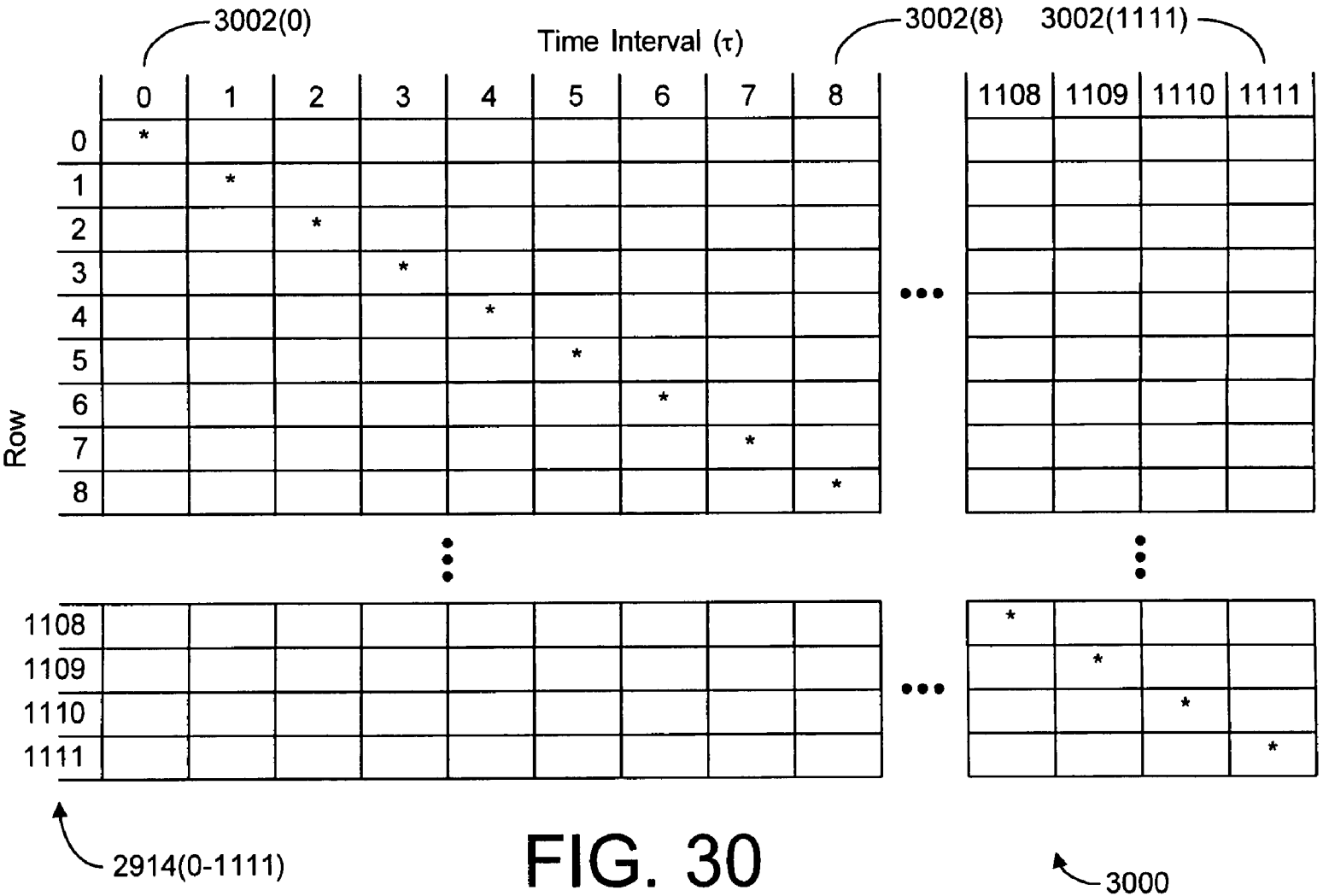
FIG. 30 is a timing chart showing a modulation scheme according to yet another embodiment of the present invention.

FIG. 30 is a timing chart 3000 showing a modulation scheme according to the present invention. Timing chart 3000 shows the modulation period of each row 2914(0-1111) of display 2908 divided into 1112 time intervals 3002(0-1111). Like in prior embodiments, the modulation period of each row 2914(0-1111) is a time period that is divided into n*r coequal time intervals 3002(0-1111), where r equals the number of rows 2914 in display 808 and n is a non-zero, positive integer. Each time interval 3002(0-1111) corresponds to a respective time value (0-1111) generated by timer 2802.

Like row logic 806, row logic 2906 asserts electrical signals corresponding to a particular intensity value within a row 2914's modulation period. Because the number of rows 2914 (0-1111) is equal to the number of time intervals 3002(0-1111), each row 2914(0-1111) has a modulation period that begins in one of time intervals 3002(0-1111) and ends after the lapse of 1111 time intervals 3002(0-1111) thereafter. The beginning of each row 2914's modulation period is indicated in FIG. 30 by an asterisk (*). Note that the modulation period of each row 2914(0-1111) is temporally offset with respect to every other row 2914(0-1111) by n (i.e., one) time interval 3002, such that the rows 2914(0-1111) are driven asynchronously.

Like in modulation scheme 1000 shown in FIG. 10, the modulation period associated with each row 2914(0-1111) forms a frame time for that row 2914(0-1111). Because the modulation periods are asynchronous, the frame times for each row 2910(0-1111) will not temporally align when all the modulation periods are viewed with respect to one particular modulation period. In addition, a row's frame time may include a multiple (e.g., two, three, four, etc.) of modulation periods, such that data is written to each pixel 2910 of a row repeatedly during the frame time of that row 2914 to reduce flicker.

FIG. 31 is a table 3100 showing an exemplary bit code for compound data word 2702 and a generic update schedule for a row based on the bit code. In the present embodiment, compound data word 2702 was selected to include eight binary-coded bits 2704 and twenty-four thermometer-coded bits 2706. Binary-coded bits 2704 are represented as B0-B7 in a first column 3102 of table 3100, and thermometer-coded bits 2706 are represented as B4-B31 in column 3102.

Each bit in column 3102 has a corresponding weight, which is given in a second column 3104 in the respective row. Column 3104 indicates the bit code for the data words 2702 and each bit weight is given in a number of time intervals 3002.

A third column 3106 indicates an update schedule for a particular row based on the bit code in column 3104 during that row's adjusted modulation period. In particular, a bit in column 3102 is written to each pixel in the particular row during the associated update time interval ("T_Event") in column 3106 during that pixel's adjusted modulation period. Note that the update time intervals 3002 in column 3106 assume that the row's modulation period begins in time interval 3002(0) and ends after time interval 3002(1111). For example, row logic 2906 writes a B0 bit to each pixel in the row during time interval 3002(0) in that row's modulation period. Similarly, row logic 2906 writes bits B1, B2, . . . , B15, B16, . . . , B29, B30, and B31 to each pixel 2910 in the row during time intervals 3002(1), 3002(3), . . . , 3002(508), 31002(544), . . . , 3002(1009), 3002(1043), and 3002(1078), respectively, in that row's modulation period.

In general, a particular bit in column 3102 will be written to pixels in a row during a time interval 3002(*x*) in that row's modulation period, where x equals the sum of the weights of the bits previously written to pixel 2910. For example, bit B3 is written to pixel 810 in time interval 3002(7). Note that the sum of the weights of bits B0-B2 is equal to 7 (i.e., 1+2+4=7). Similarly, bit B31 is written to pixel 2910 in time interval 3002(1078), and the sum of the weights of bits B0-B30 is equal to 1078 (i.e. 1+2+4+8+ . . . +34+35+34+35=1078).

Recall that the bit code in column 3104 is completely arbitrary as long as it meets the constraints set forth above in FIG. 27. Note that the sum of the weights in column 3104 add up to the number of rows 2914 (i.e., 1112) in display 2908 and the number of time intervals 3002. Second, the sum of the weighted values in column 3104 is evenly divisible by 2n (1112/2(1)=556). Third, the number of bits (32) is divisible by 2n and yields an integer quotient (32 bits/2(1)=16). Finally, same number of even- and odd-numbered rows 2914 assigned to each pixel control circuitry can be updated during each time interval 3002 as described below.

A fourth column 3108 shows a generic row schedule for determining the row schedule for each of time intervals 3002 (0-1111). The row schedule for each time interval 3002(0-1111) can be determined by the following formula:

$$\text{Row}=(r-T_\text{event})+\tau,$$

where "Row" denotes the row that will be updated, r represents the total number of rows in display 2908, T_event represents the update time interval 3002 for a particular bit in column 3106, and τ is the number of the time interval 3002 (0-1111) that the row schedule is being calculated for. Note that τ is an integer in the range of zero to 1111. Therefore, when subtracting or adding in the above equation, the value of Row should not go negative or above 1111, but should loop forward or backward to a row value between 0 and 1111, inclusive. The formula is repeated for each bit in data word 2702 for each time interval 3002.

Because τ=0 for time interval 3002(0), column 3108 indicates the row schedule for time interval 3002(0). Note that the row schedules for the remaining time intervals 3002(1-1111) can also be calculated by incrementing the values in column 3108 by a number of rows equal to the time interval number. For example, the row schedule for time interval 3002(1) can be calculated by adding one to each row value in column 3108. Similarly, the row schedule for time interval 3002(2) can be calculated by adding two to each row value in column 3108. Note that a row value of 1112 is equivalent to a row value of zero and is indicative of row 2914(0). Accordingly, the next row value after 1112 is row value 1. This process yields the same row update schedule for a particular time interval as the formula given above.

The generic row schedule in column 3108 also enables an equal number of even- and odd-numbered rows 2914 to be updated during each time interval 3002(0-1111). Columns 3110 and 3112 indicate with an "X" whether a particular row in column 3108 is even or odd. Note that there are 16 even and odd rows that are updated during each time interval 3002(0-1111).

FIG. 31 indicates the advantages of the present invention. Because the generic row schedule in column 3108 is used to determine the row schedule for each time interval 3002(0-1111), thirty-two rows 2914 are updated during each time interval 3002(0-1111). Therefore, display driver 2602 operates at 100% efficiency during each time interval 3002(0-1111). In addition, in an imager 2604(*r, g, b*) having two pixel control circuitries, each pixel control circuitry would operate at 100% efficiency because an equal number of even- and odd-numbered rows 2914 are updated during each time interval 3002(0-1111).

Figure 32:
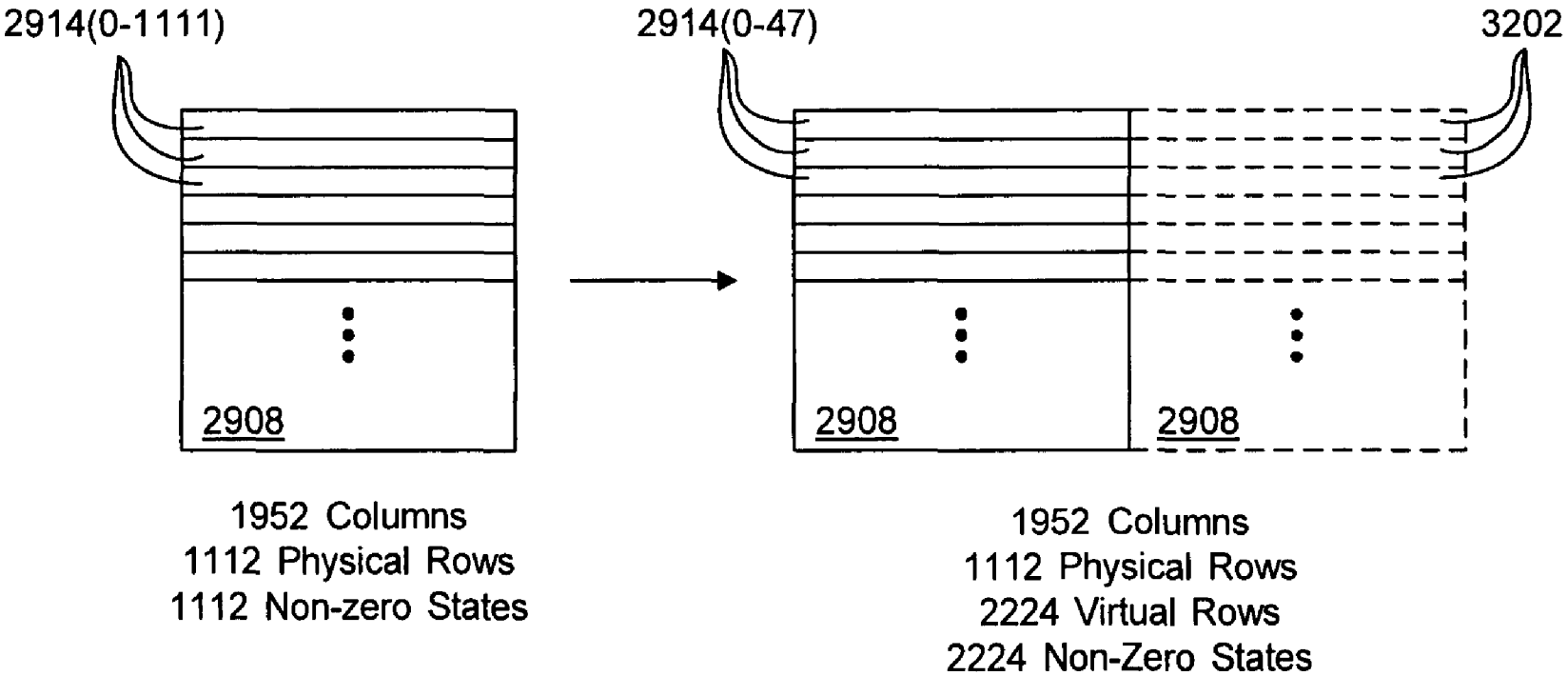
FIG. 32 shows a method for conceptually increasing the number of intensity values that a pixel of FIG. 29 can display according to the present invention.

FIG. 32 graphically shows a method for increasing the number of displayable intensity values according to the present invention. By conceptually placing two displays 2908 side by side, the number of physical rows 2914 of pixels 2910 remains the same, but the number of virtual rows 3202 increases, thereby allowing more intensity values to be defined and the advantages of the present invention to be maintained. In other words, FIG. 32 shows the case where n equals two (n=2).

Increasing the value of n increases the number of intensity values (e.g., grayscales) that that each pixel 2910 in display 2908 can produce. Recall that each pixel 2910 can produce (nr+1) intensity values (including zero), where n is a non-zero integer because there are n*r time intervals. In the previous embodiment, timer 2802 generated 1112 time values because n equaled one and r equaled 1112. However, in the present embodiment, timer 2802 generates 2224 time values because n*r (i.e., 2*1112) equals 2224.

Figure 33:
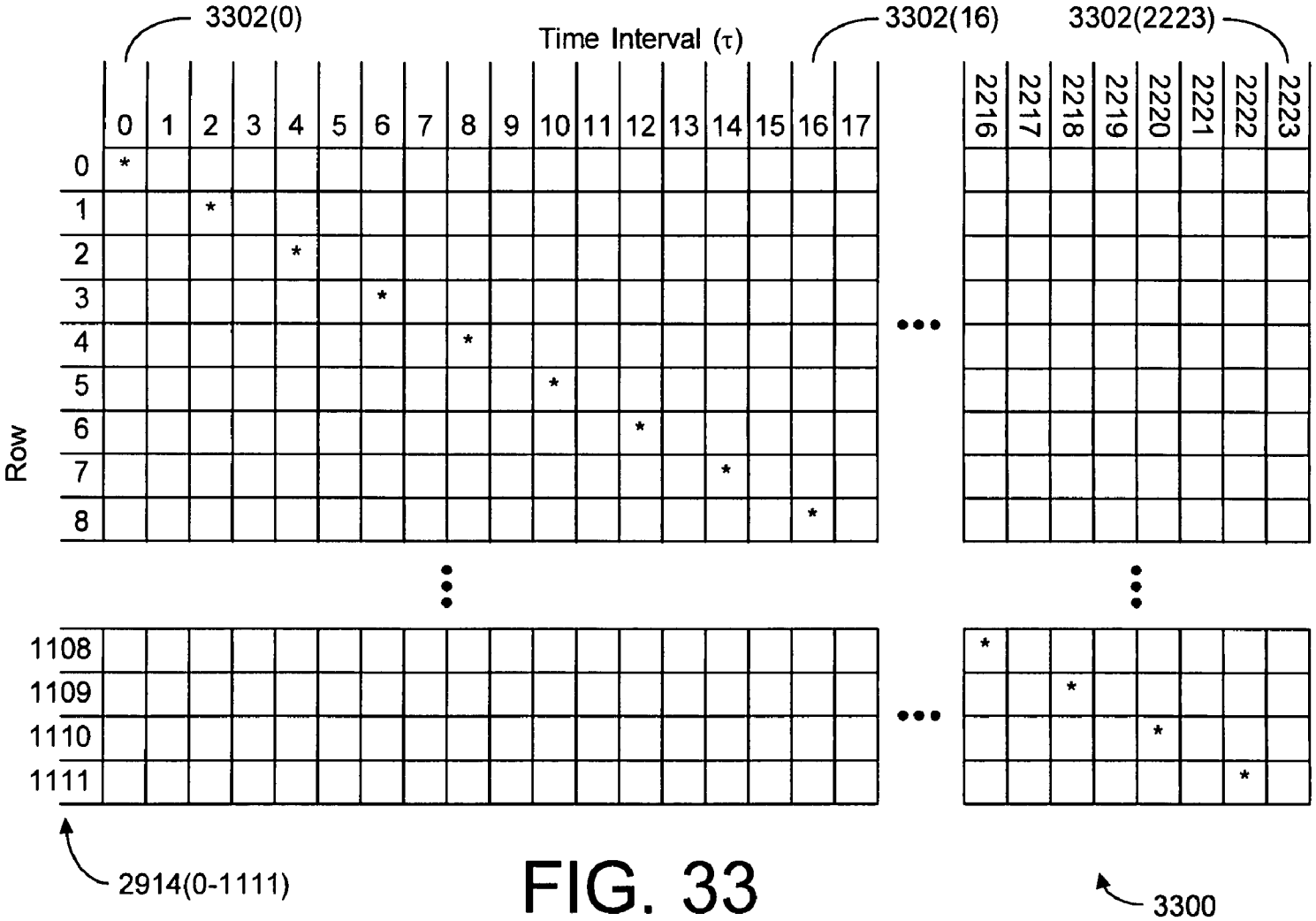
FIG. 33 is a timing chart showing a modulation scheme according to still another embodiment of the present invention.

FIG. 33 is a timing chart 3300 showing a modulation scheme for modulating display 2908 for n equals two. Timing chart 3300 shows the modulation period of each physical row 29814(0-1111) in display 29808 divided into 2224 time intervals 3302(0-2223). The modulation period of each row 2914 (0-1111) is a time period that is divided into n*r coequal time intervals 3302(0-2223), where r equals the number of physical rows 2914(0-1111) in display 2908. In the present embodiment, timer 2802 generates 2224 time values, each corresponding to one time interval 3302(0-2223).

Row logic 2906 writes electrical signals corresponding to particular intensity values to the pixels in each physical row 2914(0-1111) within the row's respective modulation period. Because the number of rows 2914(0-1111) is only half of the number of time intervals 3302(0-2223), the modulation periods of rows 2914(0-1111) begin during every other one of time intervals 3302(0-2223) and end after the lapse of 2223 time intervals thereafter. For example, row 2914(0) has a modulation period that begins at the beginning of time interval 3302(0) and end after the lapse of time interval 3302 (2223). Similarly, row 2914(1) has a modulation period that begins at the beginning of time interval 3302(2) and ends after the lapse of time interval 3302(1). Again, the beginning of each row 2914's modulation period is indicated in FIG. 33 by an asterisk (*).

Like the previous embodiment, each row 2914's modulation period is temporally offset by n time intervals 1902 from the previous row's modulation period. For example, row 2914 (1)'s modulation period is temporally offset from row 2914 (0)'s modulation period by two time intervals 3302. Thus, rows 2914(0-1111) are still driven asynchronously. In addition, as previously suggested, multiple modulation periods can be defined in each frame to improve the quality of the displayed image.

FIG. 34 is a table 3400 showing an alternate bit code for a data word 2702A and an update schedule for display 2908 based on data word 2702A. In the present embodiment (i.e., n=2), data word 2702A includes eight binary-coded bits 2704A and twenty-four thermometer-coded bits 2706A. Binary-coded bits 2704A and thermometer-coded bits 2706A are represented as bits B0-B7 and B8-B31, respectively, in a first column 3402. Each bit in column 3402 has a corresponding weight, which is given in a second column 3404 in each bit's respective row. Column 3404 represents the bit code for each compound data word 2702A. Again, the weight of each bit corresponds to its weight in time intervals 3302(0-2223).

Like data word 2702, the sum of the weighted values of bit code in data word 2702A meets the constraints of the first aspect of the present invention. In particular, the sum of the weights in column 3404 add up to an integer multiple of the number of rows 2914. Here, the sum of the weights in column 2404 equal 2224, which is two times the number of physical rows 2914 in display 2908. In addition, the number of bits in the bit code in column 3404 is evenly divisible by n. In particular, there are thirty-two bits in the code in column 3404, which when divided by two (i.e., n=2), yields sixteen. Therefore, the bit code of data word 2702A shown in column 3404 facilitates updating the same number of rows 2914 in display 2908 during each time interval 1902.

The bit code of data word 2702A also meets the constraints of the second aspect of the present invention for s equals two (s=2). In particular, the number of bits in data word 2702A (i.e., thirty-two bits) must be evenly divisible by 2n (four for n=2). In addition, the sum of the weighted values of the bits in compound data word 2702A in column 3404 must be evenly divisible by 2n. Here, the quotient of 2224 and 4 is 556. Finally, as described in more detail below, the bit code in column 3404 produces row schedules for each time interval 3302 wherein an equal number of even- and odd-numbered rows 2914 are updated during each time interval 1902. If the bit code of data word 602A meets these limitations and an imager contains two iterations of pixel control circuitry, then both iterations of pixel control circuitry will operate at 100% efficiency during each time interval 3302(0-2223) because an equal number of even- and odd-numbered rows 2914 will be updated during each time interval 3302(0-2223).

Again, note that the number of bits and their respective weights in data word 2702A are completely arbitrary as long as constraints pertaining to the particular aspect(s) of the present invention are met.

The third column 3406 in table 3400 indicates the update time intervals 3302 during which particular bits are written to the pixels 2910 in each row 2914 during that row's adjusted modulation period. Recall that an adjusted modulation period assumes that the row 814's modulation period begins at time interval 3302(0) and ends after time interval 3302(2223). For example, B0 is written to a pixel 2910 in row 2914 during time interval 3302(0) (i.e., the first time interval) during that row's adjusted modulation period. Similarly, bits B1, B2, . . . , B15, B16, . . . , B29, B30, and B31 are written to the pixel 2910 in time intervals 3302(1), 3302(3), . . . , 3302(842), 3302(924), . . . , 3302 (1981), 3302 (2062), and 3302(2143), respectively. In general, a particular bit in column 3402 will be written to pixel 2910 in a particular row 2914 during a time interval 3302(*x*) in that row's modulation period, where x is equal to the sum of the weights of the bits previously written to the pixels 2910 in that row 2914.

A generic row schedule, from which other row schedules can be determined, is shown in a fourth column 3408 and is generated based on the update time intervals 3302 calculated in column 3406. The generic row schedule shown in column 3408 is calculated according to the following formula:

$$\text{Row} = \text{INT}\left(\frac{(nr) - \text{T_Event}}{n}\right),$$

where n is a non-zero integer, r is the number of physical rows 2914 in display 2908, $T_{13}$ Event represents an update time interval given in column 3406, and INT is the integer function. In the present embodiment, n equals two such that the above equation can be simplified to the following:

$$\text{Row} = \text{INT}\left(\frac{2224 - \text{T_Event}}{2}\right).$$

Recall that there are twice as many time intervals 3302(0-2223) than there are rows 2914(0-1111). Therefore, the generic row schedule in column 3408 has to be divided between two time intervals. Therefore, each row in column 3408 can be assigned to one of n remainder groups, and each remainder group can be used to generate a row schedule for a time interval 3302(0-2223). Ideally, an equal number of rows 2914 are assigned to each remainder group such that an equal number of rows 2914 are updated during each time interval 3302.

Accordingly, each row in the row schedule in column 3408 is assigned to one of n remainder groups according to the following formula:

$$\text{Remainder Group} = ((nr) - \text{T_Event})\ \%\ n,$$

where % is the remainder function.

A fifth column 3410 shows the two remainder groups that each of the rows in column 3408 is be assigned to according to the above formula. Fifth column 3410 shows that each remainder group (e.g., remainder group 0 and remainder group 1) contains an equal number (e.g., sixteen) of the rows in column 3408. The rows in column 3408 that are assigned to remainder group zero in column 3410 form a generic row schedule for remainder group zero. Similarly, the rows in column 3408 that are assigned to remainder group one for a generic row schedule for remainder group one.

It is important to note at this point that the generic row schedules for each remainder group contains an equal number of rows that are even and odd. Accordingly, if imager 2604 contains two iterations of pixel control circuitry, one controlling even-numbered rows and one controlling odd-numbered rows, then each iteration of pixel control circuitry will operate at 100% efficiency during each time interval 3302(0-2223).

FIG. 35A is a table 3502 showing the row schedule and bit transfer schedule for time interval 3302(0) (i.e., Tau=0). A first column 3504 contains the generic row schedule for remainder group zero from FIG. 34. A second column 3506 contains the row schedule for remainder group zero with an adjustment counter value (e.g., from a counter like counter 2308) added to each row number in remainder group zero. The adjusted row schedule in column 3506 is the row schedule for time interval 3302(0), indicating the rows 2914 in display 2908 that are updated during time interval 3302(0). Finally, a third column 3508 indicates the bits of data word 2702A that are written to each pixel 2910 in the associated rows in column 3506 during time interval 3302(0).

The counter value is added to the generic row schedule for remainder group zero in column 3504 to adjust the row schedule for a particular physical row 2914's modulation period. Because there are n times as many time intervals 3302 as there are physical rows 2914, the counter steps through each count value n times. The count values produced by the counter are limited by the number of rows 2914 in display 2908. In the present embodiment, where n=2, the counter outputs values ranging from 0 to 1111 in the following sequence: 0, 1, 1, 2, 2, 3, 3, 4, 4, 5, . . . , 1110, 1110, 1111, 1111, 0.

Based on table 3502, during time interval 3302(0), row logic writes bit B0 to each pixel in row 2914(0), bit B9 to each pixel in row 2914(943), bit B10 to each pixel in row 2914 (902), bit B12 to each pixel in row 2914(817), bit B13 to each pixel in row 2914(776), and so on.

FIG. 35B is a table 3510 showing the row schedule and bit transfer schedule for time interval 3302(1) (i.e., Tau=1). A first column 3512 contains the generic row schedule for remainder group one. A second column 3514 contains the row schedule in column 3512 with the counter value, which was incremented to a value of one, added to each row from column 3512. Accordingly, column 3514 shows the row schedule for time interval 3302(1). Finally, column 3516 indicates the bits that are transferred to each pixel 2910 in the associated rows 2914 shown in column 3514 during time interval 3302(1).

FIG. 35C is a table 3518 showing the row schedule and bit transfer schedule for time interval 3302(2) (i.e., Tau=2). First column 3520 contains the generic row schedule for remainder group zero. The counter value still equals one, and second column 3522 contains the row schedule in column 3520 with the counter value added to each row. The adjusted row schedule in column 3522 is the row schedule for time interval 3302(2). Finally, column 3524 indicates the bits that are transferred to each pixel 2910 in the associated rows 2914 shown in column 3522 during time interval 3302(2).

FIG. 35D is a table 3526 showing the row schedule and bit transfer schedule for time interval 3302(3) (i.e., Tau=3). First column 3528 again contains the generic row schedule for remainder group one. The counter value has been incremented to a value of two, and second column 3530 contains the row schedule in column 3528 with the counter value added to each row. The adjusted row schedule in column 3530 is the row schedule for time interval 3302(3). Finally, column 3532 indicates the bits that are transferred to each pixels 2910 in the associated rows 2914 shown in column 3530 during time interval 3302(3).

It should be noted again that each time interval 3302(0-2223) is associated with one of the n remainder groups because the row schedule for each time interval 3302 is calculated based on a generic row schedule for a particular remainder group. Accordingly, because an equal number of bits in data word 2702A are associated with each of the n remainder groups, each row 2914 will be updated during an equal number of time intervals 3302 that are associated with each of the n remainder groups. In particular, each row 2914 will be updated during (b/n) ones of the time intervals 3302 that are associated with each remainder group, where b represents the number of bits in data word 2702A. Furthermore, because each row 2914's modulation period consists of the same number of time intervals 3302, each row 814 will be updated during an equal number of time intervals 3302 associated with each remainder group regardless of the number of time intervals 3302 that the particular row's modulation period is temporally offset from row 814(0).

Figure 36:
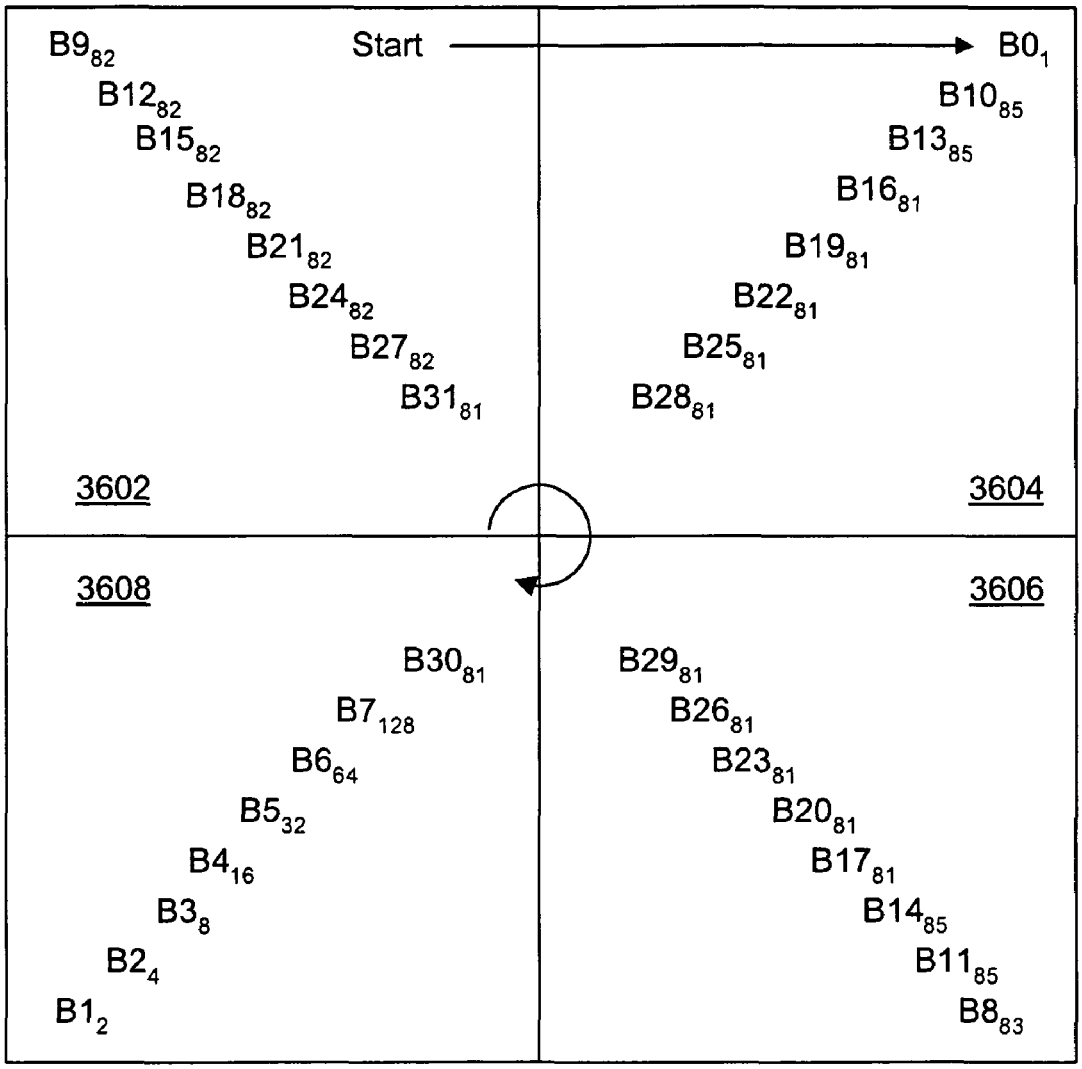
FIG. 36 shows a graphical method for validating the bit code of FIG. 34 according to the present invention.

FIG. 36 is another quadrant based diagram 3600 which graphically shows that the bit code (shown in column 3404 in FIG. 34) for data words 2702A generates a balanced update schedule. Recall that the number of bits and their associated weights that make up data word 2702A are arbitrary, so long as they meet particular system constraints for an aspect of the present invention. Diagram 3600 simplifies meeting those system constraints.

Quadrant-based diagram 3600 includes, in a clock-wise manner, a first quadrant 3602, a second quadrant 3604, a third quadrant 3606, and a fourth quadrant 3608. If the update schedule is balanced, each quadrant will contain eight data bits (i.e., 32 bits/4 quadrants=8 bits/quadrant). Each bit, starting consecutively with the least significant bit B0, in data word 2702A, "jumps" clockwise through a number of quadrants equal to its weight. Bit B0 starts in quadrant 3602, and each subsequent bit starts "jumping" where the previous bit "landed." Based on the bit code for data words 2702A, eight bits have landed in each quadrant, signaling that the bit code for data word 2702 produces a balanced update schedule.

FIG. 37 is a timing chart 3700 showing a modulation scheme according to yet another aspect of the present invention. According to this aspect of the present invention, the number of time intervals in a row's modulation period (and thus the number of non-zero intensity values) is set equal to the number of rows in the display divided by m, where m is a common divisor of the number of rows in the display. To illustrate this aspect of the present invention, recall display system 500 and imagers 504(*r, g, b*), which each had a display 808 containing forty-eight rows. According to this aspect of the present invention, if m equals two, then each row 814's modulation period would be twenty-four time intervals 3702 (0-23) long. In the case of m equals two, m is a common divisor of forty-eight because forty-eight is evenly divisible by two without leaving a remainder. Indeed, timing chart 3700 shows that the modulation period for each row 814(0-47) in display 808 is divided into twenty-four time intervals 3702(0-24).

Electrical signals corresponding to particular intensity values are written to the pixels in each row 814(0-47) within the row's respective modulation period. Because in the present embodiment there are fewer time intervals 3702(0-23) than rows 814(0-47), the modulation period associated with m rows 814 will begin during each time interval 3702(0-23). For example, two rows 814(0) and 814(1) begin their modulation period in time interval 3702(0) and end their modulation period after the lapse of time interval 3702(23). Similarly, two rows 814(2) and 814(3) begin their modulation period in time interval 3702(1) and end their modulation period after the lapse of time interval 3702(0). In general, the beginning of each row 814's modulation period begins in a time interval 3702 where a "0" is indicated for that row in chart 3700. Note that the modulation period associated with a row 814 forms a frame time for that row.

Similar to other embodiments, the modulation periods for various rows 814(0-47) are temporally offset from other rows 814(0-47). For example, the modulation periods associated with rows 814(0) and 814(1) are temporally offset with respect to the modulation periods associated with every other row 814. Similarly, the modulation periods associated with rows 814(2) and 814(3) are temporally offset from with respect to the modulation periods associated with every other row 814. Thus, the rows of the display are driven asynchronously. Note that in the present embodiment, at least one modulation period begins in each time interval 3702(0-23).

FIG. 38 is a table 3800 showing an update schedule and the row schedules associated with two time intervals 3702 for display 808 based on the modulation scheme shown in FIG. 37. Like previous embodiments, data manager 510 converts each binary-weighted data word into a compound data word 3802 that includes a plurality of binary-coded bits 3804 and a plurality of thermometer-coded bits 3806. Binary-coded bits 3804 are labeled as bits B0-B3 in a first column 3808 of table 3800, while thermometer-coded bits 3806 are labeled B4-B5 in the same column. Each bit in column 3808 has a corresponding weight, which is given in a second column 3810 in the same row as the particular bit in column 3808. Note that each bit weight in column 3810 is given in a number of time intervals 3702.

Note that the bit code in column 3810 for each data word 3802 is completely arbitrary (as to the number of bits and their respective weights), except that it is subject to some limitations depending on the aspect of the invention that is implemented. According to one aspect of the present invention, the sum of the weights in column 3810 must add up to the quotient of the number of rows 814 in display 808 divided by the common divisor (m). In the present embodiment, the sum of the weights in column 3810 add up to twenty-four, which is equal to quotient of forty-eight and two, where the number of rows 814 in display 808 is forty-eight and (m) equals two. This limitation on the bit code in column 3810 ensures that an equal number of rows are updated during each time interval 3702. Accordingly, the data and instruction transfer efficiency between display driver 502 and imagers 504(*r, g, b*) is 100% during each time interval 3702(0-23).

The bit code in column 3810 is subject to additional limitations to conform with another aspect of the present invention where each imager 504(*r, g, b*) includes a plurality of pixel control circuitries where each circuitry drives various sets of rows 814 in display 808. For example, where each imager 504(*r, g, b*) contains (s) iterations of pixel control circuitry, then the bit code in column 3810 must meet these additional limitations. First, the number of bits in the code must be divisible by (s). Second, the sum of the weighted values in column 3810 must be divisible by (s). Finally, an equal number of rows 814 belonging to each of the (s) sets of rows must be updated during each time interval 3702. These limitations ensure that an equal number of rows 814 are updated by each iteration of pixel control circuitry during each time interval 3702(0-23) such that each iteration of pixel control circuitry operates at 100% efficiency during each time interval 3702(0-23).

The bit code shown in column 3810 meets all these additional limitations as well. For example, the number of bits (six) in the bit code is divisible by two (m equals two). In addition, the sum of the weights of the bit code in column 3810 is also evenly divisible by two (i.e., 24/2=12). Finally, as will be described below, an equal number of rows assigned to each of two sets are updated during each time interval 3702 (0-23).

A third column 3812 indicates an update schedule for a row 814 based on data word 3802's bit code. In particular, a bit in column 3808 is written to a particular pixel 810 during the update time interval 3702 in column 3812 in that pixel's adjusted modulation period. In this example, B0 is written to a pixel 810 during time interval 3702(0) in that pixel's modulation period. Similarly, bits B1, B2, B3, B4, and B5, are written to pixel 810 in time intervals 3702(1), 3702(3), 3702 (7), 3702(15), and 3702(20), respectively, in that pixel's modulation period. In general, a particular bit in column 3808 will be written to pixel 810 during a time interval 3702(*x*) in that pixel's modulation period, where x is equal to the sum of the weights of the bits previously written to pixel 810.

Column 3814 shows the row schedule for time interval 3702(0), which is determined from the update schedule in column 3812. Generally, the row schedule for each time interval 3702(0-23) is determined by the following formula:

$$\text{Row}=(r-mT_\text{event})+m\tau+j,\ (0\leqq j<m)$$

where "Row" denotes a row 814 that will be updated during the particular time interval 3702(τ), (r) represents the total number of rows 814 in display 808, T_event is the update time interval in column 3812 for a particular bit, (m) is a common divisor of the number of rows 814, and (τ) is the number of the time interval 3702 that the row schedule is being calculated for. Note that because (m) rows 814 begin their modulation periods in each time interval 3702(0-23), a row update must be calculated (m) times for each bit 3808 during each time interval 3702(0-23). Accordingly, a row value is calculated for each value of (j) in the above equation for each bit in column 3808. In the present embodiment, r equals forty-eight because there are forty-eight rows 814 in display 808, the T_Event values are given in column 3812, and τ can be any number ranging from zero to twenty-three which correspond to time intervals 3702(0-23). Note that the value Row is constrained between zero and forty-seven because there are only forty-eight rows in display 808. Therefore, when subtracting or adding in the above equation, the value should not go negative or above forty-seven, but should loop forward or backward to the appropriate row value between zero and forty-seven, inclusive.

Based on this function, column 3814 shows the row schedule for time interval 3702(0) (τ=0). During time interval 3702(0), B0 bits are written to each pixel in rows 814(0) and 814(1), B1 bits are written to each pixel 810 in row 814(46) and 814(47), B2 bits are written to each pixel 810 in row 814(42) and 814(43), B3 bits are written to each pixel 810 in row 814(34) and 814(35), B4 bits are written to each pixel 810 in row 814(18) and 814(19), and B5 bits are written to each pixel 810 in row 814(8) and 814(9). Note that six even-numbered rows 814 and six odd-numbered rows 814 are updated during time interval 3702(0).

Similarly, the row schedule for time interval 3702(1) (i.e., τ=1) can also be determined and is given in column 3816. During time interval 3702(1), B0 bits are written to each pixel in rows 814(2) and 814(3), B1 bits are written to each pixel 810 in row 814(0) and 814(1), B2 bits are written to each pixel 810 in row 814(44) and 814(45), B3 bits are written to each pixel 810 in row 814(36) and 814(37), B4 bits are written to each pixel 810 in row 814(20) and 814(21), and B5 bits are written to each pixel 810 in row 814(10) and 814(11). Note again that six even-numbered rows 814 and six odd-numbered rows 814 are updated during time interval 3702(1).

It should be noted that because the number of time intervals 3702 is equal to the number of rows 814 divided by m, that the row schedule for each time interval 3702 will contain a number of row updates equal to the number of bits (b) in data word 3702 multiplied by m (i.e., b*m). In this case, where (b) equals six and (m) equals two, there are twelve rows 814 updated during each time interval 3702(0-23).

Finally, note that chart 3700 in FIG. 37 includes portions of the row schedule for each time interval 3702(0-23). Chart 3700 indicates that each row 814 is updated during the same time intervals 3702 when the time intervals 3702(0-23) are adjusted for a particular row's modulation period.

The driving scheme described in FIGS. 37 and 38 provides many advantages. First, an equal number of rows 814 are updated during each time interval 3702(0-23). In addition, if imagers 504(*r, g, b*) included two iterations of pixel control circuitry, one pixel control circuitry could drive even-numbered rows 814(even) and the other could drive odd-numbered rows 814(odd). Because an equal number of even- and odd-numbered rows are updated during each time interval 3702(0-23), each pixel control circuitry would operate at 100% efficiency during each time interval 3702.

In addition, the present aspect of the invention provides some additional advantages.

Figure 39:
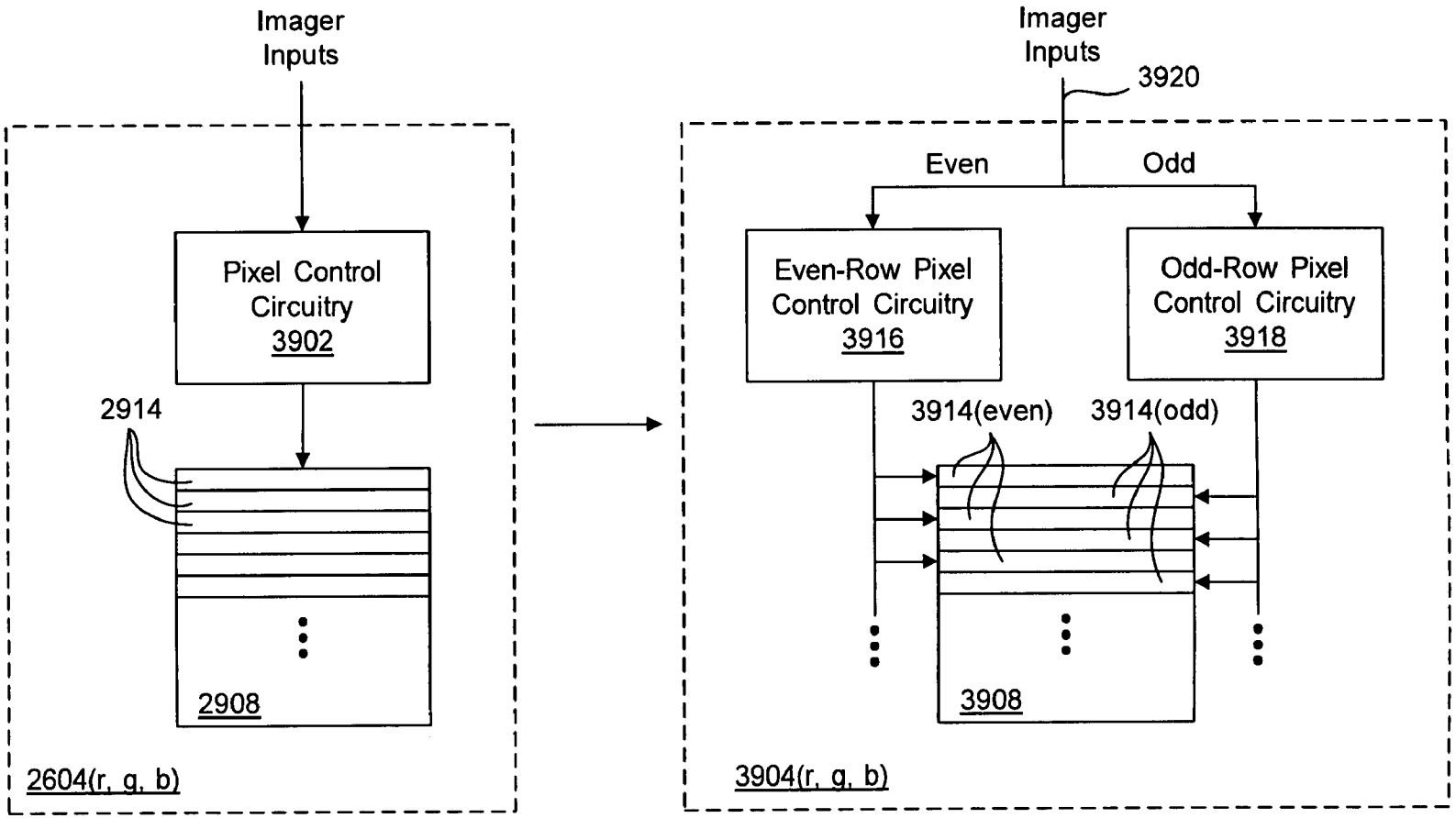
FIG. 39 is a block diagram showing an imager having a display driven by multiple pixel control units according to one embodiment of the present invention.

FIG. 39 shows imager 2604(*r, g, b*) modified into imager 3904(*r, g, b*) to compensate for large work loads placed on the pixel control circuitry 3902 of imager 2604(*r, g, b*). Recall that the various elements in FIG. 29 modulated the display 2908 in imager 2604(*r, g, b*). These elements are generally described herein as pixel control circuitry 3902. Where the value of (n) and/or the number of rows in the display 2908 are/is large, the workload on pixel control circuitry 3902 becomes too great for the circuitry to handle. For example, in the case where n equals two, pixel control circuitry would have to operate twice as fast as it would where (n) equaled one. Similarly, pixel control circuitry 3902 would experience an increased burden when driving a display having 1112 rows of pixels rather than in a display having 720 rows.

To solve this problem, imager 3904(*r, g, b*) includes (s) iterations of pixel control circuitry, each driving one of (s) sets of rows in the display. In particular, imager 3904(*r, g, b*) includes a display 3908 having a plurality of rows 3914 that is controlled by two (e.g., s=2) iterations of pixel control circuitry 3916 and 3918. Pixel control circuitry 3916 drives a first set of rows 3914 and pixel control circuitry 3918 drives a second set of rows 3914. In the present embodiment, all even-numbered rows 3914(even) are assigned to a first set and all odd-numbered rows 3914(odd) are assigned to a second set. Accordingly, pixel control circuitry 3916 drives the even-numbered rows 3914(even) in display 3908 while pixel control circuitry 3918 drives all the odd-numbered rows 3914 (odd). Therefore, pixel control circuitries 3916 and 3918 operate at the same speed as pixel control circuitry 3902 but together advantageously perform twice as many row updates as pixel control circuitry 3902 alone.

Like imager 2604, imager 3904(*r, g, b*) includes a plurality of imager inputs 3920 which include data lines and imager control lines from a display driver. The display data and control signals can be divided (e.g., according to even and odd row number) and sent to one or both of pixel control circuitries 3916 and 3918 as necessary.

Note that the modification described in FIG. 39 is applicable to either imager 504(*r, g, b*) or imager 2604(*r, g, b*). Imager 504(*r, g, b*) or imager 2604(*r, g, b*) operate at 100% efficiency during each time interval when display 3908 is driven according to any of the driving schemes of the present invention described thus far. In particular, all of these driving schemes utilize bit codings that facilitate an equal number of even- and odd-numbered rows to be updated during each time interval. Accordingly, if imager 3904(*r, g, b*) were substituted for imagers 504(*r, g, b*) or imagers 2604(*r, g, b*), each pixel control circuitry 3916 and 3918 would operate at 100% efficiency during each time interval 1002, 1902, 3002 or 3302. Furthermore, imager 3904(*r, g, b*) is able to process many more display instructions than imagers 504(*r, g, b*) or 2604(*r, g, b*) in the same amount of time.

The even and odd row assignments are an easy way to assign rows 3914 in a display 3908 to one of two sets of rows. However, rows can be assigned to sets by assigning each row one of a plurality of values (e.g., 0 and 1, A, B or C, etc.) where each value identifies a particular set. The important aspect in maintaining balanced row scheduling is to update an equal number of rows 3914 assigned to each of the (s) sets during each time interval.

Although imager 3904(*r, g, b*) shows the case were (s) equals two, it should be noted an imager of the present invention can have any number of pixel control circuitries. Indeed, the rows 3914 in display 3908 can be assigned to three or more sets, depending on the iterations of pixel control circuitry that the imager contains. As bit depth requirements and/or the number of rows 3914 in a display 3908 increases, an imager 3904(*r, g, b*) could include many iterations of pixel control circuitry.

It should also be noted that the elements of an imager that are reproduced in each pixel control circuitry is flexible and may vary from system to system. For example, in one embodiment, each pixel control circuitry in imager 3904(*r, g, b*) could include multiple iterations of all the elements in imagers 504(*r, g, b*) or 2604(*r, g, b*) that are shown in FIGS. 8 and 29, respectively, besides the display 808 or display 2908. As another example, an imager 3904(*r, g, b*) might contain multiple iterations of some imager elements, while a single iteration of another element (e.g., a shift register like shift register 2902) may be suitable. The important aspect of the present invention is that that an imager 3904 includes multiple pixel control elements (such as row logic 2906) where each element helps update different sets of rows in the display.

Furthermore, although the pixel control circuitries 3916 and 3918 are described as having particular circuit elements, their function should be thought of more generally. In particular, each pixel control circuitry 3916 and 3918 forms a pixel control unit that updates a particular set of rows 3914 in display 3908. As such, the pixel control units could be moved throughout the display system as necessary, and still provide their various functions. For example, the pixel control units could be moved from the imager to the display driver (e.g., display driver 502 or 2602). As another modification, pixel control circuitries 3916 and 3918 could be embodied as firmware or software programming in the display system 500 or 2600.

Figure 40A:
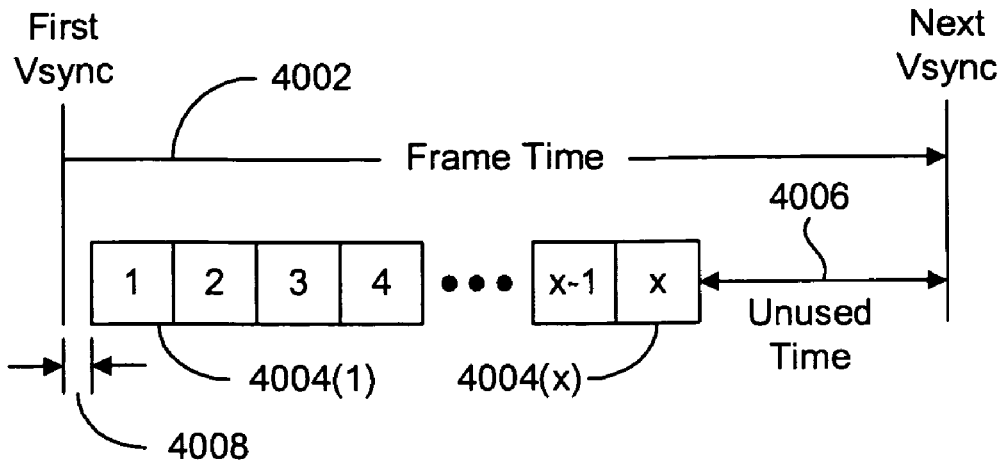
FIG. 40A is a block diagram showing the unused frame time between a last row update and the end of the frame.

FIG. 40A shows a frame time 4002 for a display device, such as imager 2604(*r, g, b*), wherein x row updates 4004(1-*x*) are performed (each box represents a row update). Frame time 4002 is defined by two sequential Vsync signals received, for example, by global timing control unit 2612. Recall that a row update occurs when data is written to the pixels (e.g., pixels 2910) in a particular row (e.g., row 2914). Therefore, frame time 4002 should be long enough to perform an entire frame's worth of row updates 4004(1-*x*) (i.e., x row updates).

According to the modulation schemes of the present invention, the number of row updates (x) performed during one frame can be determined according to the following formula:

$$x=r\times b,$$

where r equals the number of physical rows in the pixel array, and b equals the number of bits in the bit code for each data word that defines a grayscale value. For example, for imager 2604 (i.e., r=1112) and the bit code of data word 2702 (i.e., b=32), x equals 35,584 row updates (i.e., 1112*32).

As described in FIG. 26, global timing control unit 2612 coordinates the operation of display system 2600 (in part) by generating a series of clock signals on global timing control bus 2613. An ideal clock frequency generated by timing control unit 2612 would equal the product of x row updates 3704 per frame, the number of operational instructions (e.g., row-write instructions, data instructions, etc.) needed to write new data to a row in the pixel array, and the Vsync frequency. Accordingly, an ideal clock frequency can be determined as follows:

$$\text{Ideal_Clock}=x*i*f_V\text{sync Hz},$$

where i is the number of operational instructions needed per row update and f_Vsync is the Vsync frequency. As an example, if thirty-two operational instructions are needed per row update (i.e., i=32) and there are sixty frames per second (i.e., f_Vsync=60), then the ideal clock frequency output by global timing control unit 2612 is 68,321,280 Hz. Note that the ideal clock frequency calculation given above is only an example. The ideal clock frequency calculation will vary depending on design considerations of the particular application.

In reality, it is unlikely that a clock operating at this precise frequency exists. However, a clock can be selected that generates a frequency that is slightly greater than the ideal clock frequency. For example, a real clock might generate a clock frequency at 68,335,909 Hz, which is just slightly faster than the ideal clock frequency. In this particular example, the real clock frequency is 0.02141% faster than the ideal clock frequency.

FIG. 40A indicates the problems that occur when the real clock frequency is faster than the ideal clock frequency. In particular, the real clock frequency produces an unused frame time 4006 between the last row update 4004(*x*) and the subsequent Vsync. In other words, if global timing control unit 2612 operates at the real clock frequency, it generates more clock pulses than are needed to perform x row updates 4004. Due to the unused time 4006, if the pixels in the display are modulated after the last row update 4004(*x*) in the frame such that some pixels are on and some pixels are off, then some bits will be asserted on pixels for a longer time share of a row's modulation period than defined by their respective bit weights. Accordingly, the grayscale values written to the pixels will have some modulation error. In a different case, if all the pixels are turned off after the last row update 4002(*x*) (and the end of the corresponding time interval), then a large unused time 4006 will cause perceptible flicker in the display. Finally, the unused frame time 4006 represents valuable modulation time that detracts from overall pixel brightness and contrast, causing duller pixels than necessary.

FIG. 40A illustrates another problem in that the first row update 4004(1) in the frame 4002 is not synchronized with the first Vsync signal. In other words, some time 4008 elapses between the Vsync signal and when global timing control unit 2612 generates the first clock pulse associated with row update 4004(1). The first clock pulse associated with row update 4004(1) is also known as the "First of Frame" (FOF) signal. Note that in FIG. 37A, the row update 4004(1) starts late. It is also possible that the row update 4004(1) could start early before the first Vsync. If the FOF clock pulse of row update 4004(1) and the first Vsync are not locked in phase each frame 4002, then the time 4008 between the first Vsync and row update 4008 will become large enough over time to create perceptible flicker and other visual artifacts that degrade image quality.

Figure 40B:
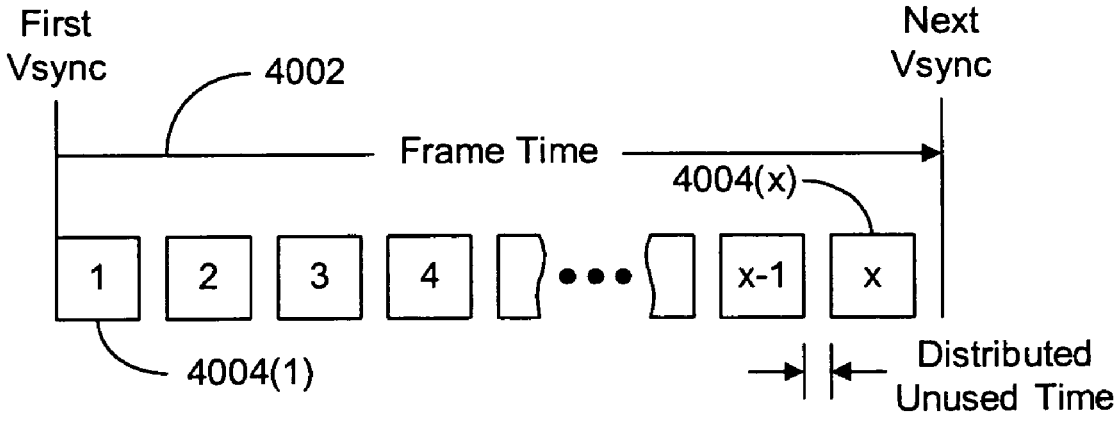
FIG. 40B is a block diagram showing the unused frame time of FIG. 40A spread between x row updates and the end of the frame.

FIG. 40B shows the unused frame time 4006 distributed between the row updates 4004(1-*x*) within frame time 4002 and between row update 4004(*x*) and the next Vsync according to the present invention. By distributing the unused time 4006 throughout the frame 4002 and between row updates 4004(1-*x*), the unused time is also distributed between the time intervals 3002, 3302 that the particular row updates 4004 occur in. By spreading the unused frame time 4006 between the time intervals 3002, 3302, the duration of at least some of the time intervals 3002, 3302 are adjusted. In particular, some of the time intervals 3002, 3302 get longer. Accordingly, each pixel gets more on and off time during its modulation period, which advantageously improves overall display brightness and contrast. In addition, perceptible flicker is reduced because a large off time does not occur after row update 4004(*x*).

FIG. 40B also shows that the beginning of row update 4004(1) is substantially in phase with the first Vsync according to the present invention. Accordingly, the time 4008 has also been spread throughout the frame time 4002. Locking the FOF clock pulse associated with row update 4004(1) to the first Vsync signal in a frame 4002 advantageously prevents flicker and other visual artifacts in the displayed image due to a large time gap 4008.

Figure 41:
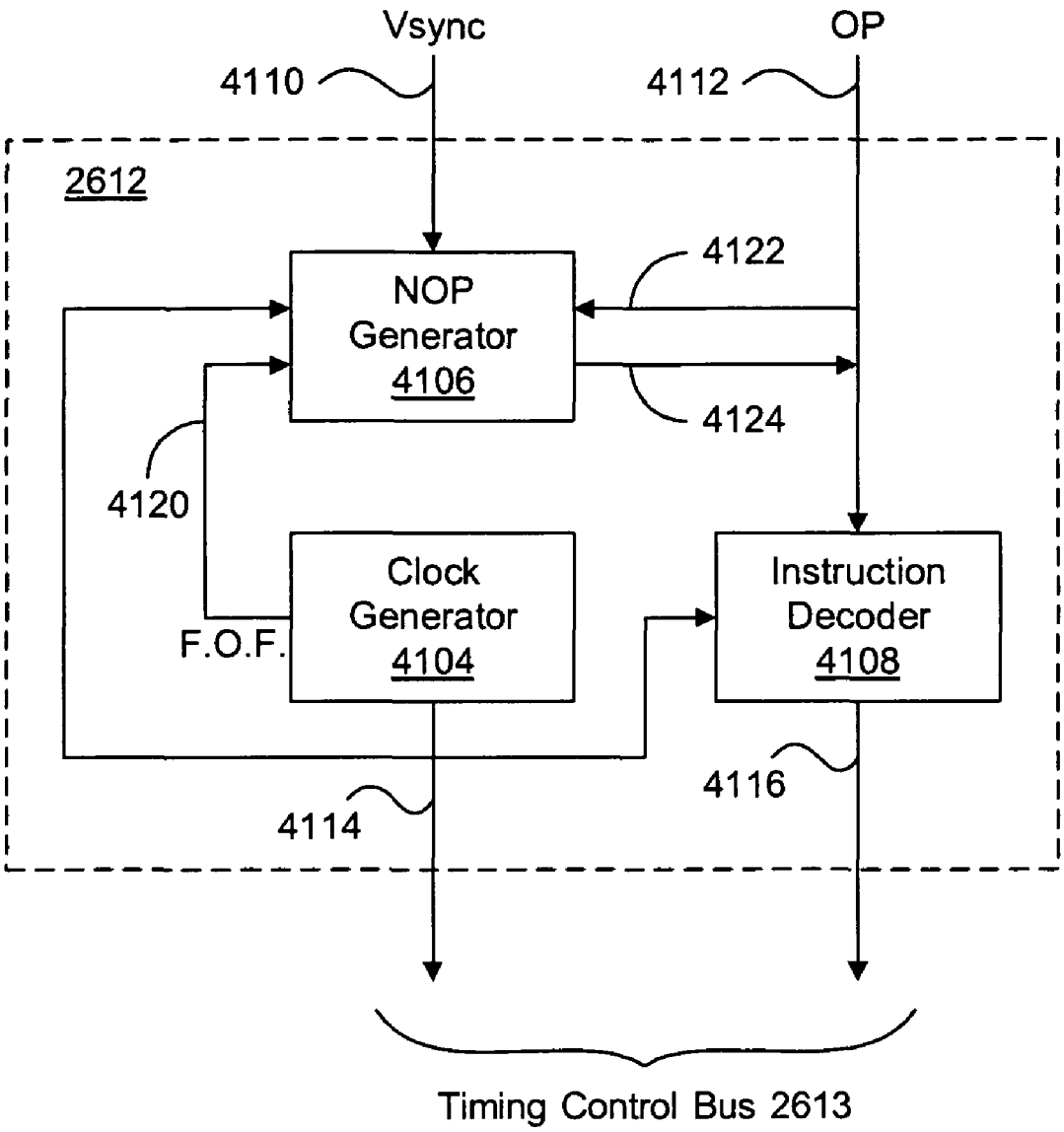
FIG. 41 is a block diagram of a timing control unit that spreads the unused frame time between the row updates according to the present invention.

FIG. 41 shows a particular embodiment of a global timing control unit 2612 that facilitates spreading the unused frame time 4006 throughout the frame 4002 and locking the FOF clock pulse to the first Vsync signal of each frame 4002 according to the present invention. In the present embodiment, global timing control unit 2612 includes a clock generator 4104, a "No Operation" (NOP) generator 4106, and an instruction decoder 4108. In addition, timing control unit 2612 receives Vsync signals via a synchronization input 4110 and operational instruction codes (opcodes) from an electronic system (not shown) via an opcode input 4112. Note that the Vsync signal received via input 4110 is the same Vsync signal received by the display device 500 or 2600 via inputs 508 and 2608, respectively. Clock generator 4104 generates a series of clock pulses on a clock output 4114 and instruction decoder 4108 generates a series of decoded operational instructions on an instruction output 4116. Clock output 4114 and instruction output 4116 together form timing control bus 2613.

Clock generator 4104 generates a series of count pulses according to a real clock frequency and outputs the clock pulses onto clock output 4114 and, ultimately, on timing control bus 2613. Recall that clock generator 4104's frequency is faster than the ideal clock frequency. Therefore, there will be some unused time 4006 in each frame 4002 without compensation. In addition, when clock generator 4104 generates the first clock pulse in each frame 4002, it transmits a FOF signal to NOP generator 4106 via a FOF line 4120.

NOP generator 4106 is a compensator that spreads the unused time 4006 between row updates 4004(1-*x*) and row update 4004(*x*) and the next Vsync signal during each frame 4002. Because NOP generator 4106 spreads the unused time 4006 between at least some of row updates 4004, it adds portions of the unused time to at least some of the time intervals 3002, 3302. In particular, NOP generator 4106 detects row-write instructions on opcode input 4112 via input 4122, and based on the number of row-write instructions, NOP generator 4106 generates NOP opcodes and stuffs the NOP opcodes into the opcode stream entering instruction decoder 4108 via NOP line 4124. In this manner, NOP generator 4106 acts as a compensator that adjusts the duration of at least some of the time intervals 3002, 3302 depending on the unused time 4006 and the number of row updates 4004 (1-*x*) occurring each frame 4002.

Instruction decoder 4108, responsive to clock signals received from clock generator 4104 and opcodes received via opcode input 4112 or from NOP generator 4106, decodes the opcodes and asserts the decoded operation instructions onto instruction output 41816. When instruction decoder 4108 receives a NOP opcode from NOP generator 4106, instruction decoder 4108 generates a NOP instruction and outputs the NOP instruction onto timing control bus 2613 via instruction output 4116. The elements of the display system 2600 that are connected to the timing control bus 2613, responsive to receiving a NOP instruction, are operative to ignore a clock pulse output by clock generator 4104 that corresponds with the NOP instruction.

By stuffing NOP instructions into the instruction stream (via instruction decoder 4108), NOP generator 4106 effectively slows down the output of clock generator 4104 because the elements of display system 2600 ignore particular clock pulses associated with the NOP instructions asserted on timing control bus 2613. NOP generator 4106 generates enough NOP opcodes so that the number of clock pulses effective on the display system 2600 is approximately equal to the ideal clock frequency. Effective clock pulses are pulses that are not associated with a NOP instruction.

Recall the example from FIG. 40A, where the frequency of the real clock generator 4104 was 68,335,909 Hz, whereas the ideal clock frequency was 68,321,280 Hz. In this example, 0.02141% of the clock pulses output by clock generator 4104 would have to be ignored by display system 2600 for display system 2600 to operate according to the ideal clock frequency. Accordingly, in the present example, NOP generator 4106 would be operative to generate 0.00685 NOP opcodes (i.e., 0.02141%*32 operational instructions per row update) for each row update 3704(*x*). NOP generator 4106 accumulates each fractional NOP opcode every row update 3704(1-*x*), subtracts off the whole NOP portion of the accumulated NOP, and stuffs the whole NOP opcodes into the opcode stream sent to instruction decoder 4108. NOP generator 4106 does this every row update 4004(1-*x*). By stuffing NOP opcodes into the opcode stream throughout the frame 4002, NOP generator 4106 distributes the unused frame time 4006 between row updates 4004(1-*x*) and between row update 4004(*x*) and the next Vsync. Accordingly, NOP generator 4106 adjusts the length of at least some of the time intervals 3002, 3302.

The function of NOP generator 4106 can be looked at from a different standpoint. For example, NOP generator 4106 could be viewed as increasing the ideal clock frequency to match the real clock frequency of clock generator 4104 by adding extra operational instructions to the ideal clock frequency calculation. In the particular example, the ideal clock frequency is adjusted by adding 0.00685 operational instructions to the value (i):

$$\text{Ideal_Clock}=x*(i+0.00685)*f_V\text{sync Hz.}$$

Accordingly, substituting the same numeric values for x, i, and f_Vsync given above, the Ideal_Clock frequency becomes 68,335,905 Hz, which is approximately equal to the Real_Clock frequency of 68,335,909 Hz.

It is also important to note that NOP generator 4106, once per frame, is further operative to dynamically adjust the value of the NOP fraction that it internally accumulates responsive to each row update 4004(1-*x*) such that the first Vsync and the FOF signal associated with row update 4004(1) remain substantially in phase over time. In particular, NOP generator 4106 measures the phase difference between a Vsync signal received via synchronization input 4110 and the FOF signal generated by clock generator 4104. NOP generator 4106 uses the phase difference to adjust the value of the NOP fraction to increase or decrease the number of NOP opcodes that are stuffed into the instruction stream each frame 4002. The value of the NOP fraction that is accumulated during each row update 4004(1-*x*) is sensitive enough that NOP generator 4106 can push or pull the FOF signal substantially into phase with the first Vsync signal of each frame 4002. Because the NOP generator 4106 updates the NOP fraction each frame 4002, it synchronizes the first Vsync and the FOF signals quickly after startup.

Note that the FOF signal does not have to be generated by clock generator 4104. For example, NOP generator 4106 could alternatively watch for a particular opcode, such as a first operational instruction associated with row update 4004 (1), on line 4122 to serve as a FOF signal.

It should also be noted that spreading the unused time 4006 among the row updates 4004(1-*x*) is particularly useful when the unused time 4006 is large enough to cause perceptible image defects. However, when the unused time 4006 is insignificant (i.e., when it doesn't degrade the displayed image), it may be more beneficial for NOP generator 4106 to stuff NOP opcodes into the instruction stream only after the last row update 4004(*x*) and before the next Vsync. This would put the unused time 4006 back at the end of the frame as shown in FIG. 40A, but would reduce the number of processes that needed to be performed during the earlier portions of the frame, which will be further described below. However, because the NOP generator 4106 would still dynamically update the value of its internal NOP fraction, the first Vsync and the FOF signal could still by synchronized. Therefore, it would be beneficial if NOP generator 4106 functioned so that either NOP opcode output scheme (i.e., (1) output NOP opcodes throughout the frame or (2) output NOP opcodes only after row update 4004(*x*)) could be selected by a hardware designer or other user based on the particular design of the display system.

Figure 42:
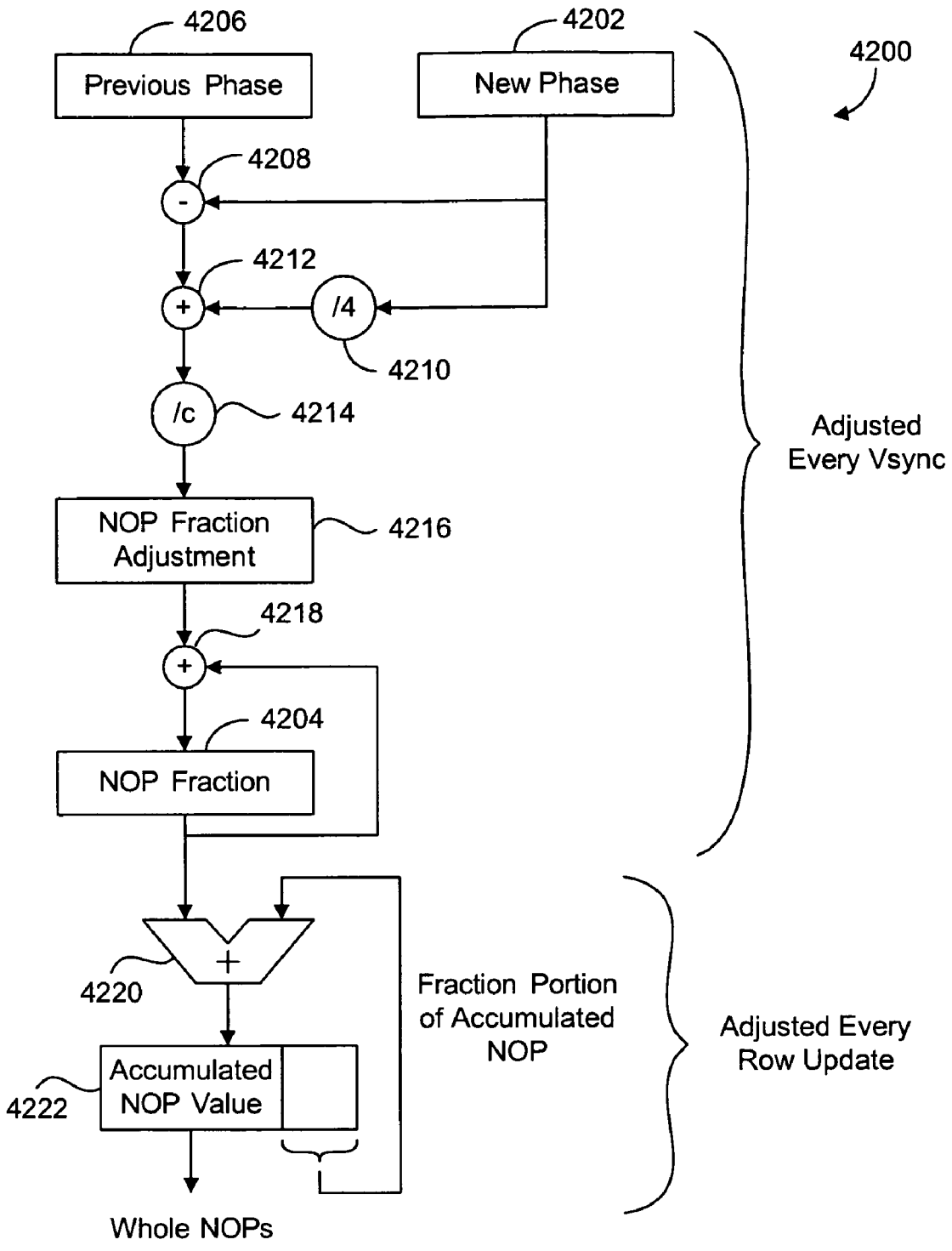
FIG. 42 shows a compensation scheme performed by the timing control unit of FIG. 41 for spreading the unused frame time between row updates according to the present invention.

FIG. 42 is an operational diagram 4200 showing how NOP generator 4106 generates NOP opcodes and synchronizes the first Vsync of each frame 4002 to the FOF signal associated with row update 4004(1). Immediately after startup, NOP generator 4106 detects the phase difference between the first Vsync received on Vsync input 4110 and the F.O.F. signal generated by clock generator 4104. NOP generator 4106 stores this phase value as new phase 4202. Near the same time, NOP generator 4106 loads an initial NOP fraction value into NOP fraction 4204.

NOP generator 4106 calculates and loads the initial value of NOP fraction 4104 at startup. In particular, after NOP generator 4106 receives a first Vsync, it waits for the last row write opcode to be asserted on opcode input 4112. Once NOP generator 4106 has determined that a last row write opcode has been asserted on opcode input 3812, it begins counting the clock pulses output by clock generator 4104 until it receives a next Vsync on synchronization input 4110. This count value represents the unused frame time 4006. Once NOP generator 4106 has determined the count value corresponding to the unused frame time 4006, it divides the count value by the number of row updates 4004(1-*x*) performed in a frame 3702. NOP generator 4106 then stores this quotient as the initial value of NOP fraction 4204. Note that NOP generator 4106 can determine the value of NOP fraction 4204 very quickly, but the calculation may require a few frames 4002 of time. As another option, the initial value 4204 could be pre-stored depending on the design of the display system such that NOP generator 4106 could simply load the initial value at start-up.

When NOP generator 4106 receives a next (e.g., second) Vsync signal on input 4110, NOP generator 4106 transfers and stores the new phase value 4202 as a past phase value 4206. NOP generator 4106 then determines and stores a new phase value 4202 representing the phase difference between the Vsync signal and the FOF signal associated with row update 4004(1) occurring in the new frame 4002. Then, in a subtraction operation 4208, NOP generator 4106 subtracts the new phase 4202 from the past phase 4206. NOP generator 4106 also divides the new phase value 4202 by a constant in a division operation 4210 and then, in an addition operation 4212, adds the difference from subtraction operation 4208 to the quotient calculated in the division operation 4210. In the present embodiment, the inventors have determined that dividing by four (4) in division operation 4210 yields acceptable adjustment values for the NOP fraction 3904.

Next, in another division operation 4214, NOP generator 4106 divides the sum calculated in addition operation 4212 by another constant (c) and then stores the quotient from operation 4214 as NOP fraction adjustment 4216. In the present embodiment, the value of the constant in operation 4214 depends on the number of row updates 4004(1-*x*) performed during each frame 4002. In particular, the constant (c) in operation 4214 is set to the following value:

$$c=2*\log_2(rb),$$

where r equals the number of rows 2914 in imagers 2604 and b equals the number of bits in data word 2702.

It should be noted that NOP generator 4106 can calculate a NOP fraction adjustment 42916 for the first frame 3702 it measures new phase 4202 based only on the new phase 4202. As another alternative, NOP generator 4106 could wait for two frames 4002 to calculate NOP fraction adjustment 4216 such that it had both new phase 4202 and past phase 4206.

Once NOP Fraction Adjustment 4216 is calculated, NOP generator 4106 adds the NOP fraction adjustment value 4216 to the NOP fraction 4204 in an addition operation 4218 and stores the sum as a new NOP fraction 4204. Note that NOP generator 4106 adjusts the value of the NOP fraction 4204 once per frame. In addition, NOP fraction 42904 is an unsigned binary fraction with sufficient bit-depth to permit fine adjustment of the number of NOPs output during each frame.

In contrast to NOP fraction 42904, the new phase 4202, the past phase 4206, and the NOP fraction adjustment 4216 are all signed quantities. Because these values are signed, NOP generator 4106 can adjust the value of the NOP fraction 42904 to keep Vsync and FOF in phase over many frames regardless of whether the FOF signal trails or leads the first Vsync in each frame 4002. New phase 4202, past phase 4206, and NOP fraction adjustment 4216 also have sufficient bit depth to adequately adjust the value of NOP fraction 4204

NOP generator 4106 receives a write instruction via opcode input 4112 and line 4122 for each row that is updated during a frame. For each row update 4004(1-*x*), an accumulator 4220 receives the updated NOP fraction 4204 and a fractional portion of an accumulated NOP value stored in accumulated NOP register 4222. The accumulator 4220 adds the two values together and stores the new accumulated NOP value in accumulated NOP register 4222. Then, NOP generator 4106 subtracts the integer portion off of the accumulated NOP value stored in accumulated NOP register 4222 and stuffs a number of NOP opcodes into the instruction stream equal to the whole portion of accumulated NOP value stored in register 42922. The fraction portion of the accumulated NOP value is saved and fed back into the accumulator 4220 during the next row update 4004. This entire process is repeated for all subsequent row updates 4004. In this manner, NOP generator 4106 spreads the unused time 4006 throughout the frame time 4002 and synchronizes the FOF signal with the first Vsync in each frame 40702. In the present embodiment, the accumulated NOP value stored in accumulated delay register 422 is an unsigned quantity.

It should be noted that, as described above, NOP generator 4106 could output NOP opcodes only after the last row update 4004(*x*) has occurred in each frame 4002. In such a case, accumulator 4220 would add the NOP fraction 4204 to the entire accumulated NOP value stored in register 4222 for each row update 4004(1-*x*). Accordingly, accumulated NOP register 4222 would output a number of NOP opcodes equal to the whole portion of the accumulated NOP value in register 4222 only after the last row update 4004(*x*). Any fractional portion of the accumulated NOP value in register 4222 could be truncated or added into the accumulator during the next frame 4002.

According to the operation scheme shown in FIG. 42, NOP generator 4106 provides the advantages of spreading the unused time 4006 throughout each frame 4002 in the form of NOP opcodes. Spreading the unused time 4006 throughout the frame 4002 advantageously increases the length of at least some of the time intervals 3002, 3302. In addition, the value of the NOP fraction 4204 can be dynamically adjusted to keep the FOF signal associated with each frame 4002 in phase with the first Vsync associated with each frame 4002. Therefore, NOP generator 4106 prevents or minimizes visually perceptible defects in the displayed image.

It should also be noted that although FIGS. 40-42 have been described with reference to the embodiment of display system 2600 shown in FIG. 26, this aspect of the present invention is also applicable to the display system shown in FIG. 5.

Several modulation schemes of the present invention have now been described in detail, wherein the number of intensity values have been equal to one or two times the number of rows in the array (i.e., n=1 or n=2). However, it should be noted that the benefits of the present invention can be realized when n is assigned a value greater than two (e.g., n=3 or n=4) as long as the bit code and row balancing constraints are met. On a practical note, the value of n may often be governed by the speed limitations of the display system, because as the value of n increases, the number of time intervals (and likely row updates) will also increase.

The methods of the present invention will now be described with respect to FIGS. 43-48. For the sake of clear explanation, these methods are described with reference to particular elements of the previously described embodiments that perform particular functions. However, it should be noted that other elements, whether explicitly described herein or created in view of the present disclosure, could be substituted for those cited without departing from the scope of the present invention. Therefore, it should be understood that the methods of the present invention are not limited to any particular element(s) that perform(s) any particular function(s). Further, some steps of the methods presented need not necessarily occur in the order shown. For example, in some cases two or more method steps may occur simultaneously. These and other variations of the methods disclosed herein will be readily apparent, especially in view of the description of the present invention provided previously herein, and are considered to be within the full scope of the invention.

Figure 43:
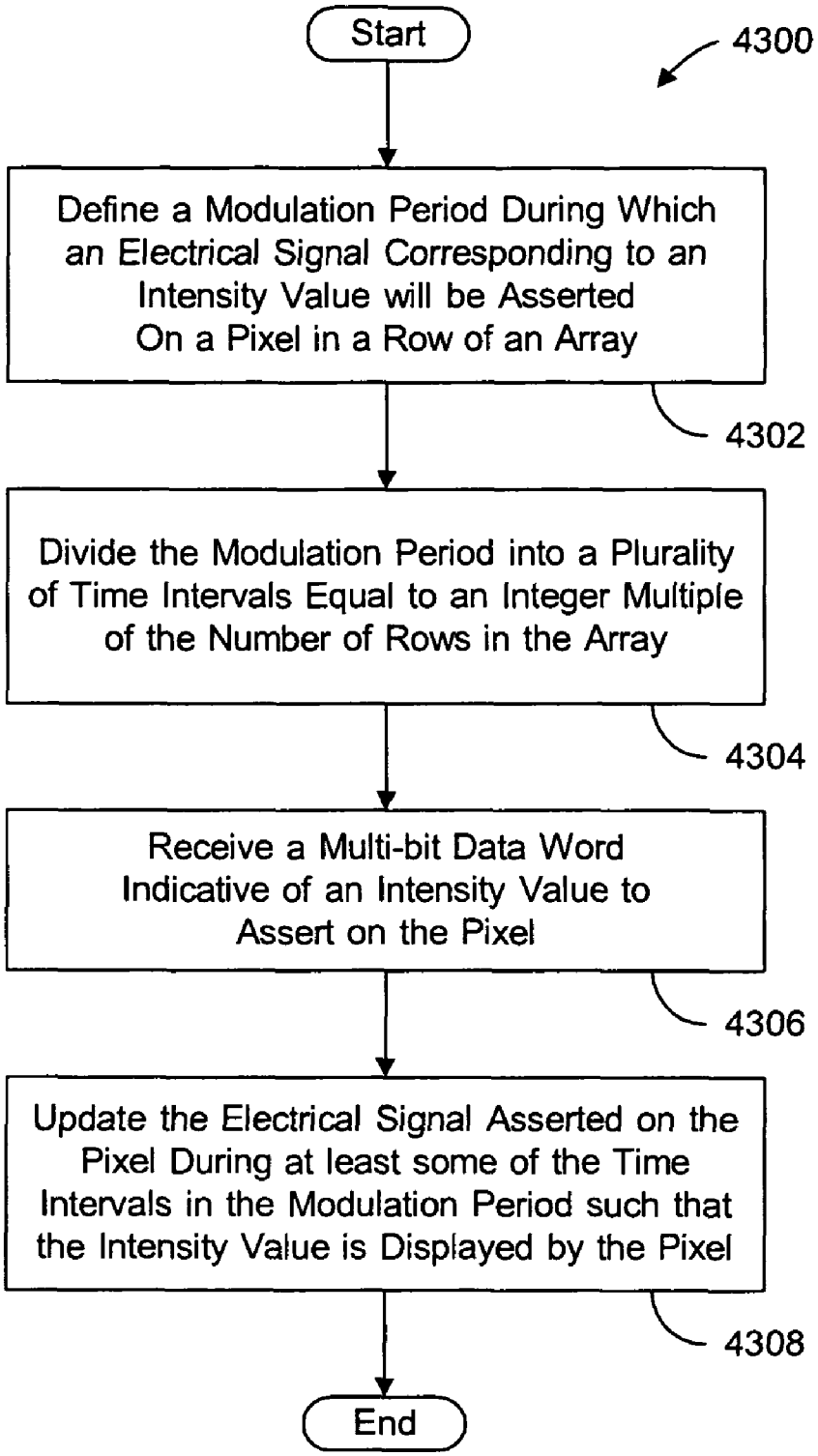
FIG. 43 is a flowchart summarizing a method of driving a display according to one aspect of the present invention.

FIG. 43 is a flowchart summarizing a method 4300 of driving a pixel 2910 with any one of a number of intensity values equal to an integer multiple (e.g., n=1, 2, 3, 4, etc.) of the number of rows 2914 in the display 2908 according to one aspect of the present invention. In a first step 4302, imager control unit 2616 defines a modulation period during which an electrical signal corresponding to an intensity value will be asserted on a pixel 2910 in a row 2914 of display 2908. Then, in a second step 4304, imager control unit 2616 divides the modulation period into a plurality of time intervals 3002, 3302, the number of time intervals 3002, 3302 equal to an integer multiple (n) of the number of rows 2914 in display 2908. Next, in a third step 4306, display driver 2602 receives a multi-bit data word 2702, 2702A indicative of an intensity value to assert on the pixel 2910. Finally, in a fourth step 4308, imager control unit 2616 and various components of imager 2904 (e.g., row logic 2906) update the electrical signal asserted on the pixel 2910 during at least some of the time intervals 3002, 3302 in the modulation period such that the intensity value defined by the data word 2702, 2702A is displayed by the pixel 2910.

Figure 44:
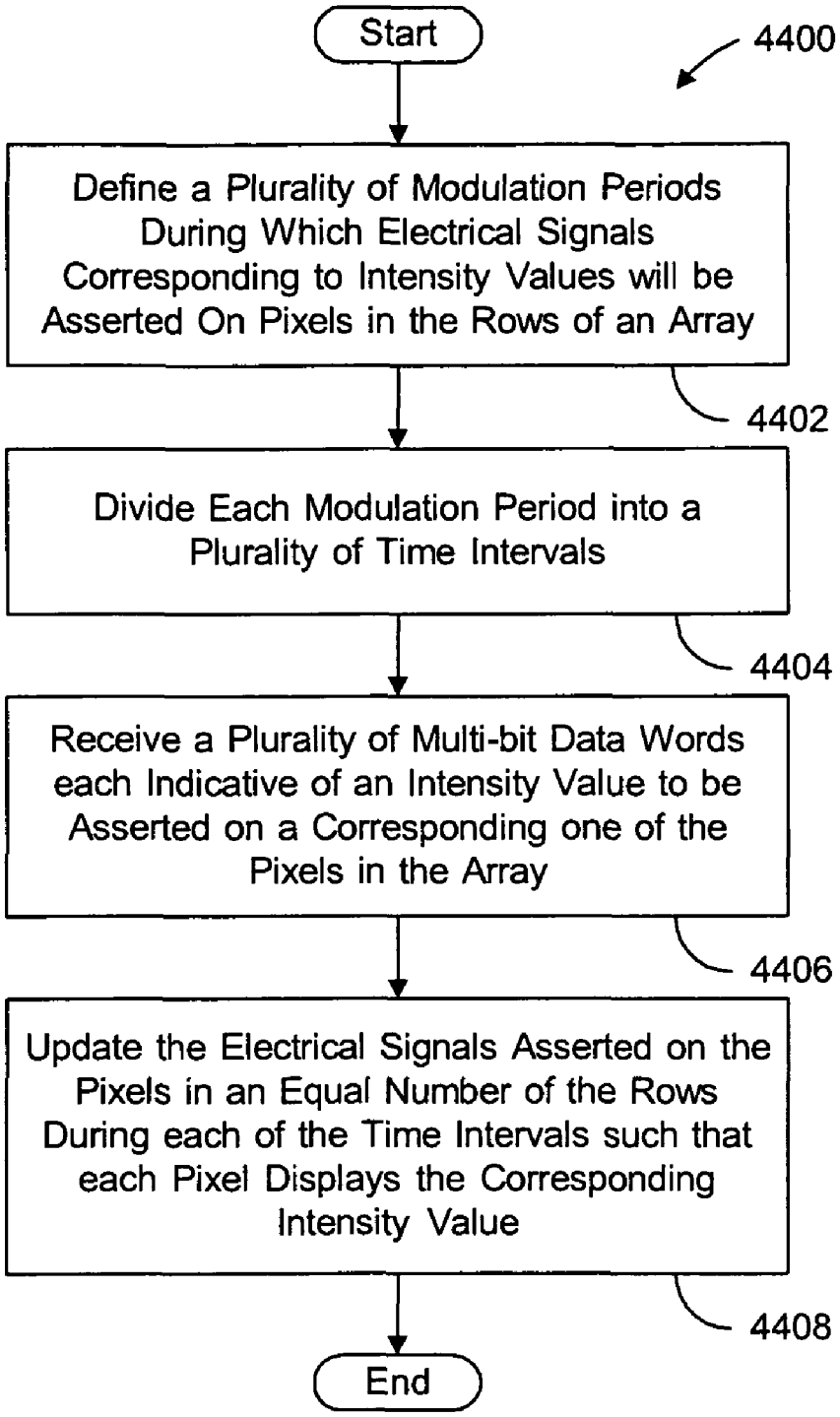
FIG. 44 is a flowchart summarizing a method of driving a display according to another aspect of the present invention.

FIG. 44 is a flowchart summarizing a method 4400 of driving a display with 100% efficiency according to another aspect of the present invention. In a first step 4402, imager control unit 2616 defines a plurality of modulation periods during which electrical signals corresponding to intensity values will be asserted on pixels 2910 in the rows 2914 of display 2908. In a second step 4404, imager control unit 2616 divides each of the modulation periods into a plurality of time intervals 3002, 3302. Then, in a third step 4408, display driver 2602 receives a plurality of multi-bit data words 2702, 2702A, each of which is indicative of an intensity value to be asserted on a corresponding one of pixels 2910. And in a fourth step 4408, imager control unit 2616 and various components of imager 2904 (e.g., row logic 2906, etc.) update the electrical signals asserted on the pixels 2910 in an equal number of rows 2914 during each of the plurality of time intervals 3002, 3302 such that each pixel displays a corresponding intensity value. The equal number of rows updated during each time interval 3002, 3302 is usually less than all of the rows in the display.

Figure 45:
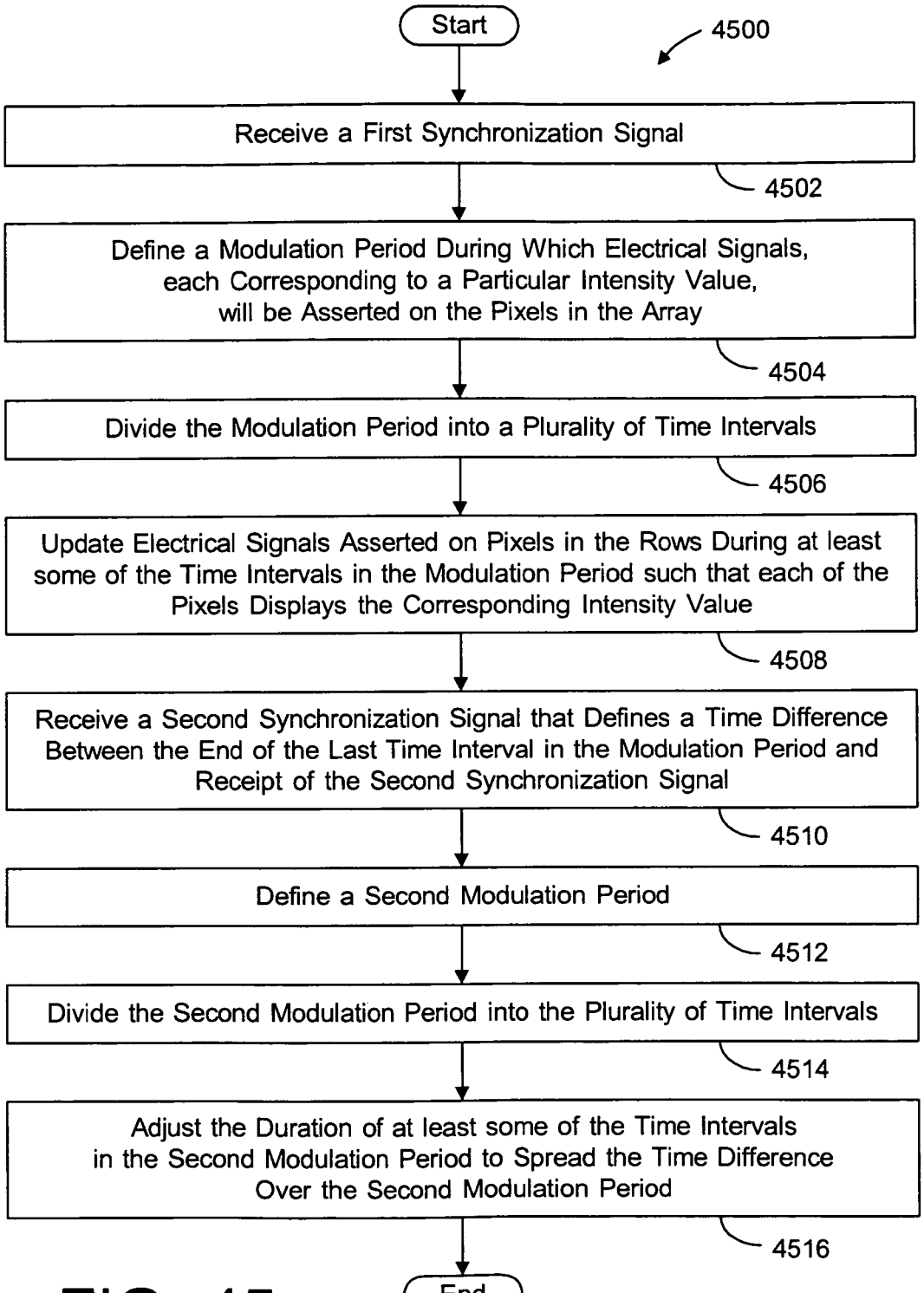
FIG. 45 is a flowchart summarizing a method for spreading any unused frame time between the row updates performed during the frame according to still another aspect of the present invention.

FIG. 45 is a flowchart summarizing a method 4500 for spreading any unused frame time 4006 between the row updates 40704(1-*x*) performed during the frame time 4002 according to another aspect of the present invention. In a first step 4502, display driver 2602 and global timing control unit 2612 receive a first synchronization signal (e.g., a Vsync). Then, in a second step 4504, imager control unit 2616 defines a modulation period during which electrical signals, each corresponding to a particular intensity value, will be asserted on pixels 2910 in display 2908. Next, in a third step 4506, imager control unit 2616 divides the modulation period into a plurality of time intervals 3002, 3302. Then, in a fourth step 4508, imager control unit 2616 and various components of imager 2904 (e.g., row logic 2906, etc.) update the electrical signals asserted on the pixels 2910 in the rows 2914 during at least some of the time intervals 3002, 3302 in the modulation period such that each pixel 2910 displays a corresponding intensity value. Then, in a fifth step 4510, global timing control unit 2612 receive a second synchronization signal that defines a time difference between the end of the last time interval 3002, 3302 in the modulation period and receipt of a second synchronization signal. Then, in a sixth step 4512, imager control unit 2616 defines a second modulation period during which electrical signals will be asserted on the pixels 2610 in display 2608. Next, in a seventh step 4514, imager control unit 2616 divides the second modulation period into the plurality of time intervals 3002, 3302. Finally, in an eighth step 4516, NOP generator 4106 of global timing control unit 2612 generates NOP opcodes that adjust the duration of at least some time intervals 3002, 3302 in the second modulation period in order to spread the time difference throughout the second modulation period.

Figure 46:
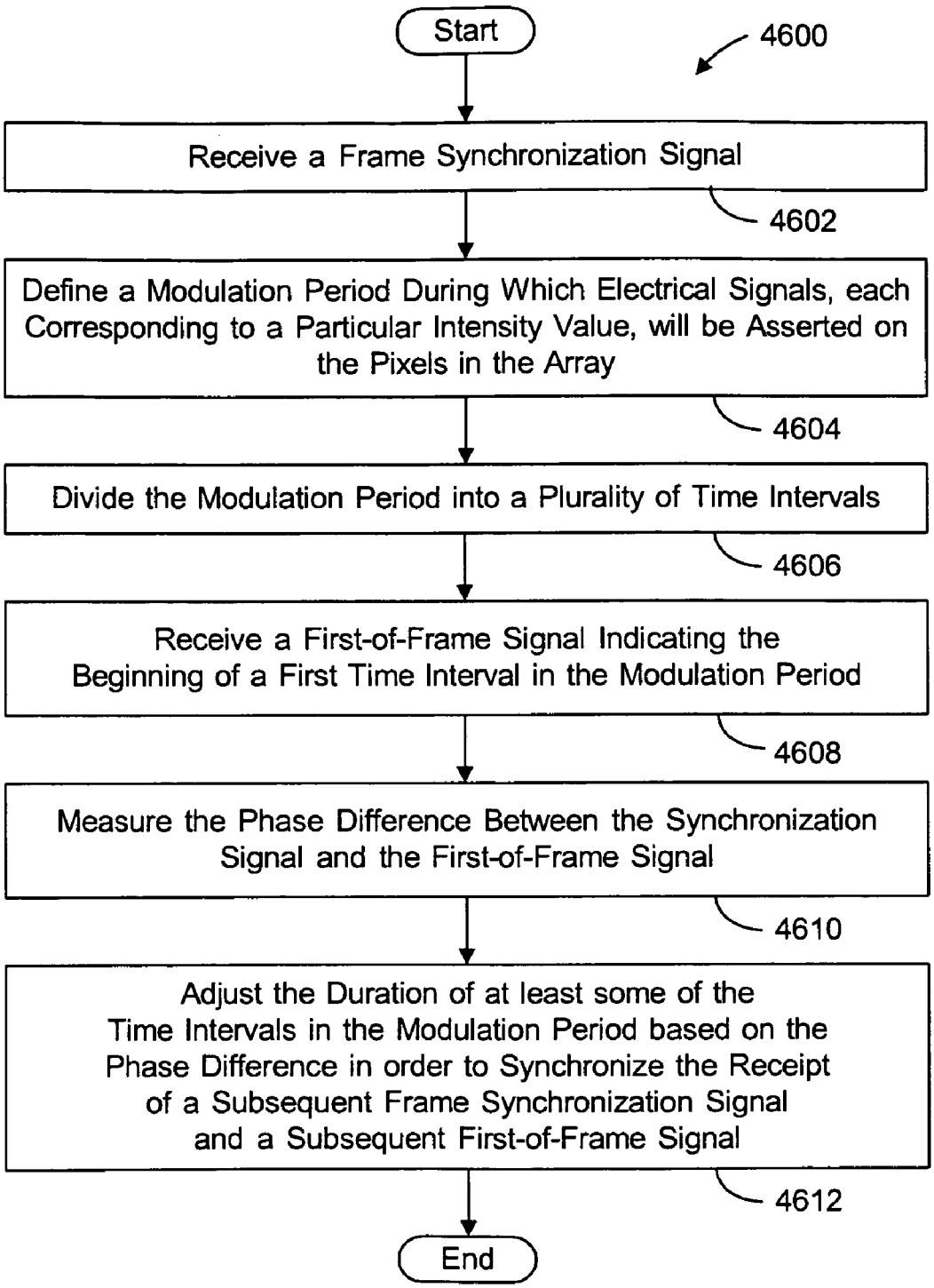
FIG. 46 is a flowchart summarizing a method for synchronizing a frame synchronization signal and a first-of-frame signal according to yet another aspect of the present invention.

FIG. 46 is a flowchart summarizing a method 4600 for synchronizing a frame synchronization signal and a first-of-frame signal during a frame according to yet another aspect of the present invention. In a first step 4602, display driver 2602 and global timing control unit 2612 receive a first synchronization signal (e.g., a Vsync). Then, in a second step 4604, imager control unit 2616 defines a modulation period during which electrical signals, each corresponding to a particular intensity value, will be asserted on pixels 2910 in display 2908. Next, in a third step 4606, imager control unit 2616 divides the modulation period into a plurality of time intervals 3002, 3302. Then, in a fourth step 4608, NOP generator 4106 of global timing control unit 2612 receives a first-of-frame signal. Subsequently, in a fifth step 4610, NOP generator 4106 measures the phase difference between the synchronization signal received in step 4602 and the first-of-frame signal. Then, in a sixth step 4612, NOP generator 4106 adjusts the duration of at least some of the time intervals in the modulation period based on the phase difference in order to synchronize receipt of a subsequent frame synchronization signal and a subsequent first-of-frame signal.

Figure 47:
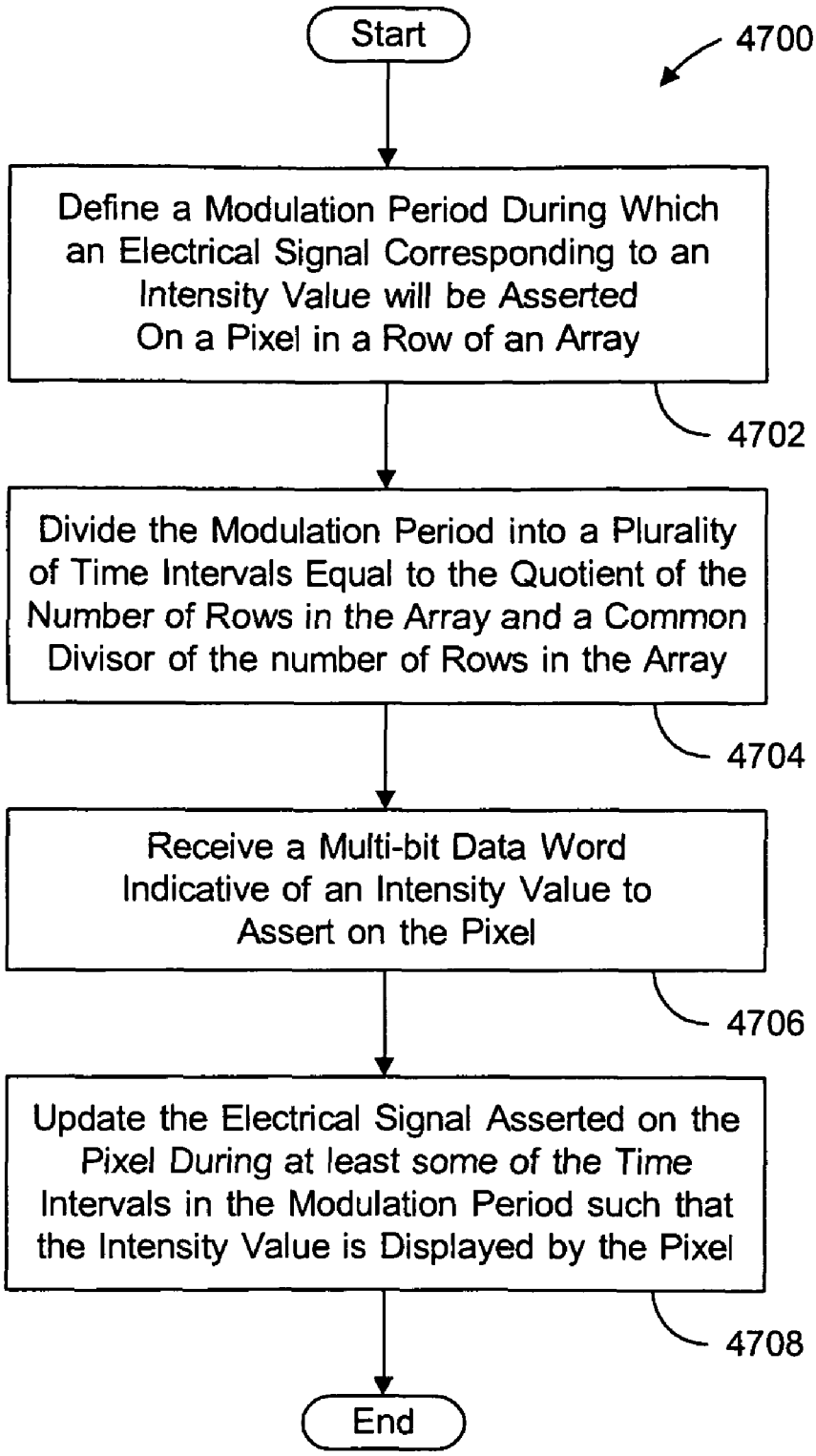
FIG. 47 is a flowchart summarizing a method of driving a display according to still another aspect of the present invention.

FIG. 47 is a flowchart summarizing a method 4700 of driving a pixel with any one of a number of intensity values where the number of intensity values is equal to the quotient of the number of rows in the array and a divisor (m) of the number of rows in the array. In a first step 4702, imager control unit 516 defines a modulation period during which an electrical signal corresponding to an intensity value will be asserted on a pixel 810 in a row 814 of display 808. Then, in a second step 4704, imager control unit 516 divides the modulation period into a plurality of time intervals 3702(0-23), the number of time intervals 3702 equal to the quotient of the number of rows 814 in display 808 and a divisor (m). Next, in a third step 4706, display driver 502 receives a multi-bit data word 3802 indicative of an intensity value to assert on the pixel 810. Finally, in a fourth step 4708, imager control unit 516 and various components of imager 504(*r, g, b*) update the electrical signal asserted on the pixel 810 during at least some of the time intervals 3702 in the pixel's modulation period such that the intensity value defined by the data word 3802 is displayed by the pixel 810.

Figure 48:
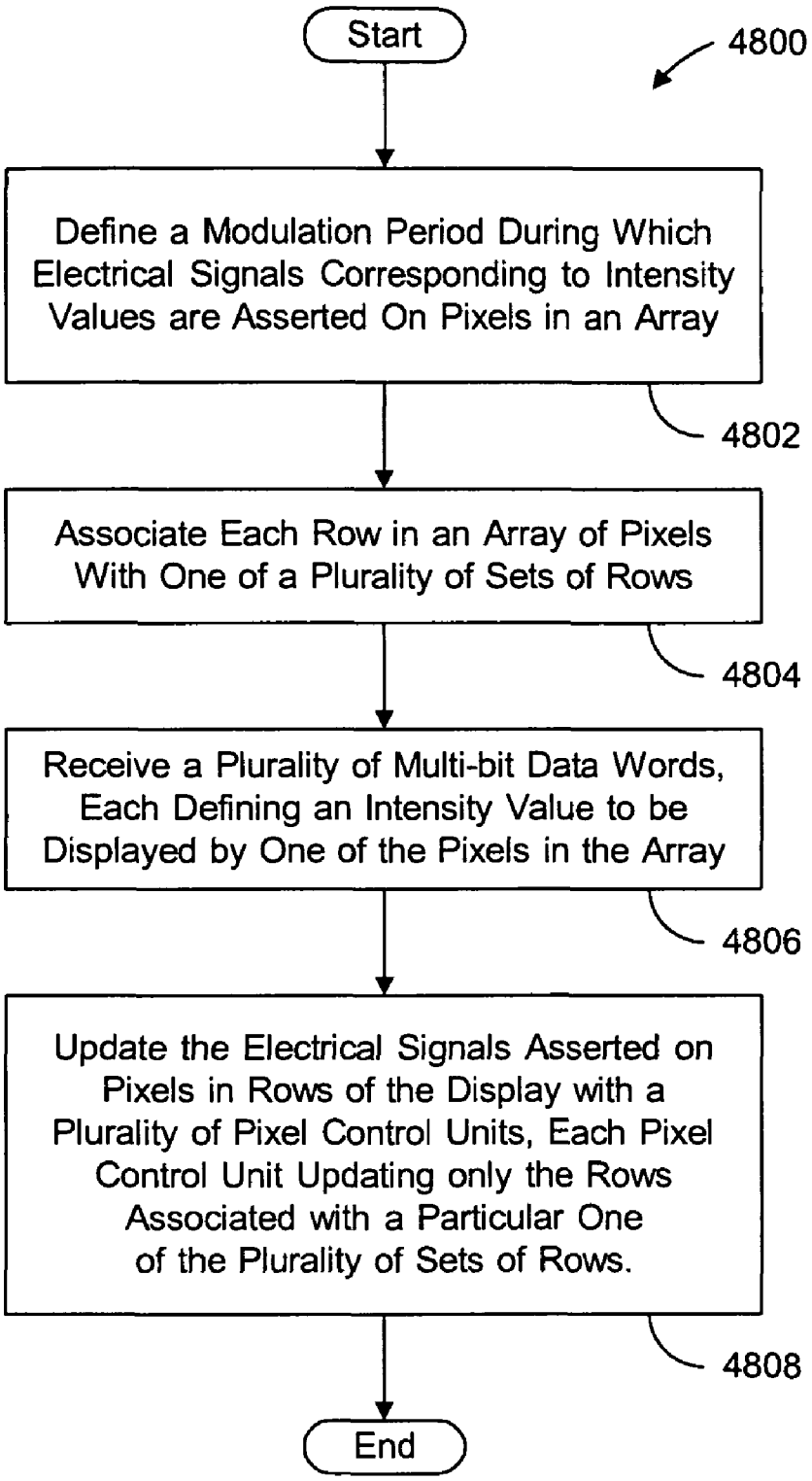
FIG. 48 is a flowchart summarizing a method for driving a display using a plurality of pixel control units according to yet another aspect of the present invention.

FIG. 48 is a flowchart summarizing a method 4800 for driving a display using a plurality of pixel control units 3916, 3918 embedded in an imager 3904(*r, g, b*) according to yet another aspect of the present invention. In a first step 4802, imager control unit 516, 2616 defines a modulation period during which electrical signals corresponding to intensity values are asserted on pixels in the rows 3914 of display 3908. In a second step 4804, each row 3914 in display 3908 is associated with one of a plurality of sets of rows 3914. In a particular embodiment, even-numbered rows 3914(even) form one set and odd-numbered rows (3914) define a second set. Then, in a third step 4806, display driver 2602 receives a plurality of multi-bit data words (e.g., data word 2702, 2702A), each indicative of an intensity value to be asserted on the pixels in display 3908. Thereafter, in a fourth step 4808, the electrical signals asserted on the pixels in rows 3914 in display 3908 are updated by a plurality of pixel control unit 3916, 3918 such that each pixel control unit 3916, 3918 updates only one set of rows 3914. In the present embodiment, pixel control unit 3916 updates only the even-numbered rows 3914(even) in display 3908 while pixel control unit 3918 updates only the odd-numbered rows 3914(odd) in display 3908.

The description of particular embodiments of the present invention is now complete. Many of the described features may be substituted, altered or omitted without departing from the scope of the invention. For example, alternate bit codes can be used with the present invention as long as the bit-code criteria are met. As yet another example, although the embodiment disclosed is primarily illustrated as a hardware implementation, the present invention can be implemented with hardware, software, firmware, or any combination thereof. As still another example, many of the functional elements shown as part of the imagers of the present invention could be relocated to other elements of the system, such as the display driver, and still provide their respective functions. These and other deviations from the particular embodiments shown will be apparent to those skilled in the art, particularly in view of the foregoing disclosure.

We claim:

1. A method for driving a display device including an array of pixels arranged in a plurality of columns and a plurality of rows, said method comprising:

defining a plurality of modulation periods during which electrical signals corresponding to particular intensity values will be asserted on said pixels in said rows of said array;

associating each of said modulation periods with at least one of said rows;

dividing each of said plurality of modulation periods into a plurality of time intervals;

receiving a plurality of multi-bit data words each indicative of one of said intensity values to be asserted on said corresponding one of said pixels in said array;

discarding at least one bit of each of said multi-bit data words prior to the end of said modulation period associated with said corresponding one of said pixels displaying said intensity value defined by said each multi-bit data word; and updating said electrical signals asserted on said pixels in an equal number of said rows during each of said time intervals based on any remaining bits of said multi-bit data words corresponding to said pixels such that each of said pixels displays said corresponding one of said intensity values; and wherein less than all of said rows in said array are updated during each of said plurality of time intervals.

2. A method according to claim 1, wherein:

said step of dividing each of said plurality of modulation periods into said plurality of time intervals further includes dividing each of said modulation periods into a number of time intervals equal to n times the number of said rows in said array; and n is an integer greater than zero.

3. A method according to claim 2, wherein:

each row in said array is assigned one of a plurality of values; and said step of updating said signals further includes updating said signals on said pixels in an equal number of said rows having each of said plurality of values during each of said time intervals.

4. A method according to claim 3, wherein:

the number of said values is two;

a first value is one of even and odd; and a second value is the other of said even and odd.

5. A method according to claim 2, wherein:

said step of updating said signals asserted on said pixels includes updating said signals asserted on said pixels in (b/n) of said rows during each of said time intervals; and b equals the number of bits in each of said plurality of multi-bit data words.

6. A method according to claim 2, wherein each of said modulation periods is temporally offset from every other one of said modulation periods by at least n said time intervals.

7. A method according to claim 2, wherein:

each bit in each of said multi-bit data words has a weighted value; and the sum of said weighted values of said bits in each of said multi-bit data words is equal to n times the number of said rows in said array.

8. A method according to claim 2, wherein:

each bit in each of said multi-bit data words has a weighted value; and the sum of said weighted values of said bits in each of said multi-bit data words is an even number.

9. A method according to claim 2, wherein:

each bit in each of said multi-bit data words has a weighted value; and the sum of said weighted values of said bits in each of said multi-bit data words is evenly divisible by 2n.

10. A method according to claim 2, wherein the number of said time intervals is evenly divisible by 2n.

11. A method according to claim 2, wherein the number of bits in each of said multi-bit data words is evenly divisible by 2n.

12. A method according to claim 1, further comprising:

receiving a binary-weighted data word; and converting said binary-weighted data word into one of said plurality of multi-bit data words, said multi-bit data words having at least one binary-coded bit and at least one thermometer-coded bit.

13. A method according to claim 1, further comprising:

receiving a frame synchronization signal at the beginning of a particular one of said modulation periods;

receiving a first-of-frame signal indicating the beginning of a first one of said time intervals in said particular modulation period;

measuring the phase difference between said frame synchronization signal and said first-of-frame signal; and adjusting the duration of at least some of said time intervals based on said phase difference in order to synchronize receipt of a subsequent frame synchronization signal and a subsequent first-of-frame signal.

14. A method according to claim 1, wherein each pixel in said array includes a liquid crystal layer disposed between a pixel electrode and a common electrode, said method further comprising:

asserting said signals on said pixels relative to said common electrode in a first bias direction during a first group of said time intervals; and asserting said signals on said pixels in a second bias direction during a second group of said time intervals.

15. A method according to claim 1, further comprising:

associating each of said rows in said array with one of a plurality of sets;

updating the electrical signals asserted on said pixels in said plurality of rows during each of said time intervals with a plurality of pixel control units; and wherein each of said plurality of pixel control units updates only the rows associated with a particular one of said sets of said rows during each of said time intervals.

16. A display driver for driving an array of pixels arranged in a plurality of columns and a plurality of rows, said display driver comprising:

a timer operative to generate a series of time values each associated with a respective one of a plurality of time intervals;

a data input terminal set for receiving a plurality of multi-bit data words, each of said multi-bit data words indicative of an intensity value to be asserted on a corresponding one of said pixels; and control logic operative to define a plurality of modulation periods during which electrical signals corresponding to said particular intensity values will be asserted on said pixels in said rows of said array, each of said modulation periods including a plurality of said time intervals, associate each of said modulation periods with at least one of said rows, discard at least one bit of each of said multi-bit data words prior to the end of said modulation period associated with said corresponding one of said pixels displaying said intensity value defined by said each multi-bit data word, and update the electrical signals asserted on said pixels in an equal number of said rows during each of said time intervals based on any remaining bits of said multi-bit data words corresponding to said pixels such that each of said pixels displays said corresponding one of said intensity values; and wherein said control logic updates less than all of said rows during each of said plurality of time intervals.

17. A display driver according to claim 16, wherein:

each of said plurality of modulation periods includes a number of time intervals equal to n times the number of said rows in said array; and n is an integer greater than zero.

18. A display driver according to claim 17, wherein:

each row in said array is assigned one of a plurality of values; and said control logic is further operative to update said signals on said pixels in an equal number of said rows assigned to each of said plurality of values during each of said time intervals.

19. A display driver according to claim 18, wherein:

the number of said values is two;

a first value is one of even and odd; and a second value is the other of said even and odd.

20. A display driver according to claim 17, wherein:

said control logic is further operative to update signals asserted on pixels in (b/n) ones of said rows during each of said time intervals; and b equals the number of bits in each of said multi-bit data words.

21. A display driver according to claim 17, wherein said control logic is further operative to temporally offset each modulation period from every other one of said plurality of modulation periods by at least n said time intervals.

22. A display driver according to claim 17, wherein:

each bit in each of said multi-bit data words has a weighted value; and the sum of said weighted values of said bits in each of said multi-bit data words is equal to n times the number of said rows in said array.

23. A display driver according to claim 17, wherein:

each bit in each of said multi-bit data words has a weighted value; and the sum of said weighted values of said bits in each of said multi-bit data words is an even number.

24. A display driver according to claim 17, wherein:

each bit in each of said multi-bit data words has a weighted value; and the sum of said weighted values of said bits in each of said multi-bit data words is evenly divisible by 2n.

25. A display driver according to claim 17, wherein the number of said time intervals in each of said modulation periods is evenly divisible by 2n.

26. A display driver according to claim 17, wherein the number of bits in each of said multi-bit data words is evenly divisible by 2n.

27. A display driver according to claim 16, wherein:

at least one of said multi-bit data words is a binary-weighted data word; and said control logic is further operative to convert said binary-weighted data word into a data word having at least one binary-coded bit and at least one thermometer-coded bit.

28. A display driver according to claim 16, further comprising:

a synchronization input operative to receive a series of frame synchronization signals; and a compensator operative to adjust the duration of subsequent ones of said time intervals to spread the time difference between the end of the last one of said time intervals in one of said modulation periods and a next frame synchronization signal over a subsequent one of said plurality of modulation periods.

29. A display driver according to claim 16, wherein:

each pixel in said array includes a liquid crystal layer disposed between a pixel electrode and a common electrode; and said display driver further includes a debias controller operative to provide a first debias signal indicative of a first bias direction for a first group of said time intervals, and provide a second debias signal indicative of a second bias direction for a second group of said time intervals.

30. A display driver according to claim 16, wherein:

said control logic further includes a plurality of pixel control units, each of said pixel control units operative to update the electrical signals asserted on said pixels; and said control logic is further operative to associate each row in said array with one of a plurality of sets of rows, and cause at least some of said pixel control units to update the electrical signals asserted on said pixels in at least one of said rows during each of said time intervals, each of said pixel control units updating only said rows associated with one of said sets of rows.

31. A non-transitory, electronically-readable storage medium having code embodied therein for causing an electronic device to:

define a plurality of modulation periods during which electrical signals corresponding to particular intensity values will be asserted on pixels in rows of an array;

associate each of said modulation periods with at least one of said rows;

divide each of said plurality of modulation periods into a plurality of time intervals;

receive a plurality of multi-bit data words each indicative of one of said intensity values to be asserted on said corresponding one of said pixels in said array;

discard at least one bit of each of said multi-bit data words prior to the end of said modulation period associated with said corresponding one of said pixels displaying said intensity value defined by said each multi-bit data word; and update said electrical signals asserted on said pixels in an equal number of said rows during each of said time intervals based on any remaining bits of said multi-bit data words corresponding to said pixels such that each of said pixels displays said corresponding one of said intensity values; and wherein less than all of said rows in said array are updated during each of said plurality of time intervals.

32. A non-transitory, electronically-readable storage medium according to claim 31, wherein:

said code is operative to cause said electronic device to divide each of said modulation periods into a number of time intervals equal to n times the number of said rows in said array; and n is an integer greater than zero.

33. A non-transitory, electronically-readable storage medium according to claim 32, wherein:

each row in said array is assigned one of a plurality of values; and said code is operative to cause said electronic device to update said signals on said pixels in an equal number of said rows having each of said plurality of values during each of said time intervals.

34. A non-transitory, electronically-readable storage medium according to claim 33, wherein:

the number of said values is two;

a first value is one of even and odd; and a second value is the other of said even and odd.

35. A non-transitory, electronically-readable storage medium according to claim 32, wherein:

said code is operative to cause said electronic device to update said signals asserted on said pixels in (b/n) of said rows during each of said time intervals; and b equals the number of bits in each of said plurality of multi-bit data words.

36. A non-transitory, electronically-readable storage medium according to claim 32, wherein each of said modulation periods is temporally offset from every other one of said modulation periods by at least n said time intervals.

37. A non-transitory, electronically-readable storage medium according to claim 32, wherein:

each bit in each of said multi-bit data words has a weighted value; and the sum of said weighted values of said bits in each of said multi-bit data words is equal to n times the number of said rows in said array.

38. A non-transitory, electronically-readable storage medium according to claim 32, wherein:

each bit in each of said multi-bit data words has a weighted value; and the sum of said weighted values of said bits in each of said multi-bit data words is an even number.

39. A non-transitory, electronically-readable storage medium according to claim 32, wherein:

each bit in each of said multi-bit data words has a weighted value; and the sum of said weighted values of said bits in each of said multi-bit data words is evenly divisible by 2n.

40. A non-transitory, electronically-readable storage medium according to claim 32, wherein the number of said time intervals is evenly divisible by 2n.

41. A non-transitory, electronically-readable storage medium according to claim 32, wherein the number of bits in each of said multi-bit data words is evenly divisible by 2n.

42. A non-transitory, electronically-readable storage medium according to claim 31, wherein said code is further operative to cause said electronic device to:

receive a binary-weighted data word; and convert said binary-weighted data word into one of said plurality of multi-bit data words, said multi-bit data words having at least one binary-coded bit and at least one thermometer-coded bit.

43. A non-transitory, electronically-readable storage medium according to claim 31, wherein said code is further operative to cause said electronic device to:

receive a frame synchronization signal at the beginning of a particular one of said modulation periods;

receive a first-of-frame signal indicating the beginning of a first one of said time intervals in said particular modulation period;

measure the phase difference between said frame synchronization signal and said first-of-frame signal; and adjust the duration of at least some of said time intervals based on said phase difference in order to synchronize receipt of a subsequent frame synchronization signal and a subsequent first-of-frame signal.

44. A non-transitory, electronically-readable storage medium according to claim 31, wherein said code is further operative to cause said electronic device to:

assert said signals on said pixels in a first bias direction relative to a common electrode of said array during a first group of said time intervals; and assert said signals on said pixels in a second bias direction during a second group of said time intervals.

45. A non-transitory, electronically-readable storage medium according to claim 31, wherein:

said code is further operative to cause said electronic device to:

associate each of said rows in said array with one of a plurality of sets, and update the electrical signals asserted on said pixels in said plurality of rows during each of said time intervals with a plurality of pixel control units; and each of said plurality of pixel control units updates only the rows associated with a particular one of said sets of said rows during each of said time intervals.

* * * * *